US011648572B2

(12) United States Patent
Matsui et al.

(10) Patent No.: US 11,648,572 B2
(45) Date of Patent: May 16, 2023

(54) SHOWER HEAD

(71) Applicant: TOTO LTD., Kitakyushu (JP)

(72) Inventors: Hideyuki Matsui, Kitakyushu (JP); Masanobu Kanashiro, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 813 days.

(21) Appl. No.: 16/568,587

(22) Filed: Sep. 12, 2019

(65) Prior Publication Data

US 2020/0086333 A1 Mar. 19, 2020

(30) Foreign Application Priority Data

Sep. 13, 2018 (JP) ..... JP2018-171702
Jul. 31, 2019 (JP) ..... JP2019-141330
Jul. 31, 2019 (JP) ..... JP2019-141331
Jul. 31, 2019 (JP) ..... JP2019-141332

(51) Int. Cl.
*B05B 1/16* (2006.01)
*B05B 1/18* (2006.01)

(52) U.S. Cl.
CPC ..... *B05B 1/1636* (2013.01); *B05B 1/18* (2013.01)

(58) Field of Classification Search
CPC ... B05B 1/1609; B05B 1/1627; B05B 1/1636; B05B 1/169; B05B 1/18; B05B 12/002
See application file for complete search history.

(56) References Cited

U.S. PATENT DOCUMENTS 9,901,939 B2 2/2018 Lin et al.
2013/0239320 A1* 9/2013 Aihara ..... B05B 1/169 4/615
2016/0221006 A1 8/2016 Lin et al.
2017/0320084 A1 11/2017 Lin et al.

FOREIGN PATENT DOCUMENTS

EP 3108964 A1 12/2016
JP 2016-140767 A 8/2016
JP 2016173166 A 9/2016

OTHER PUBLICATIONS

Office Action issued in Japanese Patent Application No. 2019-141330, dated Aug. 11, 2020 [with machine-generated translation].

* cited by examiner

*Primary Examiner* — Darren W Gorman
(74) *Attorney, Agent, or Firm* — BakerHostetler

(57) ABSTRACT

The present invention is a shower head for which a plurality of spout modes can be switched. The shower head includes: a storage chamber configured to store water supplied from a water supply source; a secondary-side flow-path member provided on a spout-surface side with respect to the storage chamber, the secondary-side flow-path member having a plurality of flow paths, each of which corresponds to each of the plurality of spout modes; and a plurality of diaphragm valves, each of which is configured to control a communicated/blocked state between each of the plurality of flow paths and the storage chamber.

17 Claims, 27 Drawing Sheets

SHOWER HEAD

TECHNICAL FIELD

The present invention pertains to a shower head, in particular a shower head having a flow-path switching function.

BACKGROUND ART

A shower head having a flow-path switching function usually includes: a disc-shaped member, which is also called a water distribution board; and a driving mechanism for rotating the disc-shaped member for switching flow paths. Depending on various driving manners, various driving mechanisms have been developed, such as a driving mechanism using a button to be pushed, a driving mechanism using a rotatable surface cover, a driving mechanism using a swingable part, or the like.

In a shower head disclosed in JP-A-2016-140767, the surface area for receiving a pressure of water on an upper-surface side of a water distribution board (disc-shaped member) and the surface area for receiving a pressure of water on a lower-surface side of the water distribution board are made substantially equal to each other. Thus, a force exerted by the pressure of water on the upper-surface side of the water distribution board and a force exerted by the pressure of water on the lower-surface side of the water distribution board are substantially equal. As a result, an operation force required for rotating the water distribution board is relatively small, which leads to good operability.

Patent Document List

JP-A-2016-140767

SUMMARY OF INVENTION

Technical Problem

In the above type of shower head, the disc-shaped member is usually slidably rotated to switch the flow paths. In order to enhance the slidability, grease is generally applied. However, the operation force for switching the flow paths varies depending on the amount of the applied grease. In addition, the applied grease may gradually leak out, so that the operation force for switching the flow paths may be increased after a long-term use.

The present invention has been made based on the above findings. The object of the present invention is to provide a shower head in which a remarkable and stable reduction of an operation force for switching flow paths is achieved.

Solution to Problem

The present invention is a shower head having a flow path configured to guide water to a plurality of spout holes, the shower head including: a main valve body movably supported in the flow path; a back pressure chamber adjacent to the main valve body on an upstream side of the flow path, configured to contain water supplied from an upstream side of the flow path and to generate a biasing force in a valve-closing direction for closing the main valve body by the supplied water; a pilot hole communicating a downstream side of the flow path with the back pressure chamber; a pilot valve configured to selectively control an opened/closed state of the pilot hole; and an operation part to be operated by a user, configured to cause the pilot valve to switch the opened/closed state of the pilot hole when operated by the user.

According to the above feature, since the main valve body is opened and closed by switching the opened/closed state of the pilot hole by means of the pilot valve, a remarkable and stable reduction of an operation force for the switching operation is achieved for a long time without using grease.

Alternatively, the present invention is a shower head having a flow path configured to guide water to a plurality of spout holes, the shower head including: a plurality of main valve bodies movably supported in the flow path; a plurality of back pressure chambers, each of which is adjacent to each of the plurality of main valve bodies on an upstream side of the flow path and is configured to contain water supplied from an upstream side of the flow path and to generate a biasing force in a valve-closing direction for closing the corresponding main valve body by the supplied water; a plurality of pilot holes communicating a downstream side of the flow path with the plurality of back pressure chambers; a pilot valve configured to selectively control opened/closed states of the plurality of pilot holes; and an operation part to be operated by a user, configured to cause the pilot valve to switch the opened/closed states of the plurality of pilot holes when operated by the user.

According to the above feature, since the plurality of main valve bodies are respectively opened and closed by switching the opened/closed states of the plurality of pilot holes by means of the pilot valve, a remarkable and stable reduction of an operation force for the switching operation is achieved for a long time without using grease.

In this case, it is preferable that the pilot valve has a plurality of communication holes, and that each of the plurality of communication holes is configured to open a corresponding pilot hole of a corresponding main valve body when selectively communicating with a corresponding back-pressure-chamber outlet hole provided on a corresponding back pressure chamber of the corresponding main valve body.

According to the above feature, it is possible to design a control for opening and closing the plurality of pilot holes for the plurality of main valve bodies with a higher degree of freedom. Thus, it is possible to achieve various switching controls.

Alternatively, the present invention is a shower head for which a plurality of spout modes can be switched, the shower head including: a storage chamber configured to store water supplied from a water supply source; a secondary-side flow-path member provided on a spout-surface side with respect to the storage chamber, the secondary-side flow-path member having a plurality of flow paths, each of which corresponds to each of the plurality of spout modes; and a plurality of diaphragm valves, each of which is configured to control a communicated/blocked state between each of the plurality of flow paths and the storage chamber.

According to the above feature, since the communicated/blocked state between each of the plurality of flow paths and the storage chamber is controlled by each of the plurality of diaphragm valves, a remarkable and stable reduction of an operation force for the switching operation is achieved for a long time without using grease.

When the plurality of diaphragm valves are two diaphragm valves, it is preferable that a pilot hole for communicating a back pressure chamber of each of the two diaphragm valves with a space outside the storage chamber is collectively located at a middle region between the two diaphragm valves so that the pilot hole is opened and closed by a common pilot valve.

According to this arrangement, the shower head may be designed to be compact. In addition, a moving range (moving distance) of the pilot valve may be designed to be smaller, which can lead to a further reduction of the operating force.

Substantially similarly, when the plurality of diaphragm valves are three or more diaphragm valves which are annularly arranged, it is preferable that a pilot hole for communicating a back pressure chamber of each of the three or more diaphragm valves with a space outside the storage chamber is collectively located at a central region of the three or more diaphragm valves so that the pilot hole is opened and closed by a common pilot valve.

According to this arrangement as well, the shower head may be designed to be compact. In addition, a moving range (moving distance) of the pilot valve may be designed to be smaller, which can lead to a further reduction of the operating force.

Furthermore, it is preferable that the common pilot valve is a disc-shaped member supported in a rotatable manner around an axis thereof and having teeth on an outer circumference thereof.

According to this feature, it is possible to easily drive the disc-shaped member in rotation by using the teeth on the outer circumference of the disc-shaped member.

In addition, in this case, it is further preferable that the disc-shaped member is made of resin.

According to this feature, it is possible to easily achieve high smoothness, which can inhibit sliding resistance (sliding friction). In addition, it is unnecessary to separately provide a seal part.

In addition, it is preferable that the disc-shaped member has a plurality of communication holes, and that each of the plurality of communication holes is configured to open a corresponding pilot hole of a corresponding diaphragm valve when selectively communicating with a corresponding back-pressure-chamber outlet hole provided on a corresponding back pressure chamber of the corresponding diaphragm valve, in response to a rotational position of the disc-shaped member.

According to this arrangement, the shower head may be designed to be more compact. In addition, a rotation angle (moving distance) of the disc-shaped member (pilot valve) may be designed to be smaller, which can lead to a further reduction of the operating force.

In addition, it is preferable that a disc-pushing member is interposed between the corresponding back-pressure-chamber outlet hole and the disc-shaped member, and that the disc-pushing member has an outlet communication hole that can communicate with the corresponding back-pressure-chamber outlet hole provided on the corresponding back pressure chamber of the corresponding diaphragm valve, and that the disc-pushing member is configured to push the disc-shaped member away from the corresponding back-pressure-chamber outlet hole by means of a biasing part.

According to this arrangement, it is unnecessary to provide a seal part between the disc-shaped member and a member located away from the back-pressure-chamber outlet hole with respect to the disc-shaped member.

In this case, it is further preferable that the outlet communication hole is formed by a tubular part, that the tubular part is inserted into the corresponding back-pressure-chamber outlet hole, that there remains a gap between the tubular part and the corresponding back-pressure-chamber outlet hole, and that the gap is configured to function as a corresponding back-pressure-chamber inlet hole.

It is easy to form the gap with high precision. Thus, it is possible to effectively inhibit variation in performance among the plurality of back-pressure-chamber inlet holes for the plurality of diaphragm valves.

In addition, it is preferable that the shower head according to one of the above features of the present invention further includes: an operation part configured to receive an operation force from a user; a shaft part configured to reciprocate in an axial direction thereof every time the operation part receives the operation force; and a claw member attached to a distal end portion of the shaft part and having a claw configured to engage with the teeth of the disc-shaped member; wherein the disc-shaped member is rotated when the claw draws the teeth while the shaft part reciprocates.

Since a force for driving the disc-shaped member in rotation is applied in a direction in which the claw draws the teeth, it is possible to prevent buckling deformation of the shaft part. Thus, rigidity required for the shaft part can be reduced. As a result, it is possible to make the shaft part of not only a rigid material but also a plastic material or an elastic material.

In this case, it is further preferable that a proximal end portion of the shaft part is connected to the operation part, that a coil spring is arranged around the shaft part, that a proximal end of the coil spring is fixed to a shower head housing, that a distal end of the coil spring is fixed to the claw member, that a stopper for the claw member is attached to a distal end portion of the shaft part, and that the claw member is movable relative to the shaft part by deformation of the coil spring.

According to this feature, after the claw member has drawn one tooth, when the claw member is returned to an original position thereof to engage with the next tooth, it is possible to effectively avoid resistance (interference) from the disc-shaped member.

In addition, for example, the plurality of diaphragm valves may be integrally connected as one diaphragm member. In this case, it is preferable that the diaphragm member has a seal part at a periphery thereof. Alternatively, the plurality of diaphragm valves may be formed as separate independent parts, respectively.

In order to stabilize a movement for opening and closing each of the plurality of diaphragm valves, it is preferable that each of the plurality of diaphragm valves is biased in a valve-closing direction by means of an elastic member.

Advantageous Effects of Invention

According to one feature of the present invention, since the main valve body is opened and closed by switching the opened/closed state of the pilot hole by means of the pilot valve, a remarkable and stable reduction of an operation force for the switching operation is achieved for a long time without using grease.

According to another feature of the present invention, since the plurality of main valve bodies are respectively opened and closed by switching the opened/closed states of the plurality of pilot holes by means of the pilot valve, a remarkable and stable reduction of an operation force for the switching operation is achieved for a long time without using grease.

According to further another feature of the present invention, since the communicated/blocked state between each of the plurality of flow paths and the storage chamber is controlled by each of the plurality of diaphragm valves, a remarkable and stable reduction of an operation force for the switching operation is achieved for a long time without using grease.

BRIEF DESCRIPTION OF DRAWINGS

FIG. 17 is a partially longitudinal section view of the shower head shown in

FIG. 16;

DESCRIPTION OF EMBODIMENTS

Structure of First Embodiment

Hereinafter, a shower head according to a first embodiment of the present invention will be described with reference to the attached drawings. The shower head 1 of the first embodiment is a shower head for which a plurality of spout modes can be switched (water can be discharged in each of the plurality of spout modes).

Figure 1:
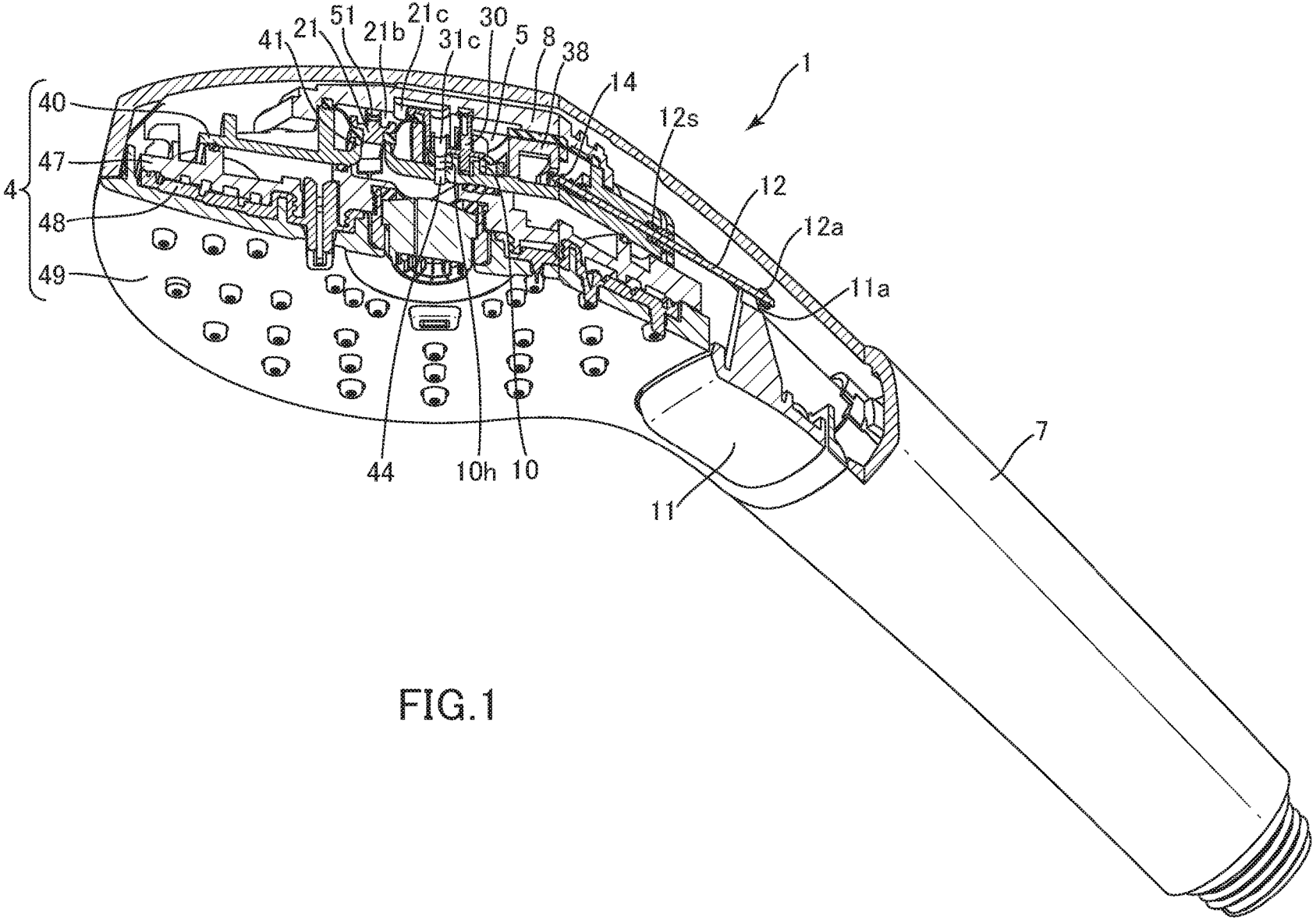
FIG. 1 is a partially sectional perspective view of a shower head according to a first embodiment of the present invention.
Figure 2:
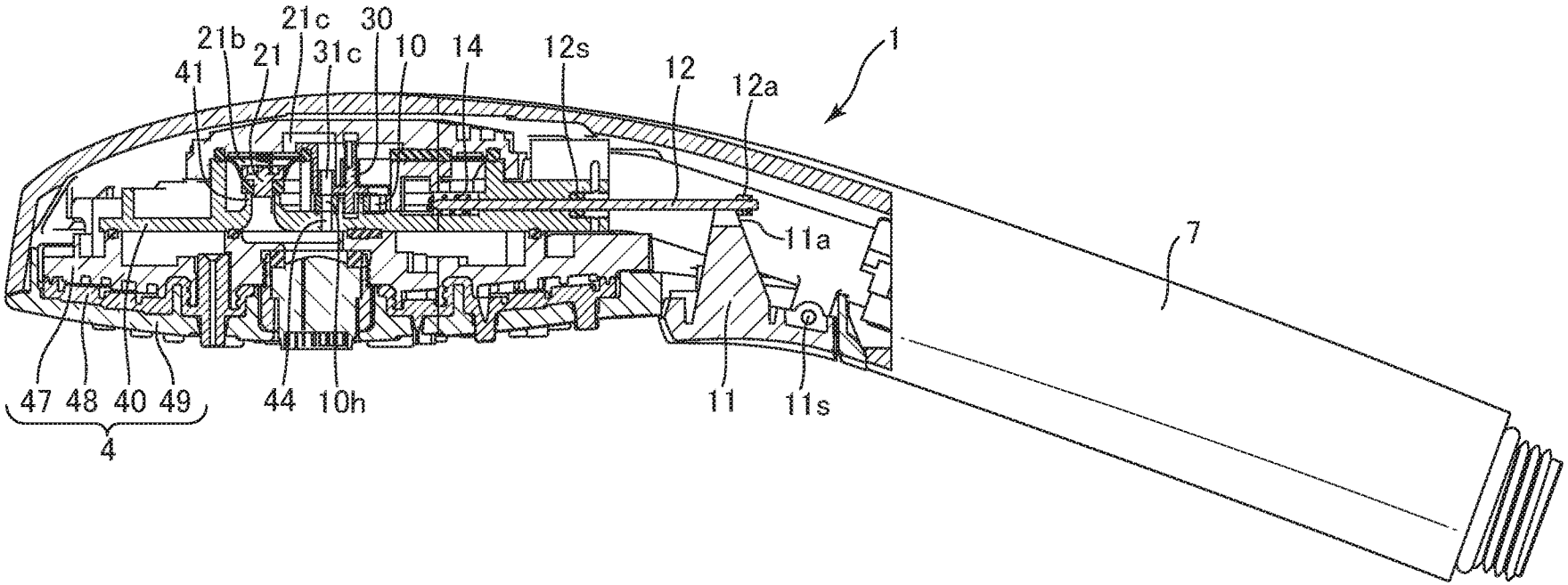
FIG. 2 is a partially longitudinal section view of the shower head shown in FIG. 1.
Figure 3:
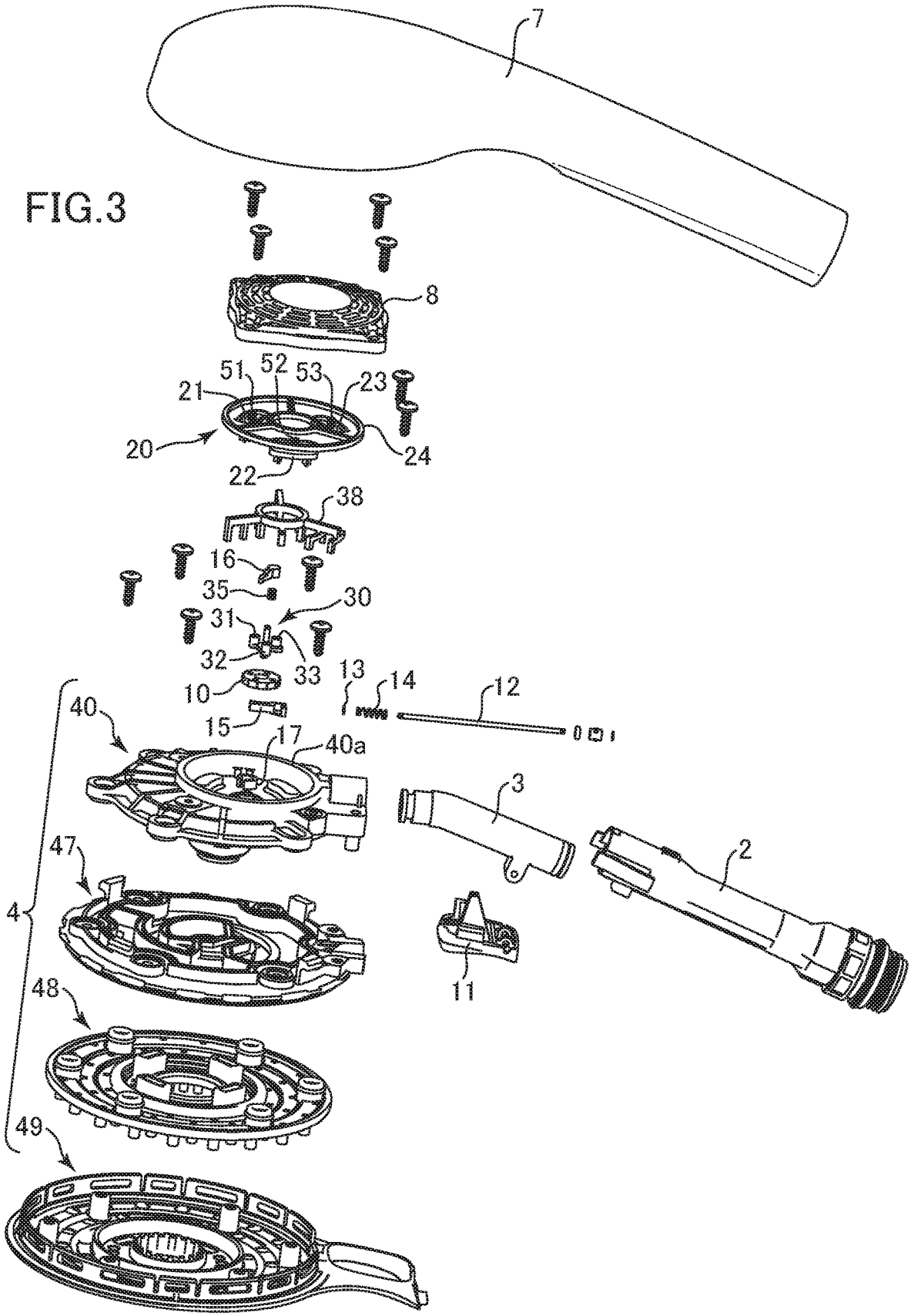
FIG. 3 is an exploded perspective view of the shower head shown in FIG. 1.

FIG. 1 is a partially sectional perspective view of the shower head 1 of the first embodiment. FIG. 2 is a partially longitudinal section view of the shower head 1 of the first embodiment. FIG. 3 is an exploded perspective view of the shower head 1 of the first embodiment.

As shown in FIGS. 1 to 3, the shower head 1 of the first embodiment includes a storage chamber 5 (which is also called cavity) configured to store water supplied from a water supply source (not shown) through water supply members 2, 3.

A secondary-side flow-path member 4 is provided on a spout-surface side of the shower head 1 with respect to the storage chamber 5. The secondary-side flow-path member 4 consists of four stacked substantially discoid element parts 40, 47, 48, 49. The secondary-side flow-path member 4 has three flow paths (an example of a plurality of flow paths), each of which corresponds to each of three spout modes (an example of the plurality of spout modes).

Three valve seats 41 to 43 protruded on a side of the storage chamber 5 are formed on the element part 40 facing to the storage chamber 5. A communication hole that communicates with a corresponding flow path among the three flow paths is provided at a center of each of the valve seats 41 to 43 (see FIG. 4, too). The three valve seats 41 to 43 (and their corresponding communication holes) are annularly arranged at even intervals in a circumferential direction, i.e., every 120 degrees.

Three diaphragm valves 21 to 23, which correspond to the three valve seats 41 to 43, respectively, are annularly arranged. The three diaphragm valves 21 to 23 are integrally formed as one diaphragm member 20. However, the respective diaphragm valves 21 to 23 are movable independently of each other.

A seal ring portion 24 is formed at a periphery of the diaphragm member 20. The seal ring portion 24 is sandwiched between an upper edge portion 40*a* of the element part 40 and a cover member 8 in a watertight manner. A central area of the diaphragm member 20 is supported on an upper surface of the element part 40 via a spacing member 38.

Coil springs 51 to 53 (an example of an elastic member) are provided between the respective diaphragm valves 21 to 23 and a lower surface of the cover member 8, so that each of the diaphragm valves 21 to 23 is biased in a valve-closing direction by means of the corresponding coil spring 51 to 53.

The three diaphragm valves 21 to 23 of the present embodiment are annularly arranged, and a pilot hole (a part of which is a back-pressure-chamber outlet hole 21*c* to 23*c* formed on a lower-surface side of the cover member 8) for communicating a back pressure chamber 21*b* to 23*b* of each of the three diaphragm valves 21 to 23 with a space below the element part 40, which is a space outside the storage chamber 5, is collectively located at a central region of the three diaphragm valves 21 to 23, so that the pilot hole is opened and closed by a disc-shaped member 10, which serves as a common pilot valve. (When the number of the plurality of diaphragm valves is two, a pilot hole for communicating a back pressure chamber of each of the two diaphragm valves with the space below the element part 40 may be collectively located at a middle region of the two diaphragm valves.)

The disc-shaped member 10 is made of resin. The disc-shaped member 10 is supported in a rotatable manner around an axis thereof, and has twelve teeth 10*t* on an outer circumference thereof (see FIGS. 6 to 8, too).

Figure 4:
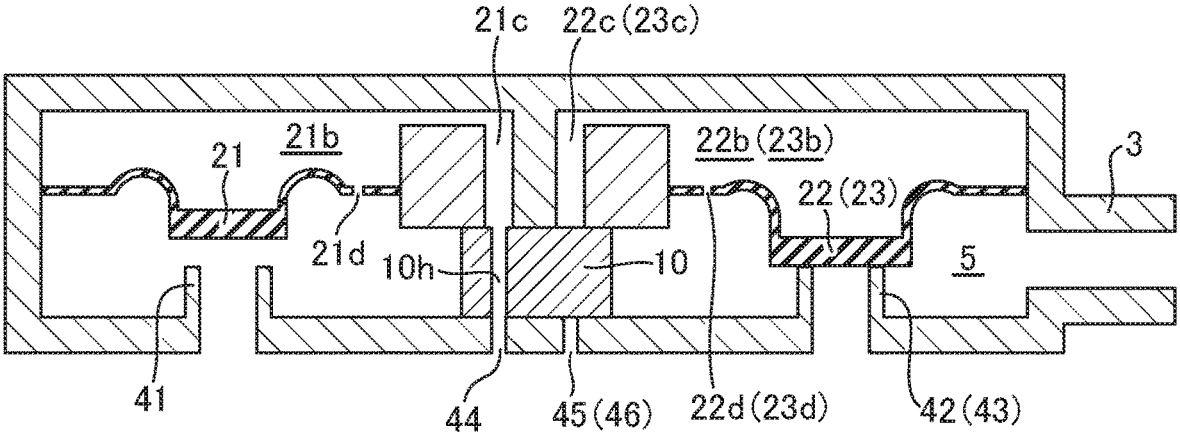
FIG. 4 is a schematic view for explaining an opened/closed state of a pilot hole.

FIG. 4 is a schematic view for explaining an opened/closed state of a pilot hole. The disc-shaped member 10 has four communication holes 10*h* (an example of the plurality of communication holes). As shown in FIG. 4 schematically, each of the four communication holes 10*h* is configured to open a corresponding pilot hole of a corresponding diaphragm valve 21 to 23 when selectively communicating with a corresponding back-pressure-chamber outlet hole 21*c* to 23*c* provided on a corresponding back pressure chamber 21*b* to 23*b* of the corresponding diaphragm valve 21 to 23, in response to a rotational position of the disc-shaped member 10. More specifically, when each of the four communication holes 10*h* selectively communicates with the corresponding back-pressure-chamber outlet hole 21*c* to 23*c* and a corresponding outlet hole 44 to 46 in the element part 40 provided correspondingly to the corresponding back-pressure-chamber outlet hole 21*c* to 23*c*, the corresponding pilot hole of the corresponding diaphragm valve 21 to 23 is opened. The four communication holes 10*h* are annularly arranged at even intervals in a circumferential direction, i.e., every 90 degrees. The back-pressure-chamber outlet holes 21*c* to 23*c* and the outlet holes 44 to 46 are also annularly arranged at even intervals in a circumferential direction, i.e., every 120 degrees.

Figure 5:
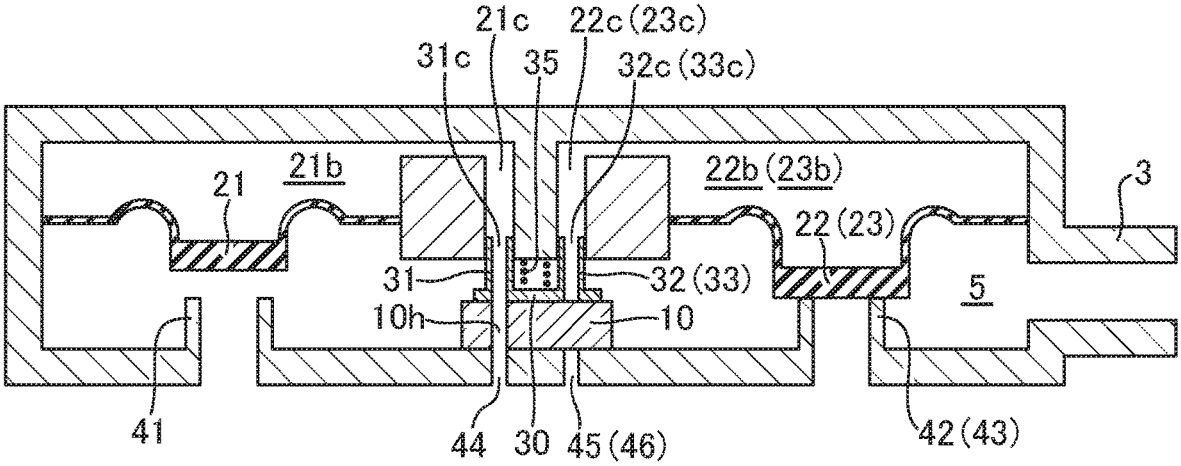
FIG. 5 is a schematic view for explaining a disc-pushing member.

FIG. 5 is a schematic view for explaining a disc-pushing member 30. As shown in FIG. 5 schematically, the disc-pushing member 30 is interposed between the back-pressure-chamber outlet holes 21*c* to 23*c* and the disc-shaped member 10. The disc-pushing member 30 is configured to push the disc-shaped member 10 away from the back-pressure-chamber outlet holes 21*c* to 23*c* (toward the element part 40) by means of a coil spring 35 as an example of a biasing part.

The disc-pushing member 30 is provided with three outlet communication holes 31*c* to 33*c*, each of which can communicate with the corresponding back-pressure-chamber outlet hole 21*c* to 23*c* provided on the corresponding back pressure chamber 21*b* to 23*b* of the corresponding diaphragm valve 21 to 23. In the present embodiment, each of the outlet communication holes 31*c* to 33*c* is formed by a tubular part 31 to 33. Each of the tubular parts 31 to 33 is inserted into the corresponding back-pressure-chamber outlet hole 21*c* to 23*c*.

There remains a gap between each of the tubular parts 31 to 33 and the corresponding back-pressure-chamber outlet hole 21*c* to 23*c*, and the gap is configured to function as a corresponding back-pressure-chamber inlet hole. (However, at least at the time of filing the present application, the scope of the present invention does not exclude a manner wherein each of back-pressure-chamber inlet holes 21*d* to 23*d* is provided through a portion of the corresponding diaphragm valve 21 to 23, as shown in FIG. 4).

With reference to FIG. 2 again, a push button 11 is provided on a lower portion of a shower head housing 7 as an operation part configured to receive an operation force from a user. (Any other type of button or slide switch may be provided in place of the push button 11.)

Every time the push button 11 receives an operation force (a pushing force) from a user (every time the user gives an operation force (a pushing force) to the push button 11), the push button 11 pivots around a pivot shaft 11*s*. Then, in coordination with the pivot movement, by means of abutment and slide between an abutment slide inclined portion 11*a* of the push button 11 and an abutment slide ring part 12*a* provided at a proximal end portion of a shaft part 12, the shaft part 12 is configured to reciprocate in an axial direction thereof.

Figure 6:
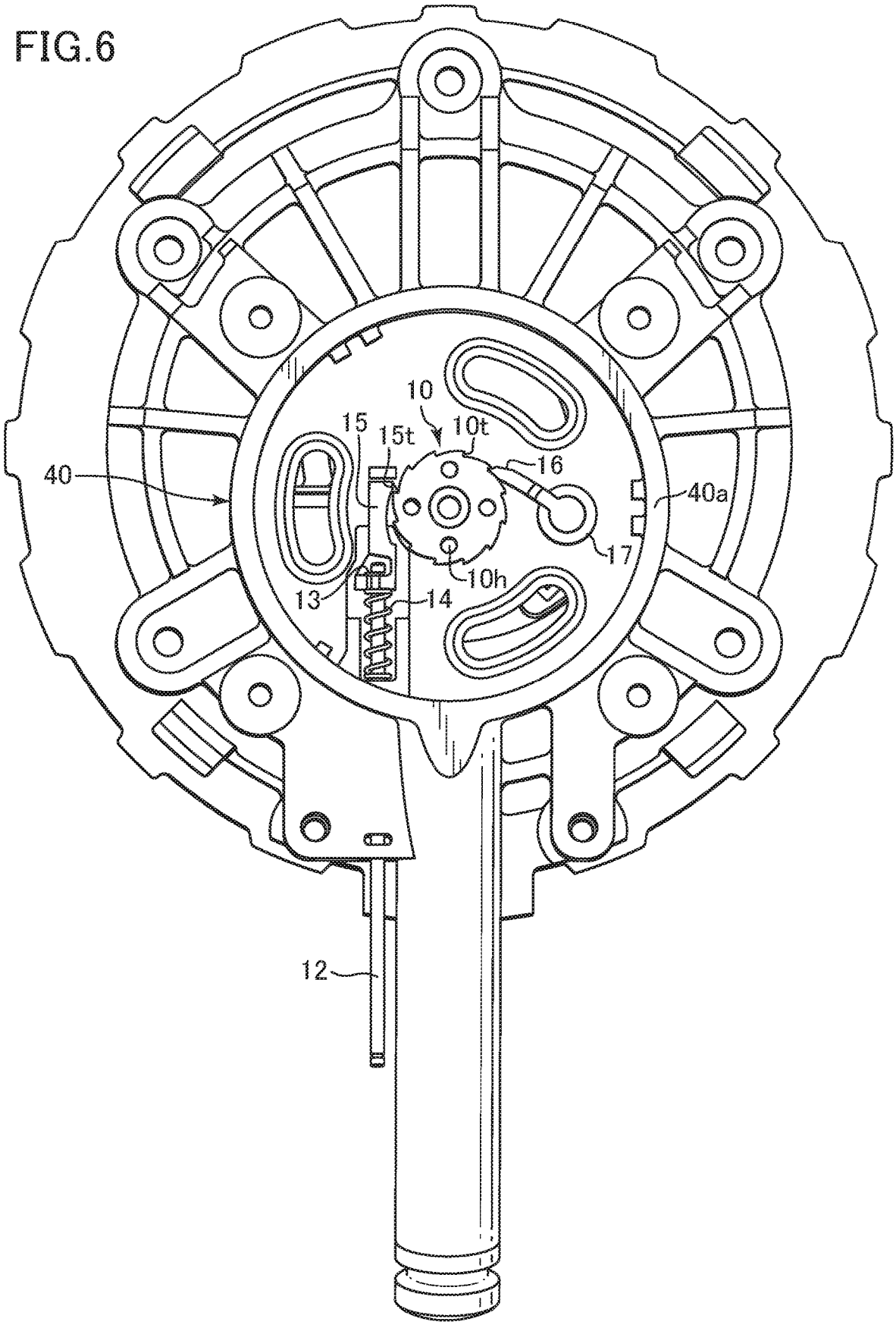
FIG. 6 is a schematic view for explaining a state wherein a disc-shaped member has started to be rotated.
Figure 7:
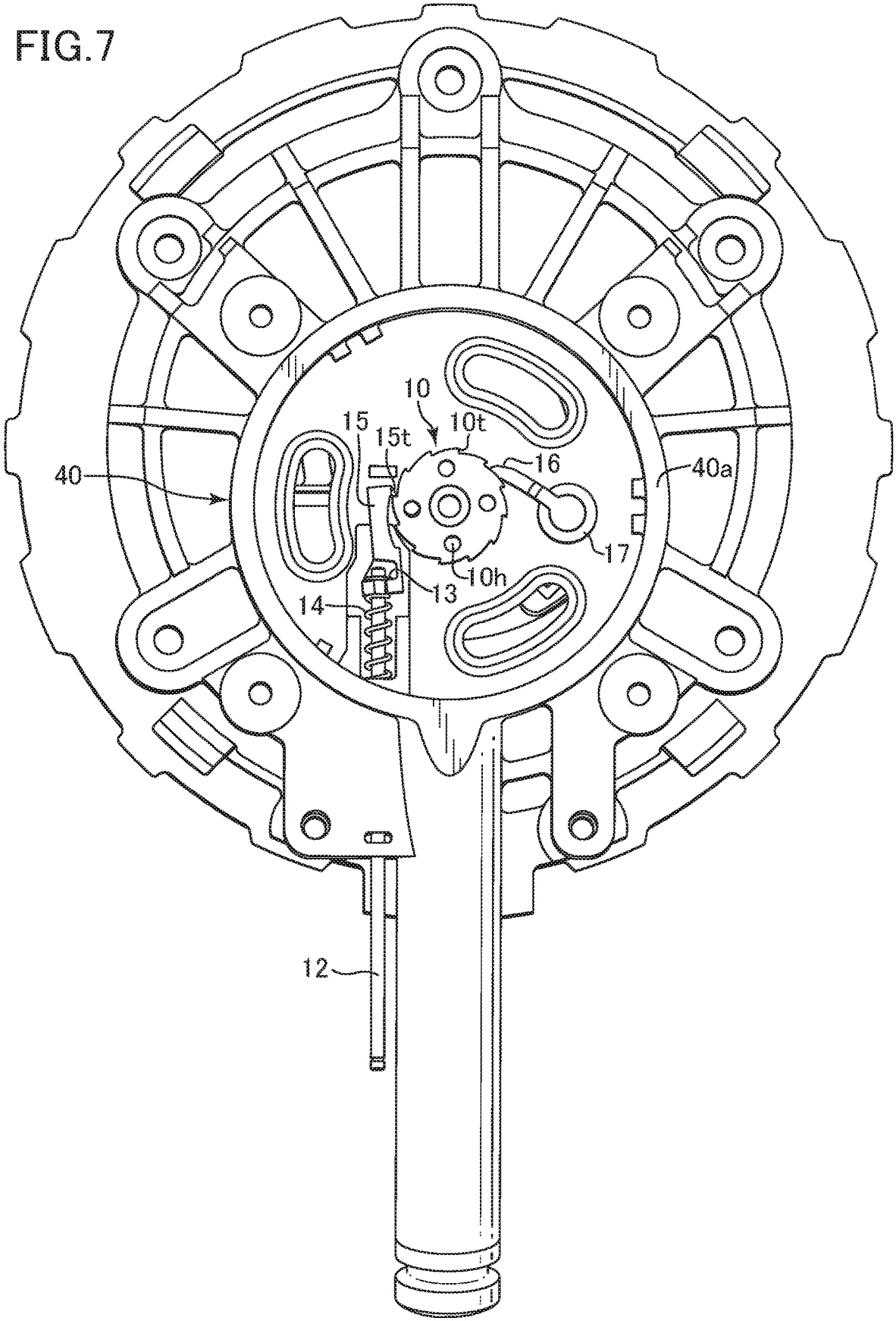
FIG. 7 is a schematic view for explaining a state wherein the disc-shaped member is being rotated.
Figure 8:
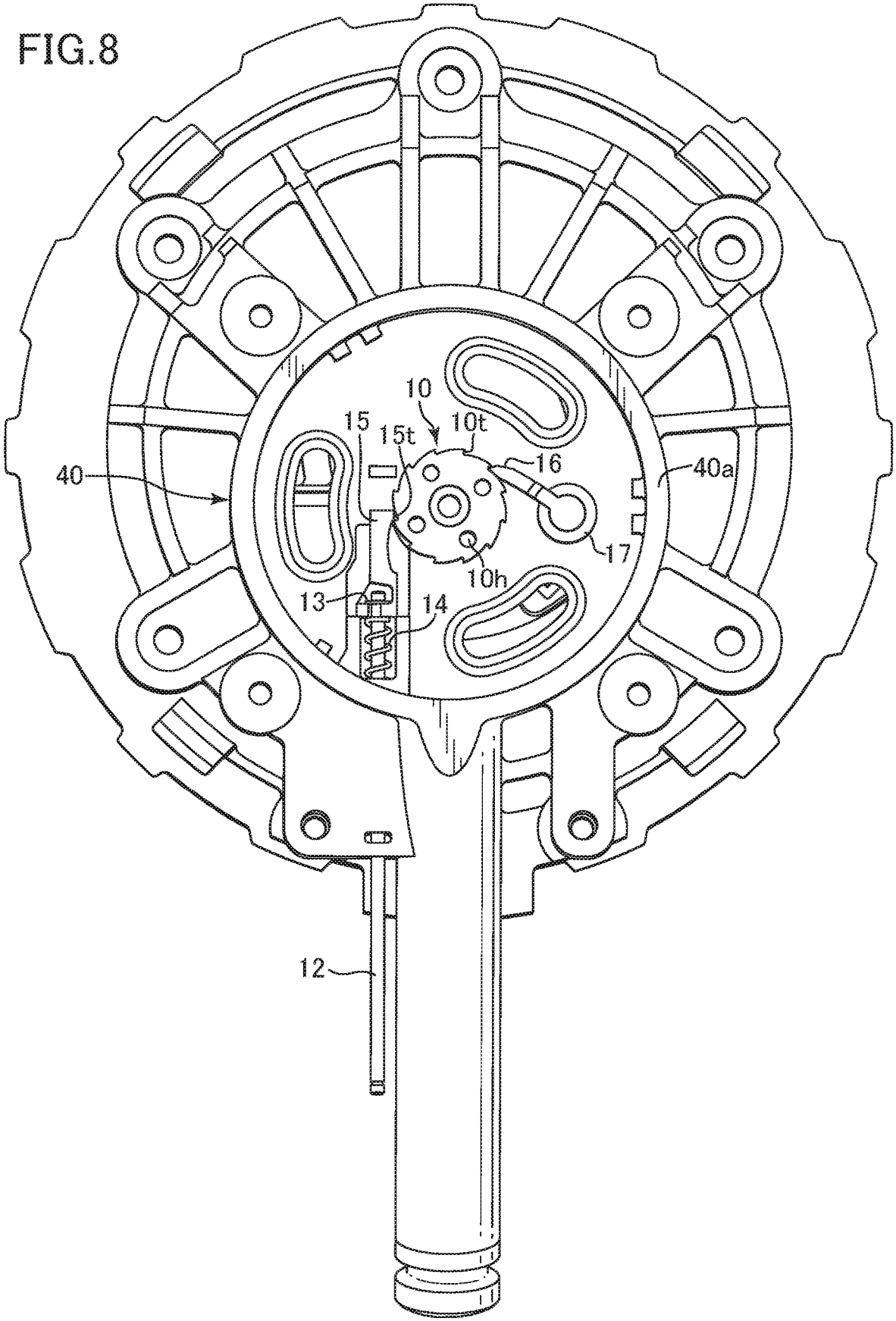
FIG. 8 is a schematic view for explaining a state wherein the disc-shaped member has finished to be rotated.

A distal end portion of the shaft part 12 is exposed to the water in the storage chamber 5 (see FIGS. 6 to 8, too). Thus, the shaft part 12 is made of a metal bar which is difficult to rust, such as a stainless-steel bar. In the present embodiment, the shaft part 12 slidably pierces through the element part 40 integrally fixed to the shower head housing 7. A seal ring part 12*s* is provided for maintaining watertight performance. The shaft part 12 may be made of not only a rigid material but also a plastic material such as string or an elastic material such as rubber.

FIG. 6 is a schematic view for explaining a state wherein the disc-shaped member 10 has started to be rotated, FIG. 7 is a schematic view for explaining a state wherein the disc-shaped member 10 is being rotated, and FIG. 8 is a schematic view for explaining a state wherein the disc-shaped member 10 has finished to be rotated.

As shown in FIGS. 6 to 8, a coil spring 14 is arranged around a distal end portion of the shaft part 12 located in the storage chamber 5. A proximal end of the coil spring 14 is fixed to the element part 40, and thus fixed to the shower head housing 7 (to the pivot shaft 11*s* of the push button 11).

A claw member 15 is fixed to a distal end of the coil spring 14. A stopper 13 for the claw member 15 is attached to the distal end portion of the shaft part 12. The distal end of the coil spring 14 and the claw member 15 are movable in an axial direction by deformation of the coil spring 14 in the axial direction in a region on the side of the proximal end portion of the shaft part 12 with respect to the stopper 13.

Furthermore, the distal end of the coil spring 14 and the claw member 15 are also movable in an inclined direction, which is inclined with respect to the axial direction of the coil spring 14, by deformation of the coil spring 14 in the inclined direction.

A claw 15*t* is provided on a lateral surface of the claw member 15 on the side of the disc-shaped member 10. The claw 15*t* is configured to engage with the teeth 10*t* of the disc-shaped member 10. The disc-shaped member 10 is rotated when the claw 15*t* draws one of the teeth 10*t* while the shaft part 12 reciprocates (from the state shown in FIG. 6, through the stage shown in FIG. 7, to the state sown in FIG. 8).

In addition, a stopper claw 16 configured to prevent the disc-shaped member 10 (teeth 10*t*) from reversely rotating is held by a stopper-claw fixing part 17 provided on the element part 40.

Operation of First Embodiment

Next, an operation of the shower head 1 according to the first embodiment is explained.

With reference to FIG. 2, when a user pushes the push button 11, the pushing force (operating force) causes the abutment slide inclined portion 11*a* of the push button 11 to pivot around the pivot shaft 11*s*, so that the shaft part 12 moves in a direction toward the proximal end portion thereof (the right side in FIG. 2) via the abutment slide ring part 12*a*.

The state shown in FIG. 6 corresponds to a state before the user pushes the push button 11. From this state, the shaft part 12 starts to move. When the claw 15*t* of the claw member 15 draws one of the teeth 10*t* of the disc-shaped member 10, the disc-shaped member 10 is rotated, as shown in FIG. 7. The state shown in FIG. 8 corresponds to a state wherein the push button 11 has been pushed to a deepest position thereof and thus the shaft part 12 has moved to a most proximal-end-side position thereof (rightmost position in FIG. 2). In the state shown in FIG. 8, the stopper claw 16 stops a tooth 10*t* next to that in FIG. 6. Accordingly, the disc-shaped member 10 is rotated by 30 degrees every time the user pushes the push button 11.

In the state shown in FIG. 8, the coil spring 14 is compressed between the claw member 15 (and the stopper 13 at the distal end portion of the shaft part 12) and the element part 40. From this state, when the pushing force against the push button 11 is released, the shaft part 12 and the push button 11 are returned back to their original positions (the state shown in FIG. 6) by a resilience force of the coil spring 14. During this step, the claw 15*t* does not engage with any tooth 10*t*, and the disc-shaped member 10 is not reversely rotated in combination with the existence of the claw stopper 16. In addition, during the above step, the claw member 15 is movable in the inclined direction, which is inclined with respect to the axial direction of the coil spring 14, by the deformation of the coil spring 14 in the inclined direction. Thus, it is possible to effectively avoid resistance (interference) from the disc-shaped member 10. In addition, when the claw member 15 is returned back to an original position thereof (the state shown in FIG. 6), the claw member 15 (claw 15*t*) engages with the tooth 10*t* next to the previously drawn one, by the resilience force of the coil spring 14.

As described above, the four communication holes 10*h* are annularly arranged at even intervals in a circumferential direction, i.e., every 90 degrees, and the back-pressure-chamber outlet holes 21*c* to 23*c* and the outlet holes 44 to 46 are annularly arranged at even intervals in a circumferential direction, i.e., every 120 degrees. Thus, when the disc-shaped member 10 is rotated by 30 degrees, it is possible to sequentially switch the following three spout modes:

(i) a first spout mode wherein the back-pressure-chamber outlet holes 21*c* and the outlet hole 44 communicate with each other while the back-pressure-chamber outlet holes 22*c*, 23*c* and the outlet holes 45, 46 do not communicate with each other;

(ii) a second spout mode wherein the back-pressure-chamber outlet holes 22*c* and the outlet hole 45 communicate with each other while the back-pressure-chamber outlet holes 21*c*, 23*c* and the outlet holes 44, 46 do not communicate with each other; and (iii) a third spout mode wherein the back-pressure-chamber outlet holes 23*c* and the outlet hole 46 communicate with each other while the back-pressure-chamber outlet holes 21*c*, 22*c* and the outlet holes 44, 45 do not communicate with each other.

The state shown in the right side half of FIG. 4 or FIG. 5 is an example of a state wherein a back-pressure-chamber outlet hole and the corresponding outlet hole do not communicate with each other, i.e., the corresponding pilot hole of the corresponding diaphragm valve is not opened. In the state shown in the right side half of FIG. 4 or FIG. 5, the back-pressure-chamber outlet holes 22*c*, 23*c* and the corresponding outlet holes 45, 46 are blocked by the disc-shaped member 10. On the other hand, through the back-pressure-chamber inlet holes 22*d*, 23*d* (in the case shown in FIG. 4) or through the gaps between the tubular parts 32, 33 and the corresponding back-pressure-chamber outlet holes 22*c*, 23*c* (in the case shown in FIG. 5), the water pressure in the storage chamber 5 and the water pressures in the back pressure chambers 23*b*, 23*c* are made equal to each other. Thus, each of the diaphragm valves 22, 23 is closed by a biasing force of the corresponding coil spring 52, 53 (not shown in FIGS. 4 and 5).

The state shown in the left side half of FIG. 4 or FIG. 5 is an example of a state wherein a back-pressure-chamber outlet hole and the corresponding outlet hole communicate with each other, i.e., the corresponding pilot hole of the corresponding diaphragm valve is opened. In the state shown in the left side half of FIG. 4 or FIG. 5, the back-pressure-chamber outlet hole 21*c* and the corresponding outlet hole 44 communicate with each other through the communication hole 10*h* of the disc-shaped member 10. In this state, the water in the back pressure chamber 21*b* flows out through the back-pressure-chamber outlet hole 21*c* and the corresponding outlet hole 44, so that the water pressure in the storage chamber 5 becomes greater than the water pressure in the back pressure chamber 21*b*. Thus, the diaphragm valve 21 is opened in spite of the biasing force of the corresponding coil spring 51 (not shown in FIGS. 4 and 5).

Effects of First Embodiment

As described above, according to the shower head 1 of the first embodiment, since the communicated/blocked state between each of the three flow paths and the storage chamber 5 is controlled by each of the three diaphragm valves 21 to 23, a remarkable and stable reduction of an operation force for the switching operation is achieved for a long time without using grease.

In particular, according to the shower head 1 of the first embodiment, the pilot hole for communicating the back pressure chamber 21*b* to 23*b* of each of the annularly-arranged three diaphragm valves 21 to 23 with the space outside the storage chamber 5 is collectively located at the central region of the three diaphragm valves 21 to 23 so that the pilot hole is opened and closed by the common disc-shaped member 10 (pilot valve). Thus, the shower head 1 is made to be compact. In addition, a moving range (moving distance) of the disc-shaped member 10 (pilot valve) is sufficiently small, which contributes to a further reduction of the operating force.

In addition, according to the shower head 1 of the first embodiment, the disc-shaped member 10 is supported in a rotatable manner around the axis thereof and has the teeth 10*t* on the outer circumference thereof. Thus, it is possible to easily drive the disc-shaped member 10 in rotation by using the teeth 10*t*.

In addition, according to the shower head 1 of the first embodiment, the disc-shaped member 10 is made of resin. Thus, it is possible to easily achieve high smoothness, which can inhibit sliding resistance (sliding friction). In addition, it is unnecessary to separately provide a seal part.

In addition, according to the shower head 1 of the first embodiment, the disc-shaped member 10 has the four communication holes 10*h*, and each of the four communication holes 10*h* is configured to open the corresponding pilot hole of the corresponding diaphragm valve 21 to 23 when selectively communicating with the corresponding back-pressure-chamber outlet hole 21*c* to 23*c* provided on the corresponding back pressure chamber 21*b* to 23*b* of the corresponding diaphragm valve 21 to 23, in response to a rotational position of the disc-shaped member 10. Thus, the shower head 1 is made to be more compact. In addition, a rotation angle (moving distance) of the disc-shaped member 10 (pilot valve) is sufficiently small (no more than 30 degrees), which contributes to a further reduction of the operating force.

In addition, according to the shower head 1 of the first embodiment, the disc-pushing member 30 is interposed between the corresponding back-pressure-chamber outlet hole 21*c* to 23*c* and the disc-shaped member 10, the disc-pushing member 30 has the outlet communication holes 31*c* to 33*c* each of which can communicate with the corresponding back-pressure-chamber outlet hole 21*c* to 23*c* provided on the corresponding back pressure chamber 21*b* to 23*b* of the corresponding diaphragm valve 21 to 23, and the disc-pushing member 30 is configured to push the disc-shaped member 10 away from the corresponding back-pressure-chamber outlet hole 21*c* to 23*c* by means of the coil spring 35. Thus, it is unnecessary to provide a seal part between the disc-shaped member 10 and the element part 40 (a member located away from the back-pressure-chamber outlet holes 21*c* to 23*c* with respect to the disc-shaped member 10).

In particular, according to the shower head 1 of the first embodiment, each of the outlet communication holes 31*c* to 33*c* is formed by the corresponding tubular part 31 to 33, each of the tubular parts 31 to 33 is inserted into the corresponding back-pressure-chamber outlet hole 21*c* to 23*c*, the gap between each of the tubular parts 31 to 33 and the corresponding back-pressure-chamber outlet hole 21*c* to 23*c* is configured to function as a corresponding back-pressure-chamber inlet hole. It is easy to form the gap with high precision, and thus it is possible to effectively inhibit variation in performance among the three back-pressure-chamber inlet holes (the three gaps) for the three diaphragm valves 21 to 23.

In addition, according to the shower head 1 of the first embodiment, by using a driving mechanism including: the push button 11 configured to receive an operation force from a user; the shaft part 12 configured to reciprocate in the axial direction thereof every time the push button 11 receives the operation force; and the claw member 15 attached to the distal end portion of the shaft part 12 and having the claw 15*t* configured to engage with the teeth 10*t* of the disc-shaped member 10, the disc-shaped member 10 is rotated when the claw 15*t* draws one of the teeth 10*t* while the shaft part 12 reciprocates. Since the force for driving the disc-shaped member 10 in rotation is applied in a direction in which the claw 15*t* draws one of the teeth 10*t*, it is possible to prevent (avoid) buckling deformation of the shaft part 12. Thus, rigidity required for the shaft part 12 can be reduced. As a result, it is possible to make the shaft part 12 of not only a rigid material but also a plastic material such as string or an elastic material such as rubber.

In particular, according to the shower head 1 of the first embodiment, the proximal end portion of the shaft part 12 is operably connected to the push button part 11, the coil spring 14 is arranged around the distal end portion of the shaft part 12, the proximal end of the coil spring 14 is fixed to the element part 40, the distal end of the coil spring 14 is fixed to the claw member 15, and the stopper 13 for the claw member 15 is attached to the distal end portion of the shaft part 12. Thus, the claw member 15 is movable relative to the shaft part 12 by deformation of the coil spring 14 (both in the axial direction and in the inclined direction). Thus, after the claw member 15 has drawn one tooth 10*t*, when the claw member 15 is returned to the original position thereof (the state shown in FIG. 6) to engage with the next tooth 10*t*, it is possible to effectively avoid resistance (interference) from the disc-shaped member 10.

In addition, according to the shower head 1 of the first embodiment, the three diaphragm valves 21 to 23 are integrally formed as the one diaphragm member 20, and the seal ring portion 24 is provided at the periphery of the diaphragm member 20. Thus, it is unnecessary to separately provide a seal ring part.

In addition, according to the shower head 1 of the first embodiment, each of the three diaphragm valves 21 to 23 is biased in a valve-closing direction by means of the corresponding coil spring 51 to 53. Thus, the movement for opening and closing each of the three diaphragm valves 21 to 23 is stabilized.

Structure of Second Embodiment

Hereinafter, a shower head according to a second embodiment of the present invention will be described with reference to the attached drawings. The shower head 101 of the second embodiment is also a shower head for which a plurality of spout modes can be switched (water can be discharged in each of the plurality of spout modes).

Figure 9:
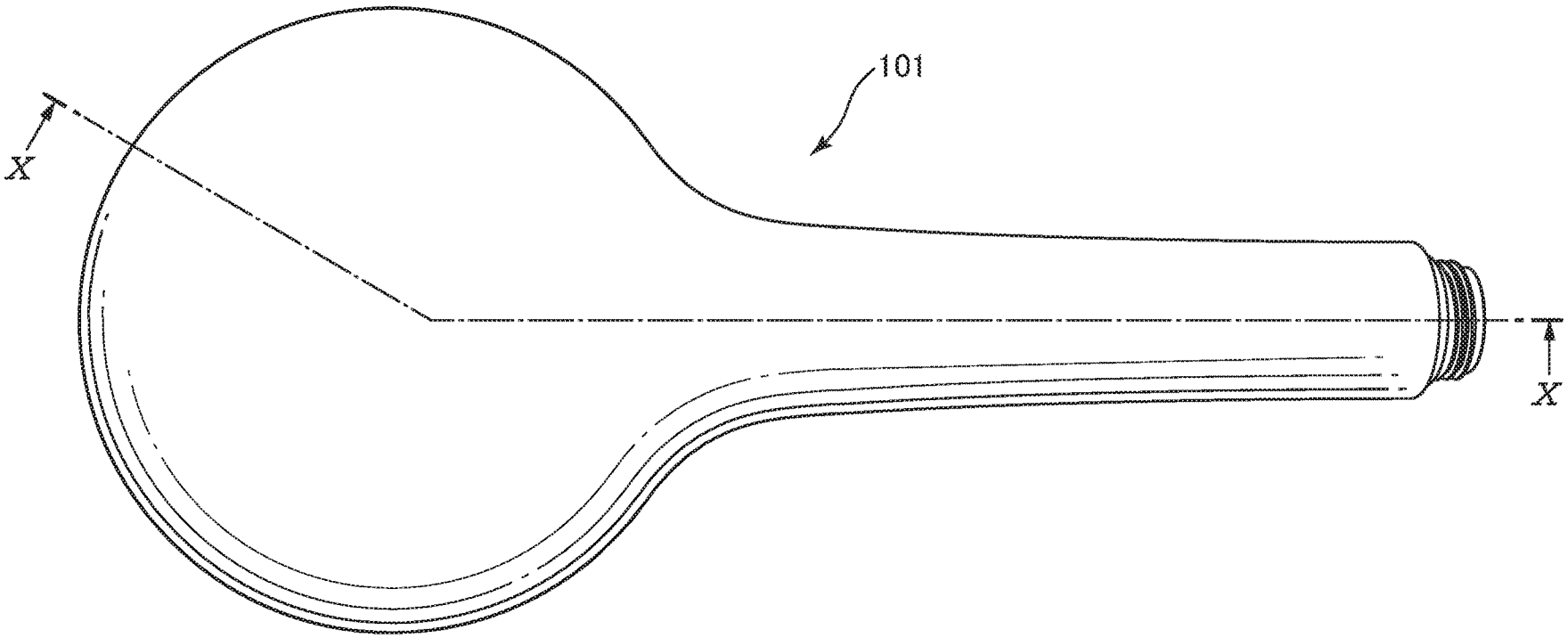
FIG. 9 is a plan view of a shower head according to a second embodiment of the present invention.
Figure 10:
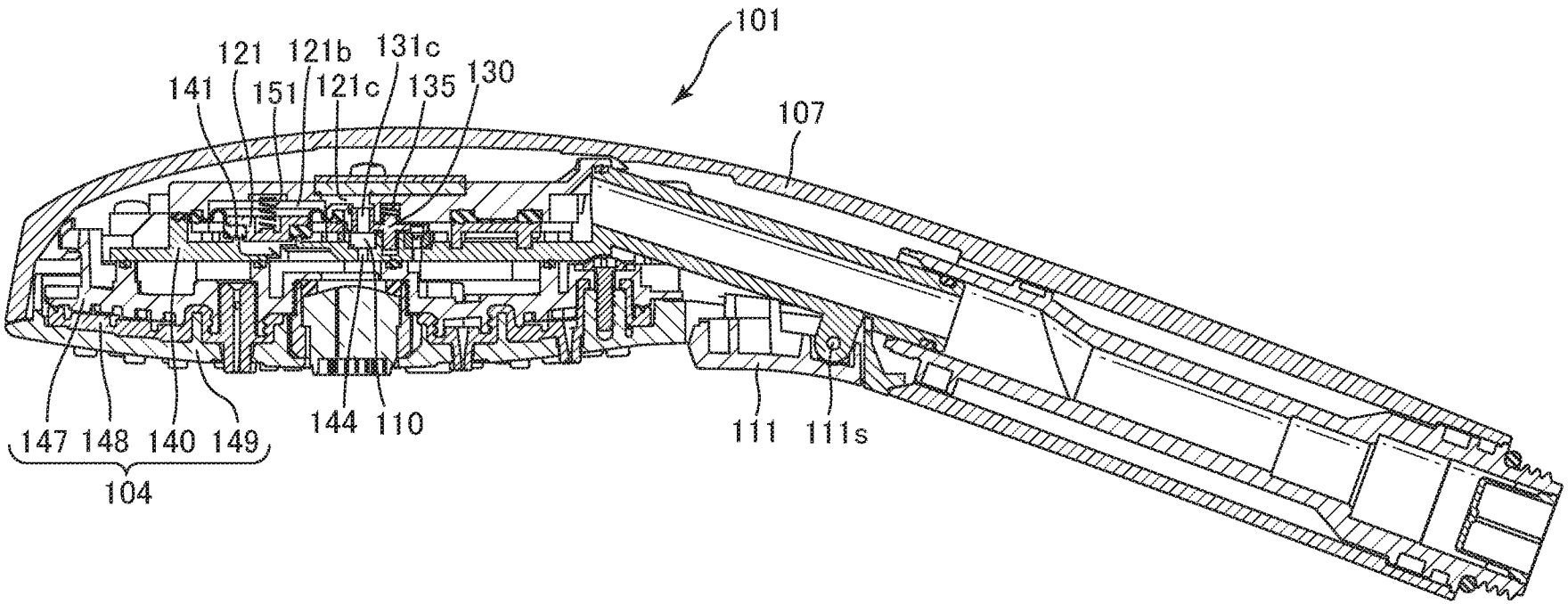
FIG. 10 is a section view taken along line X-X of the shower head shown in FIG. 9.
Figure 11:
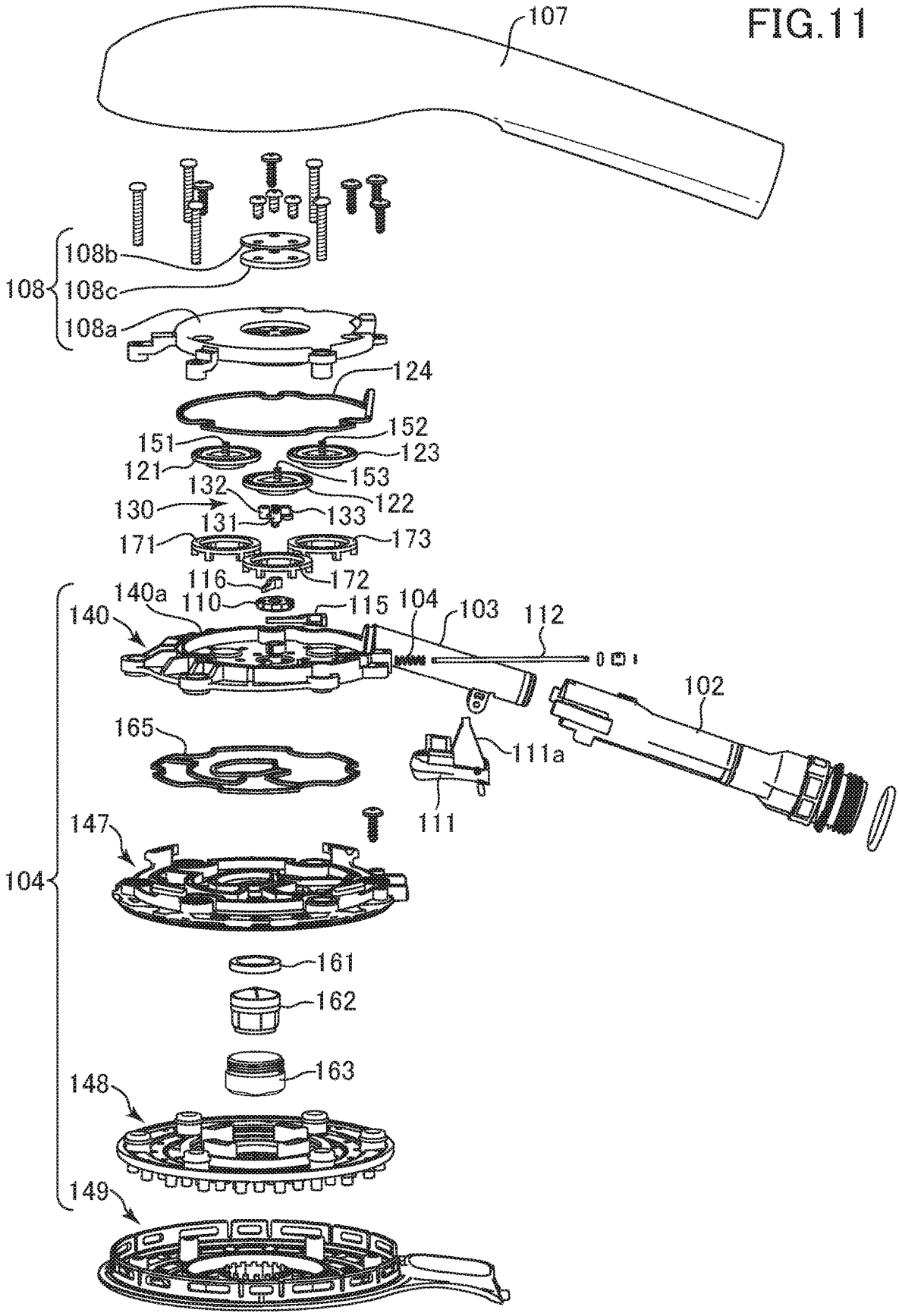
FIG. 11 is an exploded perspective view of the shower head shown in FIG. 9.

FIG. 9 is a plan view of the shower head 101 according to the second embodiment of the present invention, FIG. 10 is a section view taken along line X-X of the shower head 101 shown in FIG. 9, and FIG. 11 is an exploded perspective view of the shower head 101 shown in FIG. 9.

As shown in FIGS. 9 to 11, the shower head 101 of the second embodiment also includes a storage chamber 105 (which is also called cavity) configured to store water supplied from a water supply source (not shown) through water supply members 102, 103.

A secondary-side flow-path member 104 is provided on a spout-surface side of the shower head 101 with respect to the storage chamber 105. The secondary-side flow-path member 104 consists of four stacked substantially discoid element parts 140, 147, 148, 149, three central spout parts 161, 162, 163, and a seal part 165. The secondary-side flow-path member 104 has three flow paths (an example of a plurality of flow paths), each of which corresponds to each of three spout modes (an example of the plurality of spout modes).

Three valve seats 141 to 143 protruded on a side of the storage chamber 105 are formed on the element part 140 facing to the storage chamber 105. A communication hole that communicates with a corresponding flow path among the three flow paths is provided at a center of each of the valve seats 141 to 143. The three valve seats 141 to 143 (and their corresponding communication holes) are annularly arranged at even intervals in a circumferential direction, i.e., every 120 degrees.

Three diaphragm valves 121 to 123, which correspond to the three valve seats 141 to 143, respectively, are annularly arranged. The three diaphragm valves 121 to 123 are separate independent members, which is different from the first embodiment.

A seal ring part 124 is arranged to surround the three diaphragm valves 121 to 123. The seal ring part 124 is sandwiched between an upper edge portion 140*a* of the element part 140 and a cover member 108 in a watertight manner. The cover member 108 consists of a cover main part 108*a* and two upper discoid parts 108*b*, 108*c*. The diaphragm valves 121 to 123 are supported on an upper surface of the element part 140 via spacing members 171 to 173, respectively.

Coil springs 151 to 153 (an example of an elastic member) are provided between the respective diaphragm valves 121 to 123 and a lower surface of the cover member 108, so that each of the diaphragm valves 121 to 123 is biased in a valve-closing direction by means of the corresponding coil spring 151 to 153.

The three diaphragm valves 121 to 123 of the present embodiment are also annularly arranged, and a pilot hole (a part of which is a back-pressure-chamber outlet hole 121*c* to 123*c* formed on a lower-surface side of the cover member 108) for communicating a back pressure chamber 121*b* to 123*b* of each of the three diaphragm valves 121 to 123 with a space below the element part 140, which is a space outside the storage chamber 105, is collectively located at a central region of the three diaphragm valves 121 to 123, so that the pilot hole is opened and closed by a disc-shaped member 110, which serves as a common pilot valve. (When the number of the plurality of diaphragm valves is two, a pilot hole for communicating a back pressure chamber of each of the two diaphragm valves with the space below the element part 140 may be collectively located at a middle region of the two diaphragm valves.)

The disc-shaped member 110 is also made of resin. The disc-shaped member 110 is supported in a rotatable manner around an axis thereof, and has twelve teeth 110*t* on an outer circumference thereof.

Figure 12:
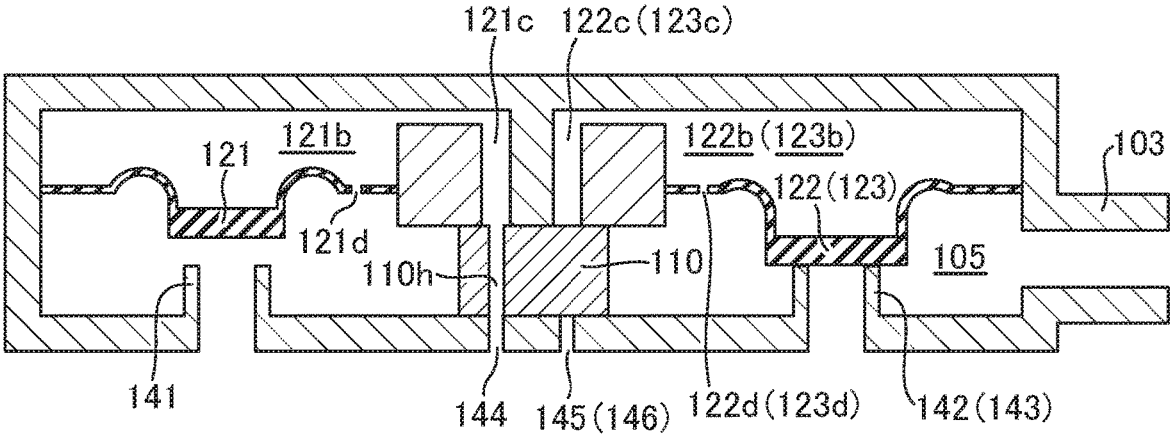
FIG. 12 is a schematic view for explaining an opened/closed state of a pilot hole.

FIG. 12 is a schematic view for explaining an opened/closed state of a pilot hole, similarly to FIG. 4. The numeral signs in FIG. 12 correspond to the numeral signs in FIG. 4 added by 100, respectively. The disc-shaped member 110 also has four communication holes 110*h* (an example of the plurality of communication holes). As shown in FIG. 12 schematically, each of the four communication holes 110*h* is configured to open a corresponding pilot hole of a corresponding diaphragm valve 121 to 123 when selectively communicating with a corresponding back-pressure-chamber outlet hole 121*c* to 123*c* provided on a corresponding back pressure chamber 121*b* to 123*b* of the corresponding diaphragm valve 121 to 123, in response to a rotational position of the disc-shaped member 110. More specifically, when each of the four communication holes 110*h* selectively communicates with the corresponding back-pressure-chamber outlet hole 121*c* to 123*c* and a corresponding outlet hole 144 to 146 in the element part 140 provided correspondingly to the corresponding back-pressure-chamber outlet hole 121*c* to 123*c*, the corresponding pilot hole of the corresponding diaphragm valve 121 to 123 is opened. The four communication holes 110*h* are also annularly arranged at even intervals in a circumferential direction, i.e., every 90 degrees. The back-pressure-chamber outlet holes 121*c* to 123*c* and the outlet holes 144 to 146 are also annularly arranged at even intervals in a circumferential direction, i.e., every 120 degrees.

Figure 13:
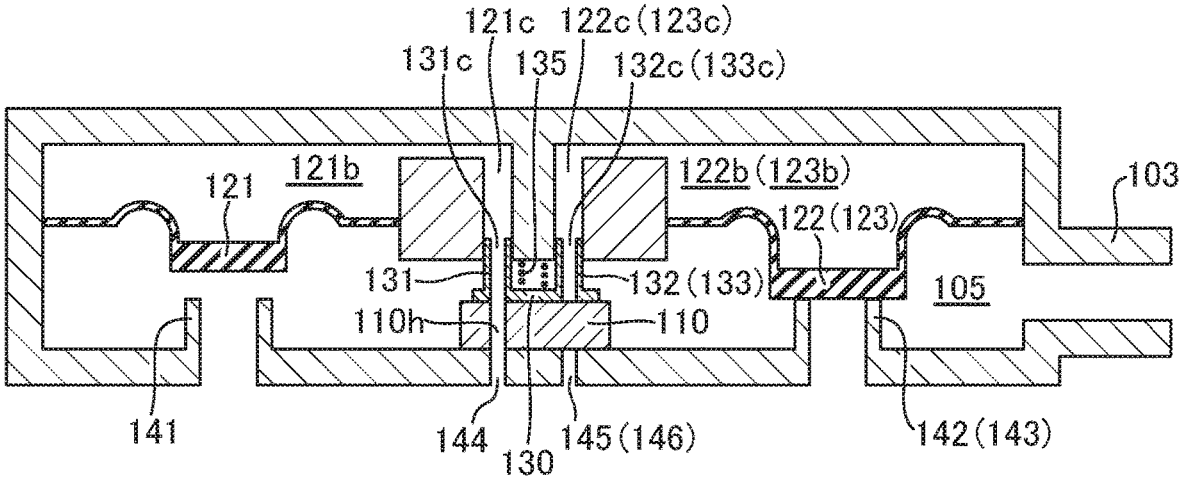
FIG. 13 is a schematic view for explaining a disc-pushing member.

FIG. 13 is a schematic view for explaining a disc-pushing member 130, similarly to FIG. 5. The numeral signs in FIG. 13 correspond to the numeral signs in FIG. 5 added by 100, respectively. As shown in FIG. 13 schematically, the disc-pushing member 130 is interposed between the back-pressure-chamber outlet holes 121*c* to 123*c* and the disc-shaped member 110. The disc-pushing member 130 is configured to push the disc-shaped member 110 away from the back-pressure-chamber outlet holes 121*c* to 123*c* (toward the element part 140) by means of a coil spring 135 as an example of a biasing part.

The disc-pushing member 130 is provided with three outlet communication holes 131*c* to 133*c*, each of which can communicate with the corresponding back-pressure-chamber outlet hole 121*c* to 123*c* provided on the corresponding back pressure chamber 121*b* to 123*b* of the corresponding diaphragm valve 121 to 123. In the present embodiment as well, each of the outlet communication holes 131*c* to 133*c* is formed by a tubular part 131 to 133, and each of the tubular parts 131 to 133 is inserted into the corresponding back-pressure-chamber outlet hole 121*c* to 123*c*. There remains a gap between each of the tubular parts 131 to 133 and the corresponding back-pressure-chamber outlet hole 121*c* to 123*c*, and the gap is configured to function as a corresponding back-pressure-chamber inlet hole. (However, at least at the time of filing the present application, the scope of the present invention does not exclude a manner wherein each of back-pressure-chamber inlet holes 121*d* to 123*d* is provided through a portion of the corresponding diaphragm valve 121 to 123, as shown in FIG. 12).

With reference to FIG. 11 again, a push button 111 is provided on a lower portion of a shower head housing 107 as an operation part configured to receive an operation force from a user. (Any other type of button or slide switch may be provided in place of the push button 111.)

Every time the push button 111 receives an operation force (a pushing force) from a user (every time the user gives an operation force (a pushing force) to the push button 111), the push button 111 pivots around a pivot shaft 111*s*. Then, in coordination with the pivot movement, by means of abutment and slide between an abutment slide inclined portion 111*a* of the push button 111 and an abutment slide ring part 112*a* provided at a proximal end portion of a shaft part 112, the shaft part 112 is configured to reciprocate in an axial direction thereof.

Figure 14:
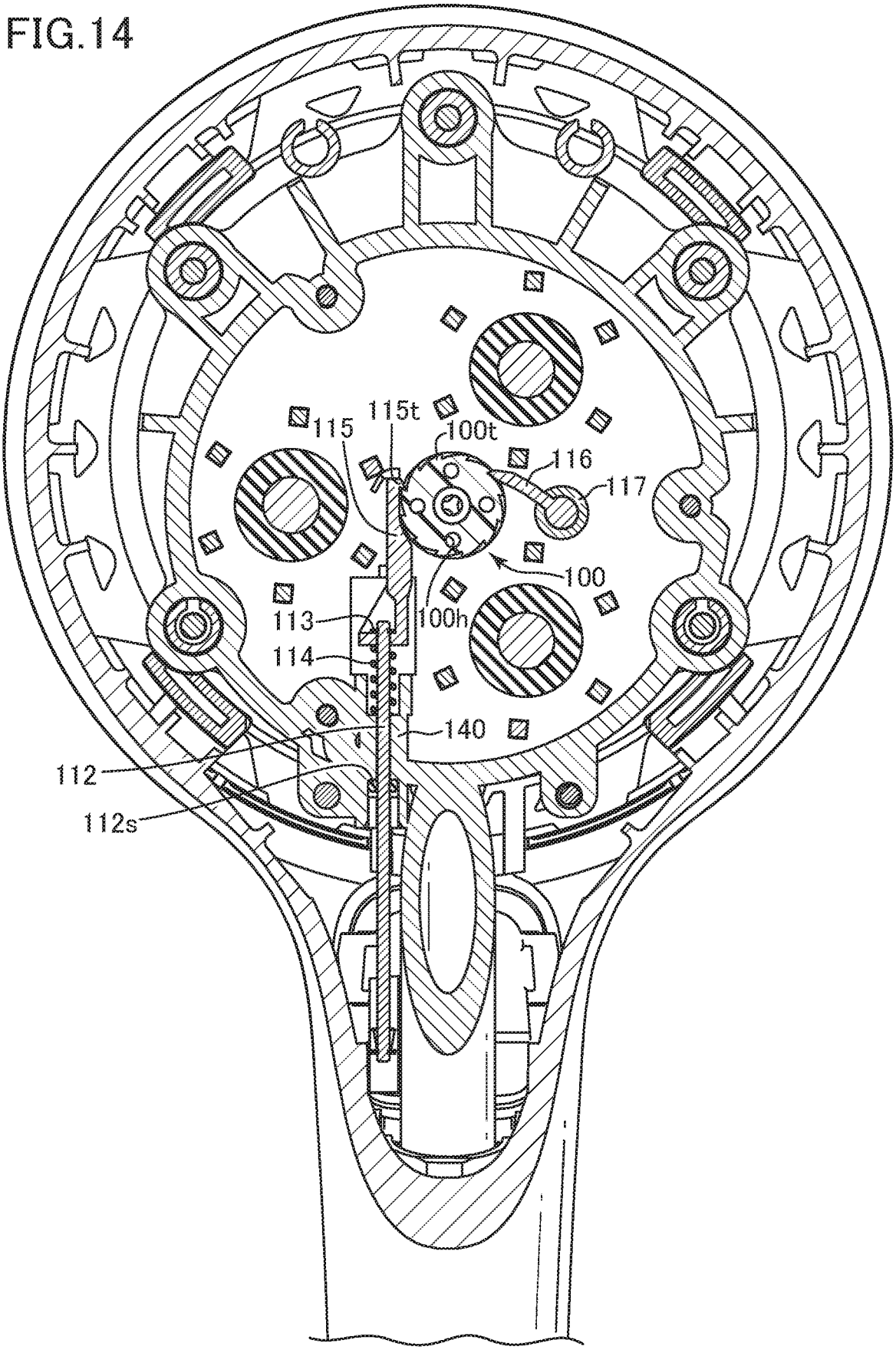
FIG. 14 is a schematic view for explaining a state wherein a disc-shaped member has started to be rotated.

A distal end portion of the shaft part 112 is exposed to the water in the storage chamber 105 (see FIG. 14, too). Thus, the shaft part 112 is made of a metal bar which is difficult to rust, such as a stainless-steel bar. In the present embodiment as well, the shaft part 112 slidably pierces through the element part 140 integrally fixed to the shower head housing 107. A seal ring part 112*s* is provided for maintaining watertight performance.

FIG. 14 is a schematic view for explaining a state wherein the disc-shaped member 110 has started to be rotated, similarly to FIG. 6. As shown in FIG. 14, a coil spring 114 is arranged around a distal end portion of the shaft part 112 located in the storage chamber 105. A proximal end of the coil spring 114 is fixed to the element part 140, and thus fixed to the shower head housing 107 (to the pivot shaft 111*s* of the push button 111).

A claw member 115 is fixed to a distal end of the coil spring 114. A stopper 113 for the claw member 115 is attached to the distal end portion of the shaft part 112. The distal end of the coil spring 114 and the claw member 115 are movable in an axial direction by deformation of the coil spring 114 in the axial direction in a region on the side of the proximal end portion of the shaft part 112 with respect to the stopper 113.

Furthermore, the distal end of the coil spring 114 and the claw member 115 are also movable in an inclined direction, which is inclined with respect to the axial direction of the coil spring 114, by deformation of the coil spring 114 in the inclined direction.

A claw 115*t* is provided on a lateral surface of the claw member 115 on the side of the disc-shaped member 110. The claw 115*t* is configured to engage with the teeth 110*t* of the disc-shaped member 110. The disc-shaped member 110 is rotated when the claw 115*t* draws one of the teeth 110*t* while the shaft part 112 reciprocates.

In addition, a stopper claw 116 configured to prevent the disc-shaped member 110 (teeth 110*t*) from reversely rotating is held by a stopper-claw fixing part 117 provided on the element part 140.

Operation of Second Embodiment

Next, an operation of the shower head 101 according to the second embodiment is explained.

With reference to FIG. 13, when a user pushes the push button 111, the pushing force (operating force) causes the abutment slide inclined portion 111*a* of the push button 111 to pivot around the pivot shaft 111*s*, so that the shaft part 112 moves in a direction toward the proximal end portion thereof (the right side in FIG. 13) via the abutment slide ring part 112*a*.

The state shown in FIG. 14 corresponds to a state before the user pushes the push button 111. From this state, the shaft part 112 starts to move. When the claw 115*t* of the claw member 115 draws one of the teeth 110*t* of the disc-shaped member 110, the disc-shaped member 110 is rotated (see FIG. 7, too). In the state wherein the push button 111 has been pushed to a deepest position thereof and thus the shaft part 112 has moved to a most proximal-end-side position thereof (rightmost position in FIG. 13), the stopper claw 116 stops a tooth 110*t* next to that in FIG. 14. Accordingly, the disc-shaped member 110 is rotated by 30 degrees every time the user pushes the push button 111.

In this state, the coil spring 114 is compressed between the claw member 115 (and the stopper 113 at the distal end portion of the shaft part 112) and the element part 140. From this state, when the pushing force against the push button 111 is released, the shaft part 112 and the push button 111 are returned back to their original positions (the state shown in FIG. 14) by a resilience force of the coil spring 114. During this step, the claw 115*t* does not engage with any tooth 110*t*, and the disc-shaped member 110 is not reversely rotated in combination with the existence of the claw stopper 116. In addition, during the above step, the claw member 115 is movable in the inclined direction, which is inclined with respect to the axial direction of the coil spring 114, by the deformation of the coil spring 114 in the inclined direction. Thus, it is possible to effectively avoid resistance (interference) from the disc-shaped member 110. In addition, when the claw member 115 is returned back to an original position thereof (the state shown in FIG. 14), the claw member 115 (claw 115*t*) engages with the tooth 110*t* next to the previously drawn one, by the resilience force of the coil spring 114.

As described above, the four communication holes 110*h* are annularly arranged at even intervals in a circumferential direction, i.e., every 90 degrees, and the back-pressure-chamber outlet holes 121*c* to 123*c* and the outlet holes 144 to 146 are annularly arranged at even intervals in a circumferential direction, i.e., every 120 degrees. Thus, when the disc-shaped member 110 is rotated by 30 degrees, it is possible to sequentially switch the following three spout modes:

(i) a first spout mode wherein the back-pressure-chamber outlet holes 121*c* and the outlet hole 144 communicate with each other while the back-pressure-chamber outlet holes 122*c*, 123*c* and the outlet holes 145, 146 do not communicate with each other;

(ii) a second spout mode wherein the back-pressure-chamber outlet holes 122*c* and the outlet hole 145 communicate with each other while the back-pressure-chamber outlet holes 121*c*, 123*c* and the outlet holes 144, 146 do not communicate with each other; and (iii) a third spout mode wherein the back-pressure-chamber outlet holes 123*c* and the outlet hole 146 communicate with each other while the back-pressure-chamber outlet holes 121*c*, 122*c* and the outlet holes 144, 145 do not communicate with each other.

The state shown in the right side half of FIG. 12 or FIG. 13 is an example of a state wherein a back-pressure-chamber outlet hole and the corresponding outlet hole do not communicate with each other, i.e., the corresponding pilot hole of the corresponding diaphragm valve is not opened. In the state shown in the right side half of FIG. 12 or FIG. 13, the back-pressure-chamber outlet holes 122*c*, 123*c* and the corresponding outlet holes 145, 146 are blocked by the disc-shaped member 110. On the other hand, through the back-pressure-chamber inlet holes 122*d*, 123*d* (in the case shown in FIG. 12) or through the gaps between the tubular parts 132, 133 and the corresponding back-pressure-chamber outlet holes 122*c*, 123*c* (in the case shown in FIG. 13), the water pressure in the storage chamber 105 and the water pressures in the back pressure chambers 123*b*, 123*c* are made equal to each other. Thus, each of the diaphragm valves 122, 123 is closed by a biasing force of the corresponding coil spring 152, 153 (not shown in FIGS. 12 and 13).

The state shown in the left side half of FIG. 12 or FIG. 13 is an example of a state wherein a back-pressure-chamber outlet hole and the corresponding outlet hole communicate with each other, i.e., the corresponding pilot hole of the corresponding diaphragm valve is opened. In the state shown in the left side half of FIG. 12 or FIG. 13, the back-pressure-chamber outlet hole 121*c* and the corresponding outlet hole 144 communicate with each other through the communication hole 110*h* of the disc-shaped member 110. In this state, the water in the back pressure chamber 121*b* flows out through the back-pressure-chamber outlet hole 121*c* and the corresponding outlet hole 144, so that the water pressure in the storage chamber 105 becomes greater than the water pressure in the back pressure chamber 121*b*. Thus, the diaphragm valve 121 is opened in spite of the biasing force of the corresponding coil spring 151 (not shown in FIGS. 12 and 13).

Effects of Second Embodiment

As described above, according to the shower head 101 of the second embodiment as well, since the communicated/blocked state between each of the three flow paths and the storage chamber 105 is controlled by each of the three diaphragm valves 121 to 123, a remarkable and stable reduction of an operation force for the switching operation is achieved for a long time without using grease.

In particular, according to the shower head 101 of the second embodiment, the pilot hole for communicating the back pressure chamber 121*b* to 123*b* of each of the annularly-arranged three diaphragm valves 121 to 123 with the space outside the storage chamber 105 is collectively located at the central region of the three diaphragm valves 121 to 123 so that the pilot hole is opened and closed by the common disc-shaped member 110 (pilot valve). Thus, the shower head 101 is made to be compact. In addition, a moving range (moving distance) of the disc-shaped member 110 (pilot valve) is sufficiently small, which contributes to a further reduction of the operating force.

In addition, according to the shower head 101 of the second embodiment, the disc-shaped member 110 is supported in a rotatable manner around the axis thereof and has the teeth 110*t* on the outer circumference thereof. Thus, it is possible to easily drive the disc-shaped member 110 in rotation by using the teeth 110*t*.

In addition, according to the shower head 101 of the second embodiment, the disc-shaped member 110 is made of resin. Thus, it is possible to easily achieve high smoothness, which can inhibit sliding resistance (sliding friction). In addition, it is unnecessary to separately provide a seal part.

In addition, according to the shower head 101 of the second embodiment, the disc-shaped member 110 has the four communication holes 110*h*, and each of the four communication holes 110*h* is configured to open the corresponding pilot hole of the corresponding diaphragm valve 121 to 123 when selectively communicating with the corresponding back-pressure-chamber outlet hole 121*c* to 123*c* provided on the corresponding back pressure chamber 121*b* to 123*b* of the corresponding diaphragm valve 121 to 123, in response to a rotational position of the disc-shaped member 110. Thus, the shower head 101 is made to be more compact. In addition, a rotation angle (moving distance) of the disc-shaped member 110 (pilot valve) is sufficiently small (no more than 30 degrees), which contributes to a further reduction of the operating force.

In addition, according to the shower head 101 of the second embodiment, the disc-pushing member 130 is interposed between the corresponding back-pressure-chamber outlet hole 121*c* to 123*c* and the disc-shaped member 110, the disc-pushing member 130 has the outlet communication holes 131*c* to 133*c* each of which can communicate with the corresponding back-pressure-chamber outlet hole 121*c* to 123*c* provided on the corresponding back pressure chamber 121*b* to 123*b* of the corresponding diaphragm valve 121 to 123, and the disc-pushing member 130 is configured to push the disc-shaped member 110 away from the corresponding back-pressure-chamber outlet hole 121*c* to 123*c* by means of the coil spring 135. Thus, it is unnecessary to provide a seal part between the disc-shaped member 110 and the element part 140 (a member located away from the back-pressure-chamber outlet holes 121*c* to 123*c* with respect to the disc-shaped member 110).

In particular, according to the shower head 101 of the second embodiment, each of the outlet communication holes 131*c* to 133*c* is formed by the corresponding tubular part 131 to 133, each of the tubular parts 131 to 133 is inserted into the corresponding back-pressure-chamber outlet hole 121*c* to 123*c*, the gap between each of the tubular parts 131 to 133 and the corresponding back-pressure-chamber outlet hole 121*c* to 123*c* is configured to function as a corresponding back-pressure-chamber inlet hole. It is easy to form the gap with high precision, and thus it is possible to effectively inhibit variation in performance among the three back-pressure-chamber inlet holes (the three gaps) for the three diaphragm valves 121 to 123.

In addition, according to the shower head 101 of the second embodiment, by using a driving mechanism including: the push button 111 configured to receive an operation force from a user; the shaft part 112 configured to reciprocate in the axial direction thereof every time the push button 111 receives the operation force; and the claw member 115 attached to the distal end portion of the shaft part 112 and having the claw 115*t* configured to engage with the teeth 110*t* of the disc-shaped member 110, the disc-shaped member 110 is rotated when the claw 115*t* draws one of the teeth 110*t* while the shaft part 112 reciprocates. Since the force for driving the disc-shaped member 110 in rotation is applied in a direction in which the claw 115*t* draws one of the teeth 110*t*, it is possible to prevent (avoid) buckling deformation of the shaft part 112. Thus, rigidity required for the shaft part 112 can be reduced. As a result, it is possible to make the shaft part 112 of not only a rigid material but also a plastic material such as string or an elastic material such as rubber.

In particular, according to the shower head 101 of the second embodiment, the proximal end portion of the shaft part 112 is operably connected to the push button part 111, the coil spring 114 is arranged around the distal end portion of the shaft part 112, the proximal end of the coil spring 114 is fixed to the element part 140, the distal end of the coil spring 114 is fixed to the claw member 115, and the stopper 113 for the claw member 115 is attached to the distal end portion of the shaft part 112. Thus, the claw member 115 is movable relative to the shaft part 112 by deformation of the coil spring 114 (both in the axial direction and in the inclined direction). Thus, after the claw member 115 has drawn one tooth 110*t*, when the claw member 115 is returned to the original position thereof (the state shown in FIG. 14) to engage with the next tooth 110*t*, it is possible to effectively avoid resistance (interference) from the disc-shaped member 110.

In addition, according to the shower head 101 of the second embodiment, the three diaphragm valves 21 to 23 are separate independent members. Thus, the three diaphragm valves 21 to 23 are replaceable independent of each other.

In addition, according to the shower head 101 of the second embodiment, each of the three diaphragm valves 121 to 123 is biased in a valve-closing direction by means of the corresponding coil spring 151 to 153. Thus, the movement for opening and closing each of the three diaphragm valves 121 to 123 is stabilized.

[Complement Regarding Flow Paths]

In the shower heads 1, 101 of the above embodiments, the opened/closed state of each of the three diaphragm valves 21 to 23, 121 to 123 corresponds to the communicated/blocked state of each of the three flow paths in the secondary-side flow-path member 4, 104 on a one-to-one basis, and just one diaphragm valve is opened at a time in response to a rotational position of the disc-shaped member 10, 110, so that just one flow path is communicated at the time. However, the present invention is not limited to this matter, For example, by changing an arrangement pattern of the communication holes 10*h*, 110*h* of the disc-shaped member 10, 110, a plurality of diaphragm valves may be opened at the same time in response to a rotational position of the disc-shaped member 10, 110, so that a plurality of flow paths may be communicated at the same time to achieve a composite-type spout.

Alternatively, for example, by changing an arrangement pattern of the flow paths in the secondary-side flow-path member 4, 104, a plurality of flow paths may be communicated at the same time to achieve a composite-type spout when a specific diaphragm valve is opened.

Furthermore, by changing an arrangement pattern of the communication holes 10*h*, 110*h* of the disc-shaped member 10, 110, all the diaphragm valves may be closed at the same time in response to a rotational position of the disc-shaped member 10, 110, so that all the flow paths may be blocked at the same time to achieve a temporal water stop. That is to say, by means of such a structure, it is possible to achieve a temporal water stop by operating the push button 11, 111.

Variation of Second Embodiment

The shower head 101 of the second embodiment is a shower head for which a plurality of spout modes can be switched (water can be discharged in each of the plurality of spout modes) by using the three separate diaphragm valves 121 to 123 (an example of main valve body).

In the second embodiment, each of the diaphragm valves 121 to 123 may be replaced with a piston valve (another example of main valve body).

Figure 15:
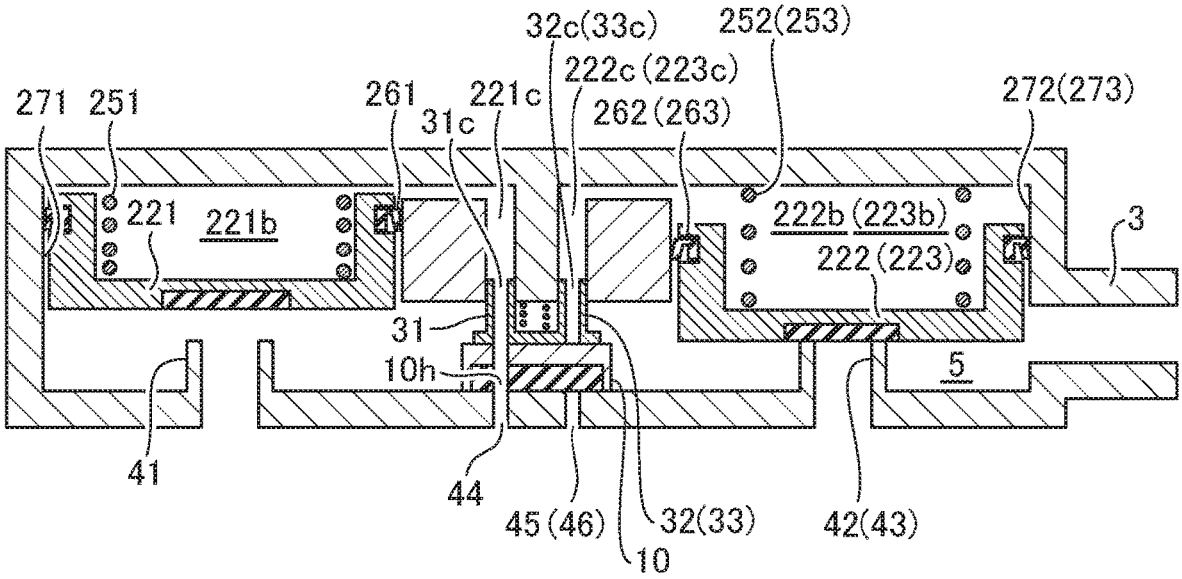
FIG. 15 is a schematic view, corresponding to FIG. 13, for explaining a variation of the second embodiment.

FIG. 15 is a schematic view, corresponding to FIG. 13, for explaining a structure wherein the diaphragm valves 121 to 123 are replaced with piston valves 221 to 223, respectively.

In the variation shown in FIG. 15, each of the piston valves 221 to 232 is slidably provided in a corresponding slide guide cylinder 271 to 273 provided on the cover main body 108*a* via a corresponding water-tight ring part 261 to 263.

Coil springs 251 to 253 (an example of an elastic member) are provided between the respective piston valves 221 to 223 and a lower surface of the cover main body 108*a*, so that each of the piston valves 221 to 223 is biased in a valve-closing direction by means of the corresponding coil spring 251 to 253.

According to the above variation as well, it is possible to achieve the same effects as the shower head 101 of the second embodiment.

Specifically, in the state wherein a pilot hole of the corresponding piston valve 222, 223 is not opened (the state shown in the right side half of FIG. 16), i.e., in the state wherein a back-pressure-chamber outlet hole 222*c*, 223*c* and the corresponding outlet hole 45, 46 are blocked by the disc-shaped member 10, through the gap (back-pressure-chamber inlet hole) between the corresponding tubular part 32, 33 and the corresponding back-pressure-chamber outlet hole 222*c*, 223*c*, the water pressure in the storage chamber 105 and the water pressure in the back pressure chamber 223*b*, 223*c* are made equal to each other. Thus, each of the piston valves 222, 223 is closed by a biasing force of the corresponding coil spring 252, 253.

On the other hand, in the state wherein a pilot hole of the corresponding piston valve 221 is opened (the state shown in the left side half of FIG. 16), i.e., in the state wherein a back-pressure-chamber outlet hole 221*c* and the corresponding outlet hole 44 communicate with each other through the corresponding communication hole 10*h* of the disc-shaped member 10, the water in the back pressure chamber 221*b* flows out through the back-pressure-chamber outlet hole 221*c* and the corresponding outlet hole 44, so that the water pressure in the storage chamber 105 becomes greater than the water pressure in the back pressure chamber 221*b*. Thus, the piston valve 221 is opened in spite of the biasing force of the corresponding coil spring 251.

Structure of Third Embodiment

As described above, the shower head 1 of the first embodiment is a shower head for which a plurality of spout modes can be switched (water can be discharged in each of the plurality of spout modes). If only one spout mode among the plurality of spout modes is limited and used, the shower head 1 is also a shower head for which the only one spout mode and a water-stop mode can be switched. That is to say, the disclosure of the shower head 1 of the first embodiment serves as a disclosure of a shower head for which a spout mode and a water-stop mode can be switched (see paragraph 0120).

However, for promoting a better understanding, a shower head according to a third embodiment of the present invention will be described with reference to the attached drawings. The shower head 301 according to the third embodiment is a shower head for which only one spout mode and a water-stop mode can be switched (water can be discharged in the one spout mode).

Figure 16:
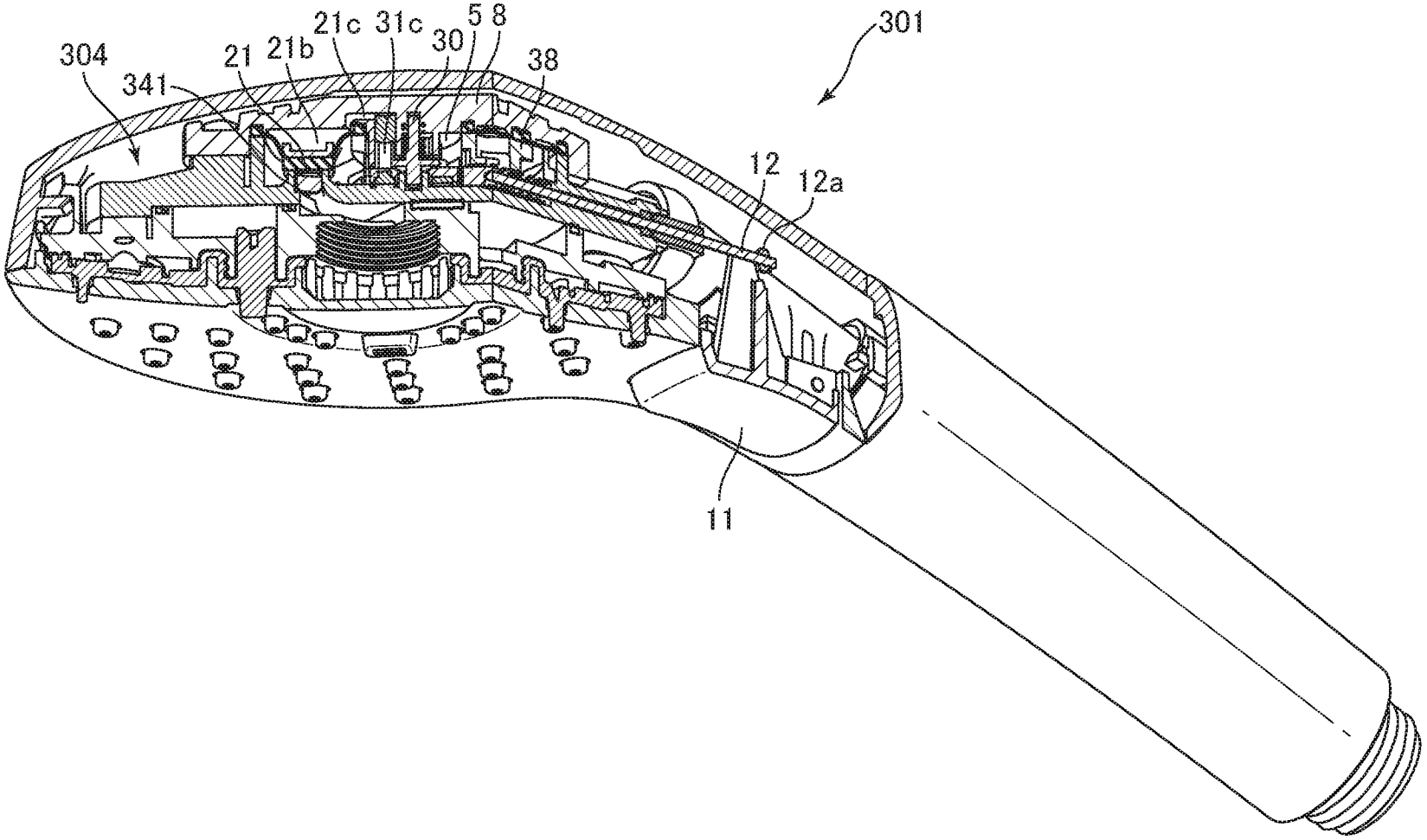
FIG. 16 is a partially sectional perspective view of a shower head according to a third embodiment of the present invention.
Figure 17:
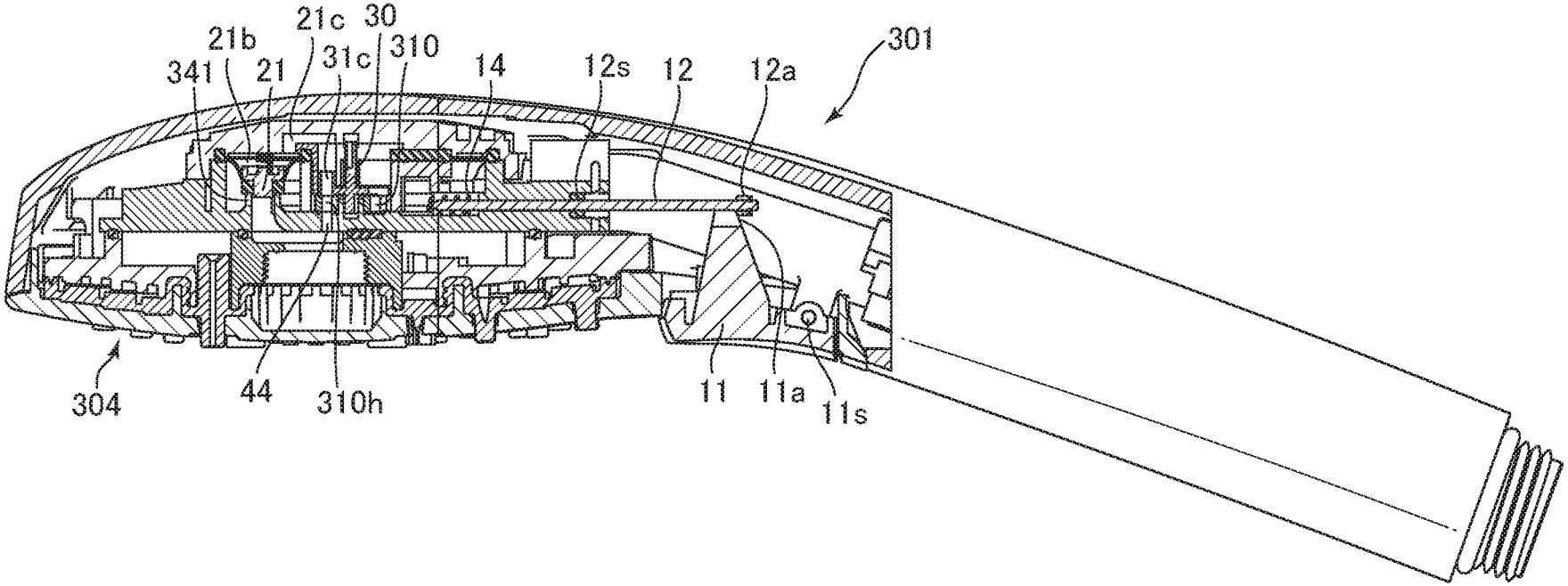
Figure 18:
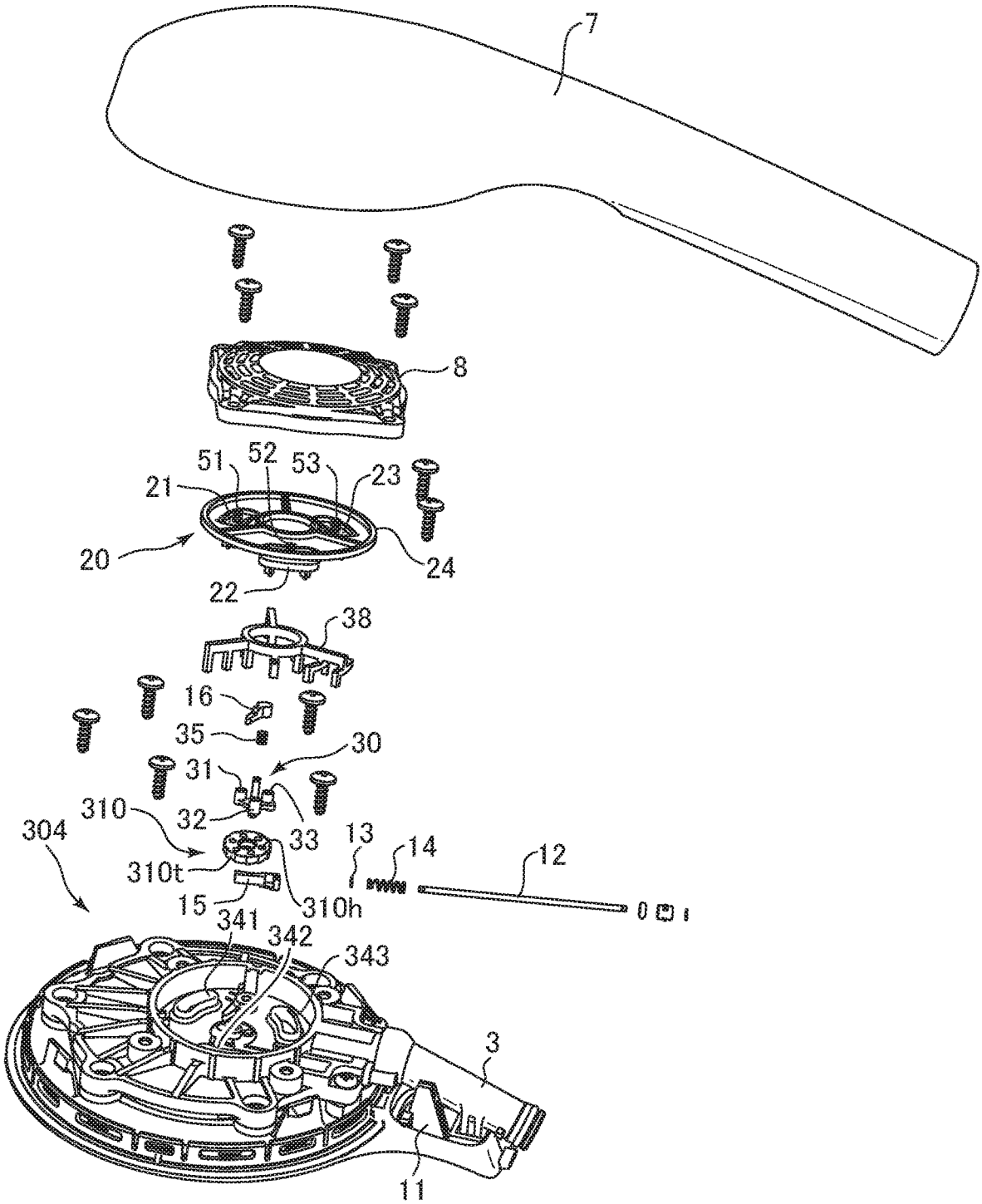
FIG. 18 is an exploded perspective view of the shower head shown in FIG. 16.

FIG. 16 is a partially sectional perspective view of the shower head 301 according to the third embodiment of the present invention, FIG. 17 is a partially longitudinal section view of the shower head 301 shown in FIG. 16, and FIG. 18 is an exploded perspective view of the shower head shown in FIG. 16.

As shown in FIGS. 16 to 18, the shower head 301 of the third embodiment includes a storage chamber 5 (which is also called cavity) configured to store water supplied from a water supply source (not shown) through water supply members 2, 3, similarly to the shower head 1 of the first embodiment.

A secondary-side flow-path member 304 is provided on a spout-surface side of the shower head 301 with respect to the storage chamber 5. The secondary-side flow-path member 304 consists of one or more substantially discoid element parts. The secondary-side flow-path member 304 has only one flow path which corresponds to only one spout mode.

Three valve seats 341 to 343 protruded on a side of the storage chamber 5 are formed on a portion of the secondary-side flow-path member 304 facing to the storage chamber 5. A communication hole that communicates with the one flow path is provided at a center of each of the valve seats 341 to 343 (see FIG. 4, too). The three valve seats 341 to 343 (and their corresponding communication holes) are annularly arranged at even intervals in a circumferential direction, i.e., every 120 degrees.

Three diaphragm valves 21 to 23, which correspond to the three valve seats 341 to 343, respectively, are annularly arranged, similarly to the shower head 1 of the first embodiment. The three diaphragm valves 21 to 23 are integrally formed as one diaphragm member 20. However, the respective diaphragm valves 21 to 23 are movable independently of each other.

A seal ring portion 24 is formed at a periphery of the diaphragm member 20. The seal ring portion 24 is sandwiched between an upper edge portion of the secondary-side flow-path member 304 and a cover member 8 in a watertight manner. A central area of the diaphragm member 20 is supported on an upper surface of the secondary-side flow-path member 304 via a spacing member 38.

Similarly to the shower head 1 of the first embodiment, coil springs 51 to 53 (an example of an elastic member) are provided between the respective diaphragm valves 21 to 23 and a lower surface of the cover member 8, so that each of the diaphragm valves 21 to 23 is biased in a valve-closing direction by means of the corresponding coil spring 51 to 53.

The three diaphragm valves 21 to 23 of the present embodiment are annularly arranged, and a pilot hole (a part of which is a back-pressure-chamber outlet hole 21*c* to 23*c* formed on a lower-surface side of the cover member 8) for communicating a back pressure chamber 21*b* to 23*b* of each of the three diaphragm valves 21 to 23 with a space in the secondary-side flow-path member 304, which is a space outside the storage chamber 5, is collectively located at a central region of the three diaphragm valves 21 to 23, so that the pilot hole is opened and closed by a disc-shaped member 10, which serves as a common pilot valve. (When the number of the plurality of diaphragm valves is two, a pilot hole for communicating a back pressure chamber of each of the two diaphragm valves with the space in the secondary-side flow-path member 304 may be collectively located at a middle region of the two diaphragm valves.)

Similarly to the shower head 1 of the first embodiment, the disc-shaped member 310 is made of resin. The disc-shaped member 310 is supported in a rotatable manner around an axis thereof, and has twelve teeth 310*t* on an outer circumference thereof (see FIGS. 6 to 8, too).

An opened/closed state of a pilot hole of the present embodiment is substantially the same as that of the first embodiment, and is explained with reference to FIG. 4 just in case. The valve seats 41 to 43 in FIG. 4 correspond to the valve seats 341 to 343 in the present embodiment, and the disc-shaped member 10 and the communication holes 10*h* in FIG. 4 substantially correspond to the disc-shaped member 310 and the communication holes 310*h* in the present embodiment. The disc-shaped member 310 has six communication holes 310*h* (four communication holes 10*h* in the first embodiment). As shown in FIG. 4 schematically, each of the six communication holes 310*h* is configured to open a corresponding pilot hole of a corresponding diaphragm valve 21 to 23 when selectively communicating with a corresponding back-pressure-chamber outlet hole 21*c* to 23*c* provided on a corresponding back pressure chamber 21*b* to 23*b* of the corresponding diaphragm valve 21 to 23, in response to a rotational position of the disc-shaped member 310. More specifically, when each of the six communication holes 310*h* selectively communicates with the corresponding back-pressure-chamber outlet hole 21*c* to 23*c* and a corresponding outlet hole 44 to 46 in the secondary-side flow-path member 304 provided correspondingly to the corresponding back-pressure-chamber outlet hole 21*c* to 23*c*, the corresponding pilot hole of the corresponding diaphragm valve 21 to 23 is opened. The six communication holes 310*h* are annularly arranged at even intervals in a circumferential direction, i.e., every 60 degrees. The back-pressure-chamber outlet holes 21*c* to 23*c* and the outlet holes 44 to 46 are also annularly arranged at even intervals in a circumferential direction, i.e., every 120 degrees.

A disc-pushing member 30 of the present embodiment is substantially the same as that of the first embodiment, and is explained with reference to FIG. 5 just in case. The valve seats 41 to 43 in FIG. 5 correspond to the valve seats 341 to 343 in the present embodiment, and the disc-shaped member 10 and the communication holes 10*h* in FIG. 5 substantially correspond to the disc-shaped member 310 and the communication holes 310*h* in the present embodiment. As shown in FIG. 5 schematically, the disc-pushing member 30 is interposed between the back-pressure-chamber outlet holes 21*c* to 23*c* and the disc-shaped member 310. The disc-pushing member 30 is configured to push the disc-shaped member 310 away from the back-pressure-chamber outlet holes 21*c* to 23*c* (toward the secondary-side flow-path member 304) by means of a coil spring 35 as an example of a biasing part.

The disc-pushing member 30 is provided with three outlet communication holes 31*c* to 33*c*, each of which can communicate with the corresponding back-pressure-chamber outlet hole 21*c* to 23*c* provided on the corresponding back pressure chamber 21*b* to 23*b* of the corresponding diaphragm valve 21 to 23. In the present embodiment, each of the outlet communication holes 31*c* to 33*c* is formed by a tubular part 31 to 33. Each of the tubular parts 31 to 33 is inserted into the corresponding back-pressure-chamber outlet hole 21*c* to 23*c*. There remains a gap between each of the tubular parts 31 to 33 and the corresponding back-pressure-chamber outlet hole 21*c* to 23*c*, and the gap is configured to function as a corresponding back-pressure-chamber inlet hole. (However, at least at the time of filing the present application, the scope of the present invention does not exclude a manner wherein each of back-pressure-chamber inlet holes 21*d* to 23*d* is provided through a portion of the corresponding diaphragm valve 21 to 23, as shown in FIG. 4).

With reference to FIG. 17 again, similarly to the shower head 1 of the first embodiment, a push button 11 is provided on a lower portion of a shower head housing 7 as an operation part configured to receive an operation force from a user. (Any other type of button or slide switch may be provided in place of the push button 11.)

Every time the push button 11 receives an operation force (a pushing force) from a user (every time the user gives an operation force (a pushing force) to the push button 11), the push button 11 pivots around a pivot shaft 11*s*. Then, in coordination with the pivot movement, by means of abutment and slide between an abutment slide inclined portion 11*a* of the push button 11 and an abutment slide ring part 12*a* provided at a proximal end portion of a shaft part 12, the shaft part 12 is configured to reciprocate in an axial direction thereof.

A distal end portion of the shaft part 12 is exposed to the water in the storage chamber 5 (see FIGS. 6 to 8, too). Thus, the shaft part 12 is made of a metal bar which is difficult to rust, such as a stainless-steel bar. In the present embodiment, the shaft part 12 slidably pierces through the secondary-side flow-path member 304 integrally fixed to the shower head housing 7. A seal ring part 12*s* is provided for maintaining watertight performance. The shaft part 12 may be made of not only a rigid material but also a plastic material such as string or an elastic material such as rubber.

A state wherein the disc-shaped member 310 has started to be rotated is substantially the same as that of the first embodiment, and is explained with reference to FIGS. 6 to 8 just in case. The element part 40 in FIGS. 6 to 8 corresponds to the secondary-side flow-path member 304 in the present embodiment, and the disc-shaped member 10, the communication holes 10*h* and the teeth 10*t* in FIGS. 6 to 8 substantially correspond to the disc-shaped member 310, the communication holes 310*h* and the teeth 310*t* in the present embodiment.

As shown in FIGS. 6 to 8, a coil spring 14 is arranged around a distal end portion of the shaft part 12 located in the storage chamber 5. A proximal end of the coil spring 14 is fixed to the secondary-side flow-path member 304, and thus fixed to the shower head housing 7 (to the pivot shaft 11*s* of the push button 11).

A claw member 15 is fixed to a distal end of the coil spring 14. A stopper 13 for the claw member 15 is attached to the distal end portion of the shaft part 12. The distal end of the coil spring 14 and the claw member 15 are movable in an axial direction by deformation of the coil spring 14 in the axial direction in a region on the side of the proximal end portion of the shaft part 12 with respect to the stopper 13.

Furthermore, the distal end of the coil spring 14 and the claw member 15 are also movable in an inclined direction, which is inclined with respect to the axial direction of the coil spring 14, by deformation of the coil spring 14 in the inclined direction.

A claw 15*t* is provided on a lateral surface of the claw member 15 on the side of the disc-shaped member 310. The claw 15*t* is configured to engage with the teeth 310*t* of the disc-shaped member 310. The disc-shaped member 310 is rotated when the claw 15*t* draws one of the teeth 310*t* while the shaft part 12 reciprocates (from the state shown in FIG. 6, through the stage shown in FIG. 7, to the state sown in FIG. 8).

In addition, a stopper claw 16 configured to prevent the disc-shaped member 310 (teeth 310*t*) from reversely rotating is held by a stopper-claw fixing part 17 provided on the secondary-side flow-path member 304.

Operation of Third Embodiment

Next, an operation of the shower head 301 according to the third embodiment is explained.

With reference to FIG. 17, when a user pushes the push button 11, the pushing force (operating force) causes the abutment slide inclined portion 11*a* of the push button 11 to pivot around the pivot shaft 11*s*, so that the shaft part 12 moves in a direction toward the proximal end portion thereof (the right side in FIG. 17) via the abutment slide ring part 12*a*.

The state shown in FIG. 6 corresponds to a state before the user pushes the push button 11. From this state, the shaft part 12 starts to move. When the claw 15*t* of the claw member 15 draws one of the teeth 310*t* of the disc-shaped member 310, the disc-shaped member 310 is rotated, as shown in FIG. 7. The state shown in FIG. 8 corresponds to a state wherein the push button 11 has been pushed to a deepest position thereof and thus the shaft part 12 has moved to a most proximal-end-side position thereof (rightmost position in FIG. 17). In the state shown in FIG. 8, the stopper claw 16 stops a tooth 310*t* next to that in FIG. 6. Accordingly, the disc-shaped member 310 is rotated by 30 degrees every time the user pushes the push button 11.

In the state shown in FIG. 8, the coil spring 14 is compressed between the claw member 15 (and the stopper 13 at the distal end portion of the shaft part 12) and the secondary-side flow-path member 304. From this state, when the pushing force against the push button 11 is released, the shaft part 12 and the push button 11 are returned back to their original positions (the state shown in FIG. 6) by a resilience force of the coil spring 14. During this step, the claw 15*t* does not engage with any tooth 310*t*, and the disc-shaped member 310 is not reversely rotated in combination with the existence of the claw stopper 16. In addition, during the above step, the claw member 15 is movable in the inclined direction, which is inclined with respect to the axial direction of the coil spring 14, by the deformation of the coil spring 14 in the inclined direction. Thus, it is possible to effectively avoid resistance (interference) from the disc-shaped member 310. In addition, when the claw member 15 is returned back to an original position thereof (the state shown in FIG. 6), the claw member 15 (claw 15*t*) engages with the tooth 310*t* next to the previously drawn one, by the resilience force of the coil spring 14.

As described above, the six communication holes 310*h* are annularly arranged at even intervals in a circumferential direction, i.e., every 60 degrees, and the back-pressure-chamber outlet holes 21*c* to 23*c* and the outlet holes 44 to 46 are annularly arranged at even intervals in a circumferential direction, i.e., every 120 degrees. Thus, when the disc-shaped member 310 is rotated by 30 degrees, it is possible to sequentially switch the spout mode, in which the back-pressure-chamber outlet holes 21*c* to 23*c* and the outlet holes 44 to 46 communicate with each other in three pairs (whose combination is free) at the same time, and the water-stop mode, in which the back-pressure-chamber outlet holes 21*c* to 23*c* and the outlet holes 44 to 46 do not communicate with each other.

The state shown in the right side half of FIG. 4 or FIG. 5 is an example of a state wherein a back-pressure-chamber outlet hole and the corresponding outlet hole do not communicate with each other, i.e., the corresponding pilot hole of the corresponding diaphragm valve is not opened. In the state shown in the right side half of FIG. 4 or FIG. 5, the back-pressure-chamber outlet holes 22*c*, 23*c* and the corresponding outlet holes 45, 46 are blocked by the disc-shaped member 310. On the other hand, through the back-pressure-chamber inlet holes 22*d*, 23*d* (in the case shown in FIG. 4) or through the gaps between the tubular parts 32, 33 and the corresponding back-pressure-chamber outlet holes 22*c*, 23*c* (in the case shown in FIG. 5), the water pressure in the storage chamber 5 and the water pressures in the back pressure chambers 23*b*, 23*c* are made equal to each other. Thus, each of the diaphragm valves 22, 23 is closed by a biasing force of the corresponding coil spring 52, 53 (not shown in FIGS. 4 and 5).

The state shown in the left side half of FIG. 4 or FIG. 5 is an example of a state wherein a back-pressure-chamber outlet hole and the corresponding outlet hole communicate with each other, i.e., the corresponding pilot hole of the corresponding diaphragm valve is opened. In the state shown in the left side half of FIG. 4 or FIG. 5, the back-pressure-chamber outlet hole 21*c* and the corresponding outlet hole 44 communicate with each other through the communication hole 310*h* of the disc-shaped member 310. In this state, the water in the back pressure chamber 21*b* flows out through the back-pressure-chamber outlet hole 21*c* and the corresponding outlet hole 44, so that the water pressure in the storage chamber 5 becomes greater than the water pressure in the back pressure chamber 21*c*. Thus, the diaphragm valve 21 is opened in spite of the biasing force of the corresponding coil spring 51 (not shown in FIGS. 4 and 5).

Effects of Third Embodiment

As described above, according to the shower head 301 of the third embodiment, since the communicated/blocked state between the flow path in the secondary-side flow-path member 304 and the storage chamber 5 is controlled by the three diaphragm valves 21 to 23, a remarkable and stable reduction of an operation force for the switching operation between the spout mode and the water-stop mode is achieved.

In particular, according to the shower head 301 of the third embodiment, the pilot hole for communicating the back pressure chamber 21*b* to 23*b* of each of the annularly-arranged three diaphragm valves 21 to 23 with the space outside the storage chamber 5 is collectively located at the central region of the three diaphragm valves 21 to 23 so that the pilot hole is opened and closed by the common disc-shaped member 310 (pilot valve). Thus, the shower head 301 is made to be compact. In addition, a moving range (moving distance) of the disc-shaped member 310 (pilot valve) is sufficiently small, which contributes to a further reduction of the operating force.

In addition, according to the shower head 301 of the third embodiment, the disc-shaped member 310 is supported in a rotatable manner around the axis thereof and has the teeth 310*t* on the outer circumference thereof. Thus, it is possible to easily drive the disc-shaped member 310 in rotation by using the teeth 310*t*.

In addition, according to the shower head 301 of the third embodiment, the disc-shaped member 310 is made of resin. Thus, it is possible to easily achieve high smoothness, which can inhibit sliding resistance (sliding friction). In addition, it is unnecessary to separately provide a seal part.

In addition, according to the shower head 301 of the third embodiment, the disc-shaped member 310 has the six communication holes 310*h*, and each of the six communication holes 310*h* is configured to open the corresponding pilot hole of the corresponding diaphragm valve 21 to 23 when selectively communicating with the corresponding back-pressure-chamber outlet hole 21*c* to 23*c* provided on the corresponding back pressure chamber 21*b* to 23*b* of the corresponding diaphragm valve 21 to 23, in response to a rotational position of the disc-shaped member 310. Thus, the shower head 301 is made to be more compact. In addition, a rotation angle (moving distance) of the disc-shaped member 310 (pilot valve) is sufficiently small (no more than 30 degrees), which contributes to a further reduction of the operating force.

In addition, according to the shower head 301 of the third embodiment, the disc-pushing member 30 is interposed between the corresponding back-pressure-chamber outlet hole 21*c* to 23*c* and the disc-shaped member 310, the disc-pushing member 30 has the outlet communication holes 31*c* to 33*c* each of which can communicate with the corresponding back-pressure-chamber outlet hole 21*c* to 23*c* provided on the corresponding back pressure chamber 21*b* to 23*b* of the corresponding diaphragm valve 21 to 23, and the disc-pushing member 30 is configured to push the disc-shaped member 310 away from the corresponding back-pressure-chamber outlet hole 21*c* to 23*c* by means of the coil spring 35. Thus, it is unnecessary to provide a seal part between the disc-shaped member 310 and the secondary-side flow-path member 304 (a member located away from the back-pressure-chamber outlet holes 21*c* to 23*c* with respect to the disc-shaped member 310).

In particular, according to the shower head 301 of the third embodiment, each of the outlet communication holes 31*c* to 33*c* is formed by the corresponding tubular part 31 to 33, each of the tubular parts 31 to 33 is inserted into the corresponding back-pressure-chamber outlet hole 21*c* to 23*c*, the gap between each of the tubular parts 31 to 33 and the corresponding back-pressure-chamber outlet hole 21*c* to 23*c* is configured to function as a corresponding back-pressure-chamber inlet hole. It is easy to form the gap with high precision, and thus it is possible to effectively inhibit variation in performance among the three back-pressure-chamber inlet holes (the three gaps) for the three diaphragm valves 21 to 23.

In addition, according to the shower head 301 of the third embodiment, by using a driving mechanism including: the push button 11 configured to receive an operation force from a user; the shaft part 12 configured to reciprocate in the axial direction thereof every time the push button 11 receives the operation force; and the claw member 15 attached to the distal end portion of the shaft part 12 and having the claw 15*t* configured to engage with the teeth 310*t* of the disc-shaped member 310, the disc-shaped member 310 is rotated when the claw 15*t* draws one of the teeth 310*t* while the shaft part 12 reciprocates. Since the force for driving the disc-shaped member 310 in rotation is applied in a direction in which the claw 15*t* draws one of the teeth 310*t*, it is possible to prevent (avoid) buckling deformation of the shaft part 12. Thus, rigidity required for the shaft part 12 can be reduced. As a result, it is possible to make the shaft part 12 of not only a rigid material but also a plastic material such as string or an elastic material such as rubber.

In particular, according to the shower head 301 of the third embodiment, the proximal end portion of the shaft part 12 is operably connected to the push button part 11, the coil spring 14 is arranged around the distal end portion of the shaft part 12, the proximal end of the coil spring 14 is fixed to the secondary-side flow-path member 304, the distal end of the coil spring 14 is fixed to the claw member 15, and the stopper 13 for the claw member 15 is attached to the distal end portion of the shaft part 12. Thus, the claw member 15 is movable relative to the shaft part 12 by deformation of the coil spring 14 (both in the axial direction and in the inclined direction). Thus, after the claw member 15 has drawn one tooth 310*t*, when the claw member 15 is returned to the original position thereof (the state shown in FIG. 6) to engage with the next tooth 310*t*, it is possible to effectively avoid resistance (interference) from the disc-shaped member 310.

In addition, according to the shower head 301 of the third embodiment, the three diaphragm valves 21 to 23 are integrally formed as the one diaphragm member 20, and the seal ring portion 24 is provided at the periphery of the diaphragm member 20. Thus, it is unnecessary to separately provide a seal ring part.

In addition, according to the shower head 301 of the third embodiment, each of the three diaphragm valves 21 to 23 is biased in a valve-closing direction by means of the corresponding coil spring 51 to 53. Thus, the movement for opening and closing each of the three diaphragm valves 21 to 23 is stabilized.

According to the above structure as well, since the three diaphragm valves (main valve bodies) are respectively opened and closed by switching the opened/closed states of the three pilot holes by means of the disc-shaped member 310 (pilot valve), a remarkable and stable reduction of an operation force for the switching operation is achieved for a long time without using grease.

First Variation of Third Embodiment

As described above, the shower head 301 of the third embodiment is a shower head for which the spout mode and the water-stop mode can be switched by using the three separate diaphragm valves 21 to 23. Each of the three separate diaphragm valves 21 to 23 is opened when the corresponding back-pressure-chamber outlet hole 21*c* to 23*c* and the corresponding outlet hole 44 to 46 communicate with each other through the corresponding communication hole 310*h* of the disc-shaped member 310.

The three back pressure chambers 21*b* to 23*b* for the three separate diaphragm valves 21 to 23 may be connected to communicate with each other, and only one common back-pressure-chamber outlet hole may be provided for the three back pressure chambers 21*b* to 23*b*. For example, only one of the three back-pressure-chamber outlet holes 21*c* to 23*c* may be provided, and correspondingly only one of the three outlet holes 44 to 46 may be provided.

In this case, as well as the shower head 301 of the third embodiment, if the six communication holes 310*h* are annularly arranged at even intervals in a circumferential direction, i.e., every 60 degrees, when the disc-shaped member 310 is rotated by 30 degrees, it is possible to sequentially switch the spout mode, in which the only one back-pressure-chamber outlet hole and the only one outlet hole communicate with each other, and the water-stop mode, in which the only one back-pressure-chamber outlet hole and the only one outlet hole do not communicate with each other.

In the water-stop mode, i.e., in the state wherein the back-pressure-chamber outlet hole (one of the back-pressure-chamber outlet holes 21*c* to 23*c*) and the outlet hole (one of the outlet hole 44 to 46) are blocked by the disc-shaped member 310 (the state shown in the right side half of FIG. 4 or FIG. 5), the water pressure in the storage chamber 5 and the water pressure in the back pressure chamber are made equal to each other through a back-pressure-chamber inlet hole. Thus, each of the diaphragm valves 21 to 23 is closed by a biasing force of the corresponding coil spring (not shown in FIGS. 4 and 5).

In the spout mode, i.e., in the state wherein the back-pressure-chamber outlet hole (one of the back-pressure-chamber outlet holes 21*c* to 23*c*) and the outlet hole (one of the outlet hole 44 to 46) communicate with each other through the communication hole 310*h* of the disc-shaped member 310 (the state shown in the left side half of FIG. 4 or FIG. 5), the water in the back pressure chamber flows out through the back-pressure-chamber outlet hole and the outlet hole, so that the water pressure in the storage chamber 5 becomes greater than the water pressure in the back pressure chamber. Thus, each of the diaphragm valves 21 to 23 is opened in spite of the biasing force of the corresponding coil spring (not shown in FIGS. 4 and 5).

According to the above structure, since the three diaphragm valves (main valve bodies) are simultaneously opened and closed by switching the opened/closed state of the one pilot hole by means of the disc-shaped member 310 (pilot valve), a remarkable and stable reduction of an operation force for the switching operation is achieved for a long time without using grease.

Second Variation of Third Embodiment

Furthermore, in a shower head for which the spout mode and the water-stop mode can be switched, instead of the three diaphragm valves 21 to 23, only one diaphragm valve (for example, one of the three diaphragm valves 21 to 23, or another large-sized diaphragm valve replacing the three diaphragm valves 21 to 23) may be provided, and correspondingly, instead of the three valve seats 341 to 343, only one valve seat (for example, one of the three valve seats 341 to 343, or another large-sized valve seat) may be provided.

In this case, as well as the shower head 301 of the third embodiment, if the six communication holes 310*h* are annularly arranged at even intervals in a circumferential direction, i.e., every 60 degrees, when the disc-shaped member 310 is rotated by 30 degrees, it is possible to sequentially switch the spout mode, in which a back-pressure-chamber outlet hole provided for the one diaphragm valve and a corresponding outlet hole communicate with each other, and the water-stop mode, in which the back-pressure-chamber outlet hole and the corresponding outlet hole do not communicate with each other.

In the water-stop mode, i.e., in the state wherein the back-pressure-chamber outlet hole provided for the one diaphragm valve and the corresponding outlet hole are blocked by the disc-shaped member 310 (the state shown in the right side half of FIG. 4 or FIG. 5), the water pressure in the storage chamber 5 and the water pressure in the back pressure chamber are made equal to each other through a back-pressure-chamber inlet hole provided for the one diaphragm valve. Thus, the one diaphragm valve is closed by a biasing force of a corresponding coil spring (not shown in FIGS. 4 and 5).

In the spout mode, i.e., in the state wherein the back-pressure-chamber outlet hole provided for the one diaphragm valve and the outlet hole communicate with each other through the communication hole 310*h* of the disc-shaped member 310 (the state shown in the left side half of FIG. 4 or FIG. 5), the water in the back pressure chamber flows out through the back-pressure-chamber outlet hole and the outlet hole, so that the water pressure in the storage chamber 5 becomes greater than the water pressure in the back pressure chamber. Thus, the one diaphragm valve is opened in spite of the biasing force of the corresponding coil spring (not shown in FIGS. 4 and 5).

According to the above structure, since the one diaphragm valve (main valve body) is opened and closed by switching the opened/closed state of the one pilot hole by means of the disc-shaped member 310 (pilot valve), a remarkable and stable reduction of an operation force for the switching operation is achieved for a long time without using grease.

Structure of Fourth Embodiment

Hereinafter, a shower head according to a fourth embodiment of the present invention will be described with reference to FIGS. 19 to 30. The shower head 401 of the fourth embodiment is a shower head for which a plurality of spout modes can be switched by means of a first push button 411 and a spout mode and a water-stop mode can be switched by means of a second push button 511.

Figure 19:
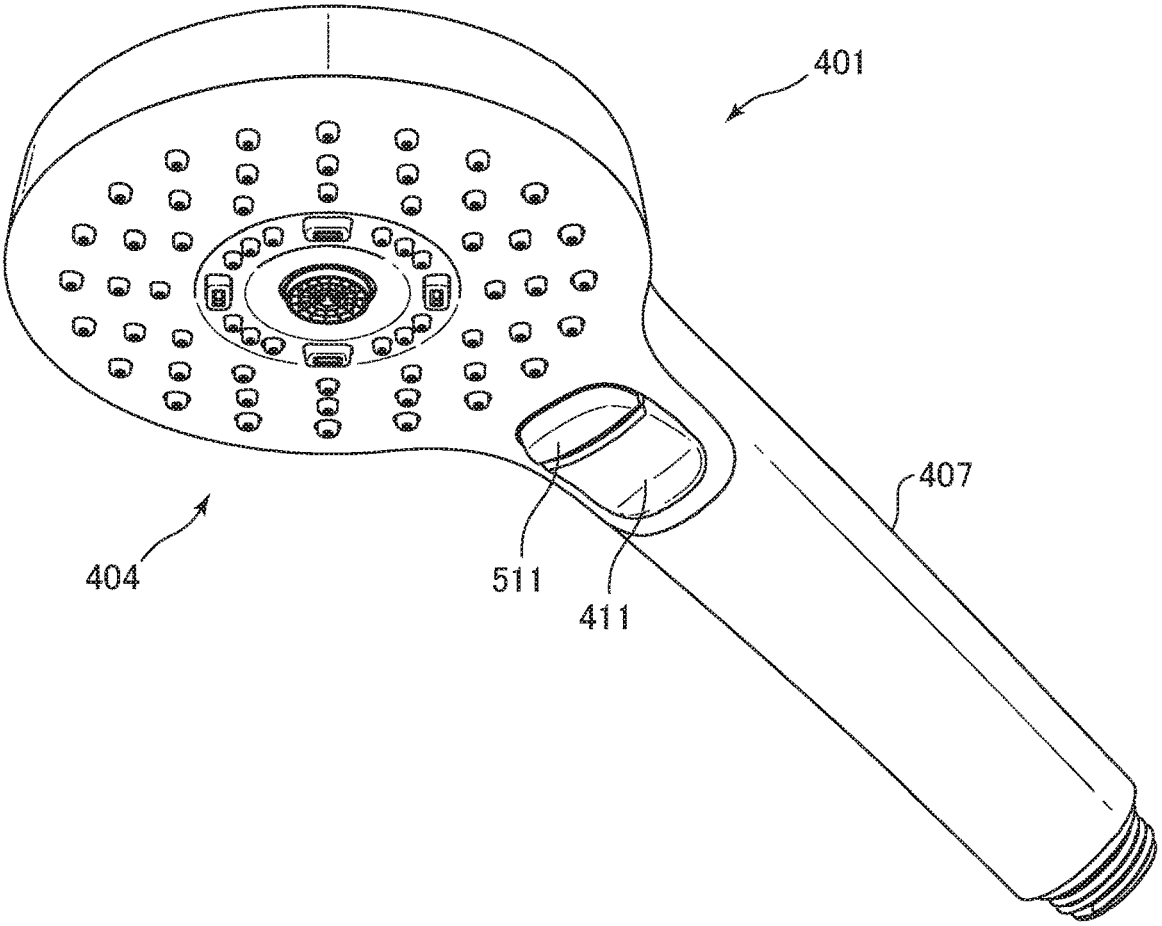
FIG. 19 is a perspective view of a shower head according to a fourth embodiment of the present invention.
Figure 20:
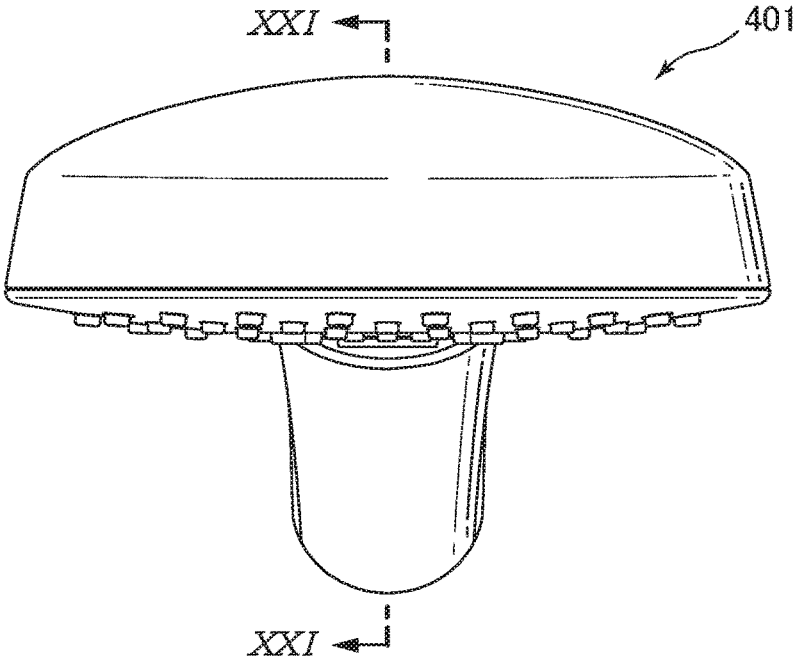
FIG. 20 is a front view of the shower head shown in FIG. 19.
Figure 21:
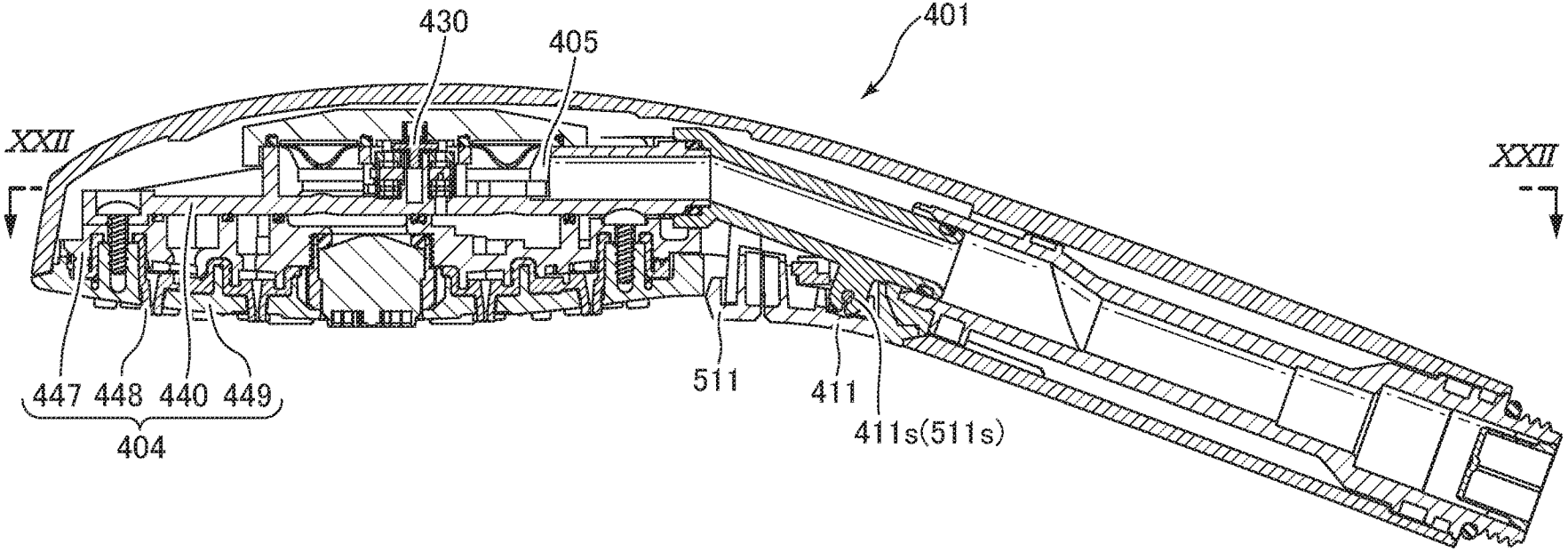
FIG. 21 is a longitudinal section view taken along line XXI-XXI of the shower head shown in FIG. 20.
Figure 22:
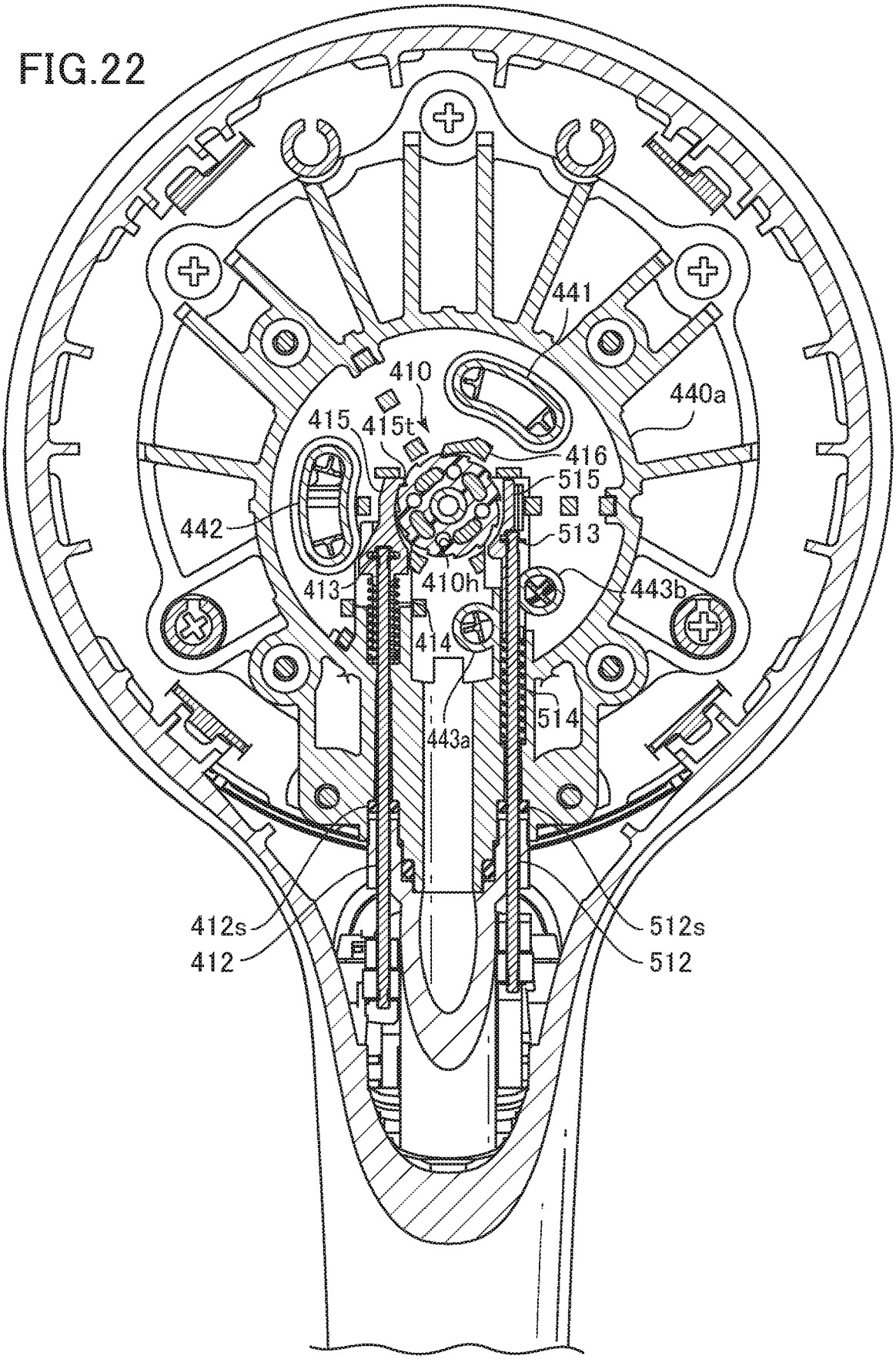
FIG. 22 is a transversal section view taken along line XXII-XXII of the shower head shown in FIG. 21.
Figure 23:
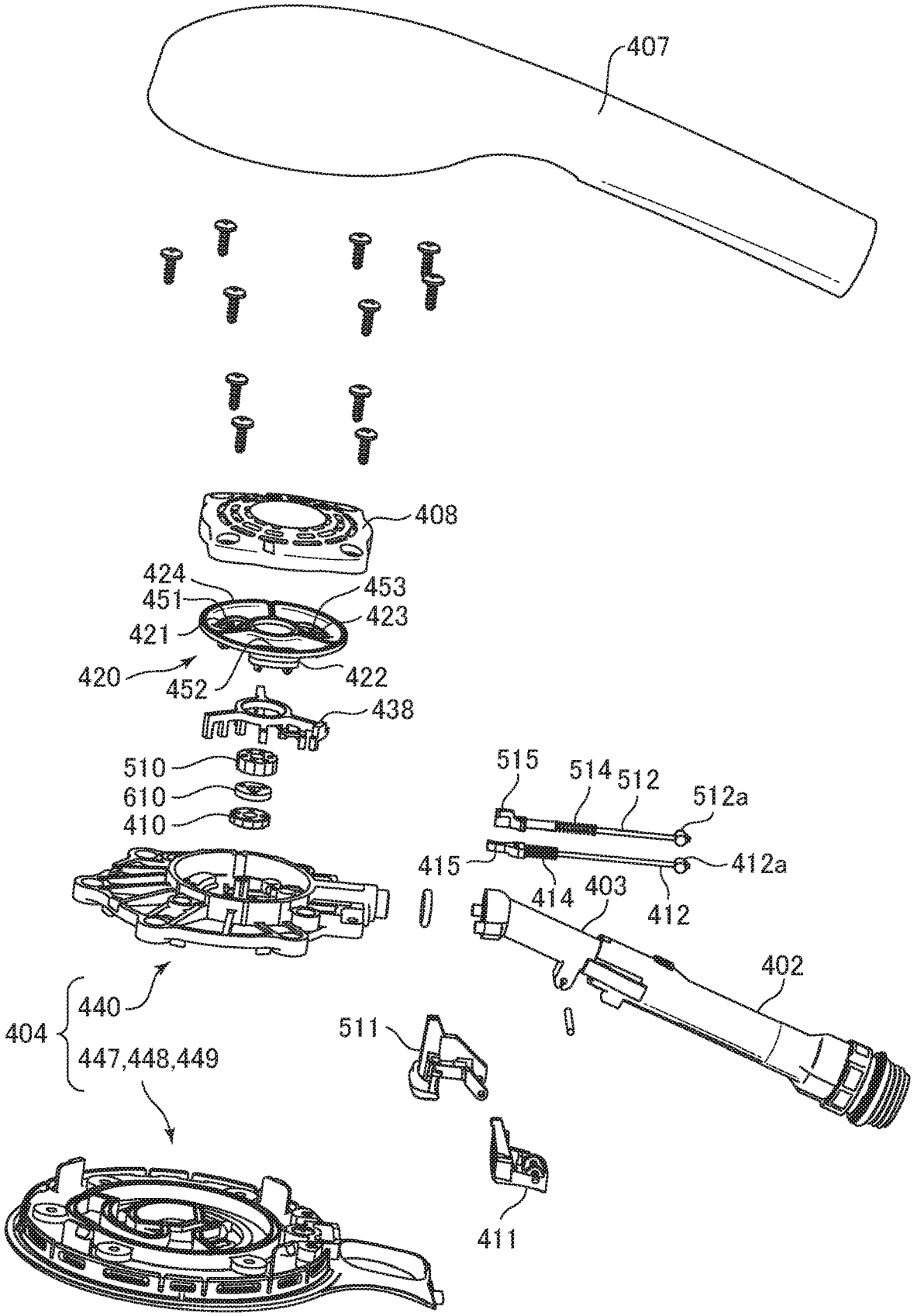
FIG. 23 is an exploded perspective view of the shower head shown in FIG. 19.

FIG. 19 is a perspective view of the shower head 401 according to the fourth embodiment of the present invention, FIG. 20 is a front view of the shower head 401 shown in FIG. 19, FIG. 21 is a longitudinal section view taken along line XXI-XXI of the shower head 401 shown in FIG. 20, FIG. 22 is a transversal section view taken along line XXII-XXII of the shower head 401 shown in FIG. 21, and FIG. 23 is an exploded perspective view of the shower head 401 shown in FIG. 19.

As shown in FIGS. 19 to 23, the shower head 401 of the fourth embodiment also includes a storage chamber 405 (which is also called cavity) configured to store water supplied from a water supply source (not shown) through water supply members 402, 403.

Similarly to the shower head 1 of the first embodiment, a secondary-side flow-path member 404 is provided on a spout-surface side of the shower head 401 with respect to the storage chamber 405. The secondary-side flow-path member 404 consists of four stacked substantially discoid element parts 440, 447, 448, 449. The secondary-side flow-path member 404 has three flow paths (an example of a plurality of flow paths), each of which corresponds to each of three spout modes (an example of the plurality of spout modes).

Four valve seats 441, 442, 443*a*, 443*b* protruded on a side of the storage chamber 405 are formed on the element part 440 facing to the storage chamber 405. A communication hole that communicates with a corresponding flow path among the three flow paths is provided at a center of each of the valve seats 441, 442, 443*a*, 443*b* (see FIG. 24, too). Among the four valve seats, two valve seats 441, 442, each of which has a bean shape as seen in plan view, are arranged at two of three regions which are annularly arranged at even intervals in a circumferential direction, i.e., every 120 degrees. The other two valve seats 443*a*, 443*b*, each of which has a circular shape as seen in plan view, are arranged at the rest one of the three regions (in order to secure a trajectory of a second shaft part 512, which will be described below).

Three diaphragm valves 421 to 423, which correspond to the above three regions, respectively, are annularly arranged (see FIG. 23, too). The three diaphragm valves 421 to 423 are integrally formed as one diaphragm member 420. However, the respective diaphragm valves 421 to 423 are movable independently of each other.

A seal ring portion 424 is formed at a periphery of the diaphragm member 420. The seal ring portion 424 is sandwiched between an upper edge portion 440*a* of the element part 440 and a cover member 408 in a watertight manner. A central area of the diaphragm member 420 is supported on an upper surface of the element part 440 via a spacing member 438.

Coil springs 451 to 453 (an example of an elastic member) are provided between the respective diaphragm valves 421 to 423 and a lower surface of the cover member 408, so that each of the diaphragm valves 421 to 423 is biased in a valve-closing direction by means of the corresponding coil spring 451 to 453.

The three diaphragm valves 421 to 423 of the present embodiment are annularly arranged, and a pilot hole (a part of which is a back-pressure-chamber outlet hole 421*c* to 423*c* formed on a lower-surface side of the cover member 408) for communicating a back pressure chamber 421*b* to 423*b* of each of the three diaphragm valves 421 to 423 with a space below the element part 440, which is a space outside the storage chamber 405, is collectively located at a central region of the three diaphragm valves 421 to 423, so that the pilot hole is opened and closed by a first disc-shaped member 410 and a second dsic-shaped member 510, which serve as common pilot valves. (When the number of the plurality of diaphragm valves is two, a pilot hole for communicating a back pressure chamber of each of the two diaphragm valves with the space below the element part 440 may be collectively located at a middle region of the two diaphragm valves.)

The first disc-shaped member 410 is made of resin. The first disc-shaped member 410 is supported in a rotatable manner around an axis thereof, and has twelve teeth 410*t* on an outer circumference thereof (see FIGS. 25 to 27, too).

The second disc-shaped member 510 is also made of resin. The second disc-shaped member 510 is also supported in a rotatable manner around an axis thereof, and has twelve teeth 510*t* on an outer circumference thereof (see FIGS. 28 to 30, too).

In the fourth embodiment, a disc-shaped valve-seat member 610 is provided between the first disc-shaped member 410 and the second disc-shaped member 510 in a non-rotatable manner with respect to the element part 440 (or the cover member 408). The disc-shaped valve-seat member 610 is movable in an axial direction thereof in order to transfer a biasing force of a coil spring 435 (which will be described below) to the first disc-shaped member 410. Thereby, the first disc-shaped member 410 and the second disc-shaped member 510 are rotatable with respect to the valve-seat member 610 independently of each other.

Figure 24:
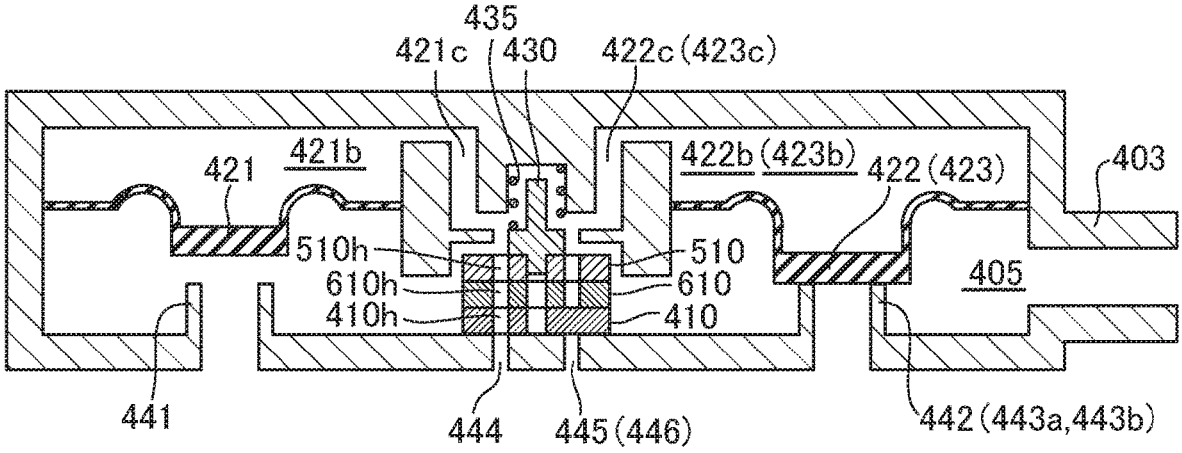
FIG. 24 is a schematic view for explaining an opened/closed state of a pilot hole.

FIG. 24 is a schematic view for explaining an opened/closed state of a pilot hole. The first disc-shaped member 410 has four communication holes 410*h* (an example of the plurality of communication holes) similarly to the disc-shaped member 10 of the first embodiment. As shown in FIG. 24 schematically, each of the four communication holes 410*h* is configured to open a corresponding pilot hole of a corresponding diaphragm valve 421 to 423 when selectively communicating with a corresponding back-pressure-chamber outlet hole 421*c* to 423*c* provided on a corresponding back pressure chamber 421*b* to 423*b* of the corresponding diaphragm valve 421 to 423, in response to a rotational position of the first disc-shaped member 410. More specifically, when each of the four communication holes 410*h* (and each of communication holes 510*h* which will be described below) selectively communicates with the corresponding back-pressure-chamber outlet hole 421*c* to 423*c* and a corresponding outlet hole 444 to 446 in the element part 440 provided correspondingly to the corresponding back-pressure-chamber outlet hole 421*c* to 423*c*, the corresponding pilot hole of the corresponding diaphragm valve 421 to 423 is opened. The four communication holes 410*h* are annularly arranged at even intervals in a circumferential direction, i.e., every 90 degrees. The back-pressure-chamber outlet holes 421*c* to 423*c* and the outlet holes 444 to 446 are also annularly arranged at even intervals in a circumferential direction, i.e., every 120 degrees.

The second disc-shaped member 510 has six communication holes 510*h* similarly to the disc-shaped member 310 of the third embodiment. As shown in FIG. 24 schematically, each of the six communication holes 510*h* is also configured to open a corresponding pilot hole of a corresponding diaphragm valve 421 to 423 when selectively communicating with a corresponding back-pressure-chamber outlet hole 421*c* to 423*c* provided on a corresponding back pressure chamber 421*b* to 423*b* of the corresponding diaphragm valve 421 to 423, in response to a rotational position of the second disc-shaped member 510. More specifically, when each of the six communication holes 510*h* (and each of the four communication holes 410*h* as described above) selectively communicates with the corresponding back-pressure-chamber outlet hole 421*c* to 423*c* and a corresponding outlet hole 444 to 446 in the element part 440 provided correspondingly to the corresponding back-pressure-chamber outlet hole 421*c* to 423*c*, the corresponding pilot hole of the corresponding diaphragm valve 421 to 423 is opened. The six communication holes 510*h* are annularly arranged at even intervals in a circumferential direction, i.e., every 60 degrees.

As shown in FIG. 24 schematically, the disc-shaped valve-seat member 610 has three communication holes 610*h* correspondingly to the outlet holes 444 to 446. That is to say, the communication holes 610*h* are annularly arranged at even intervals in a circumferential direction, i.e., every 120 degrees.

Furthermore, with reference to FIG. 24, a disc-pushing member 430 is explained. As shown in FIG. 24 schematically, the disc-pushing member 430 is interposed between a lower surface of the cover member 408 and an upper surface of the second disc-shaped member 510. The disc-pushing member 430 is configured to push the second disc-shaped member 510 away from the back-pressure-chamber outlet holes 421*c* to 423*c* (toward the element part 440) by means of a coil spring 435 as an example of a biasing part.

Each of the back-pressure-chamber outlet holes 421*c* to 423*c* for the diaphragm valves 421 to 423 extends through a region around the disc-pushing member 430 to communicate with a corresponding communication hole 510*h* of the second disc-shaped member 510. The region around the disc-pushing member 430 also communicates with the storage chamber 405 through a gap formed by a spacing member 438 or the like, and the gap is configured to function as a corresponding back-pressure-chamber inlet hole. (However, at least at the time of filing the present application, the scope of the present invention does not exclude a manner wherein each of back-pressure-chamber inlet holes is provided through a portion of the corresponding diaphragm valve 421 to 423 (see FIG. 4).)

With reference to FIG. 19 again, the first push button 411 is provided on a lower portion of a shower head housing 407 as an operation part configured to receive an operation force from a user. (Any other type of button or slide switch may be provided in place of the first push button 411.)

With reference to FIGS. 21 to 23, every time the first push button 411 receives an operation force (a pushing force) from a user (every time the user gives an operation force (a pushing force) to the first push button 411), the first push button 411 pivots around a pivot shaft 411*s*. Then, in coordination with the pivot movement, by means of abutment and slide between an abutment slide inclined portion of the first push button 411 (whose configuration is substantially the same as the abutment slide inclined portion 11*a* shown in FIG. 2) and an abutment slide ring part 412*a* provided at a proximal end portion of a shaft part 412, the shaft part 412 is configured to reciprocate in an axial direction thereof.

Figure 25:
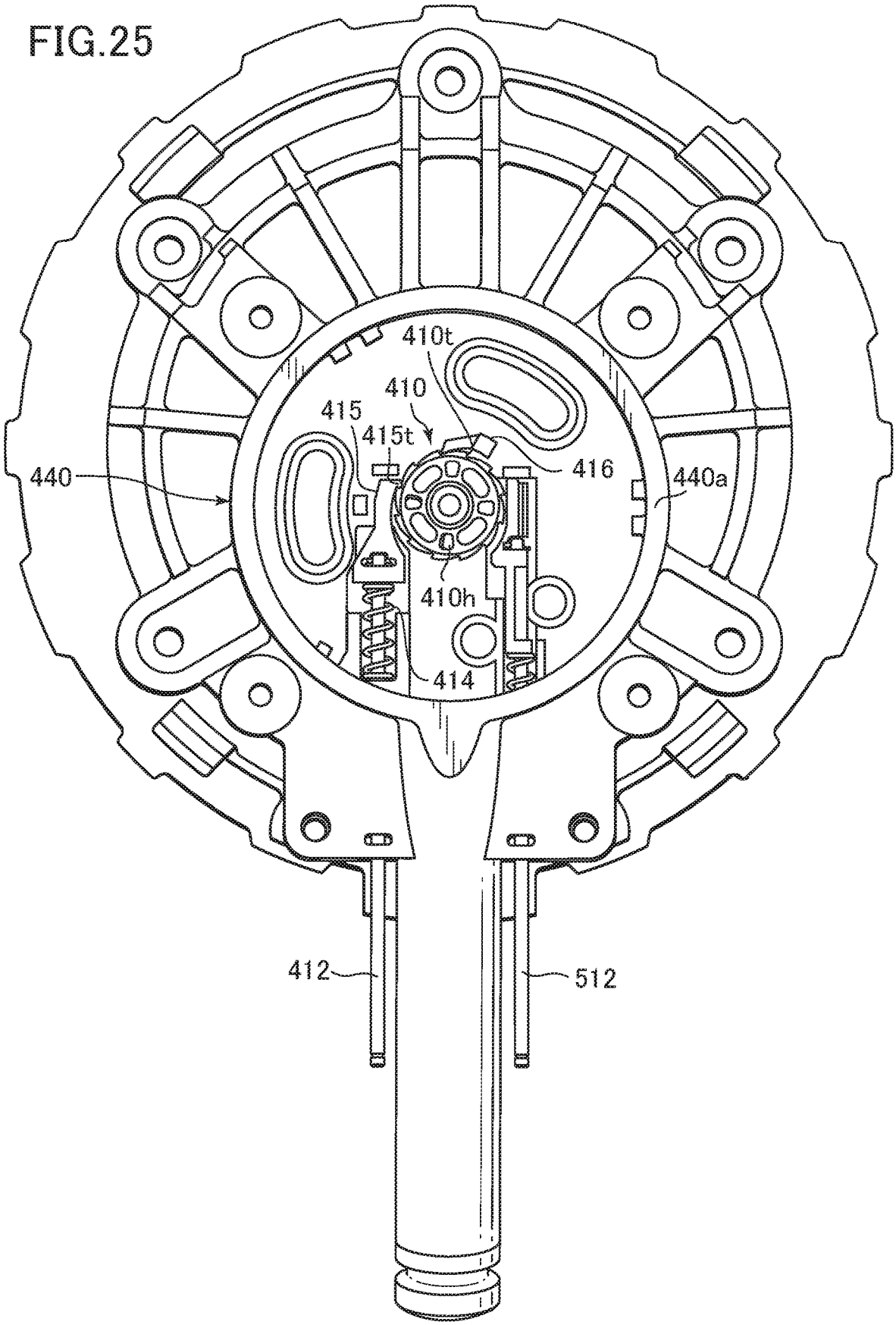
FIG. 25 is a schematic view for explaining a state wherein a first disc-shaped member has started to be rotated.
Figure 26:
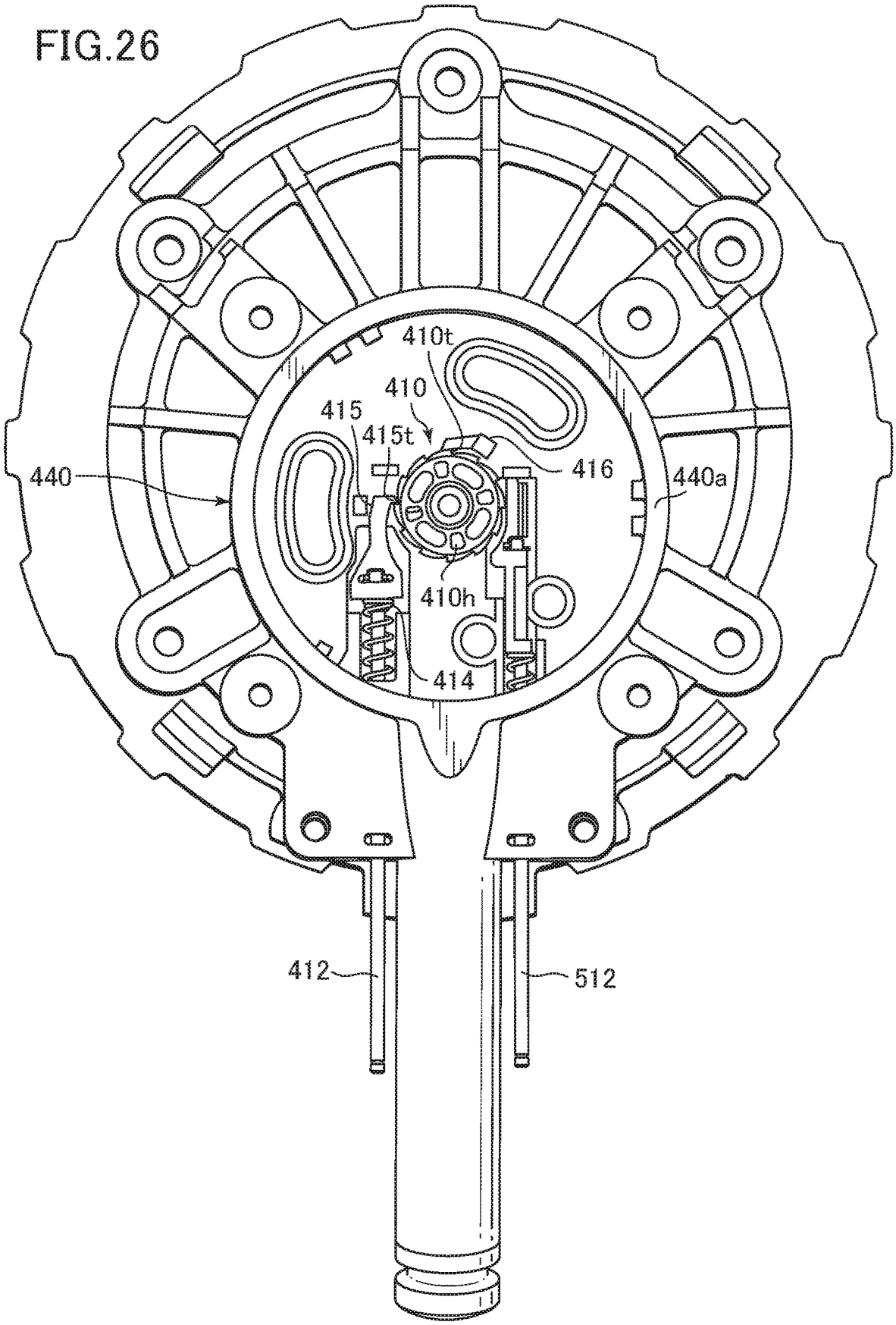
FIG. 26 is a schematic view for explaining a state wherein the first disc-shaped member is being rotated.
Figure 27:
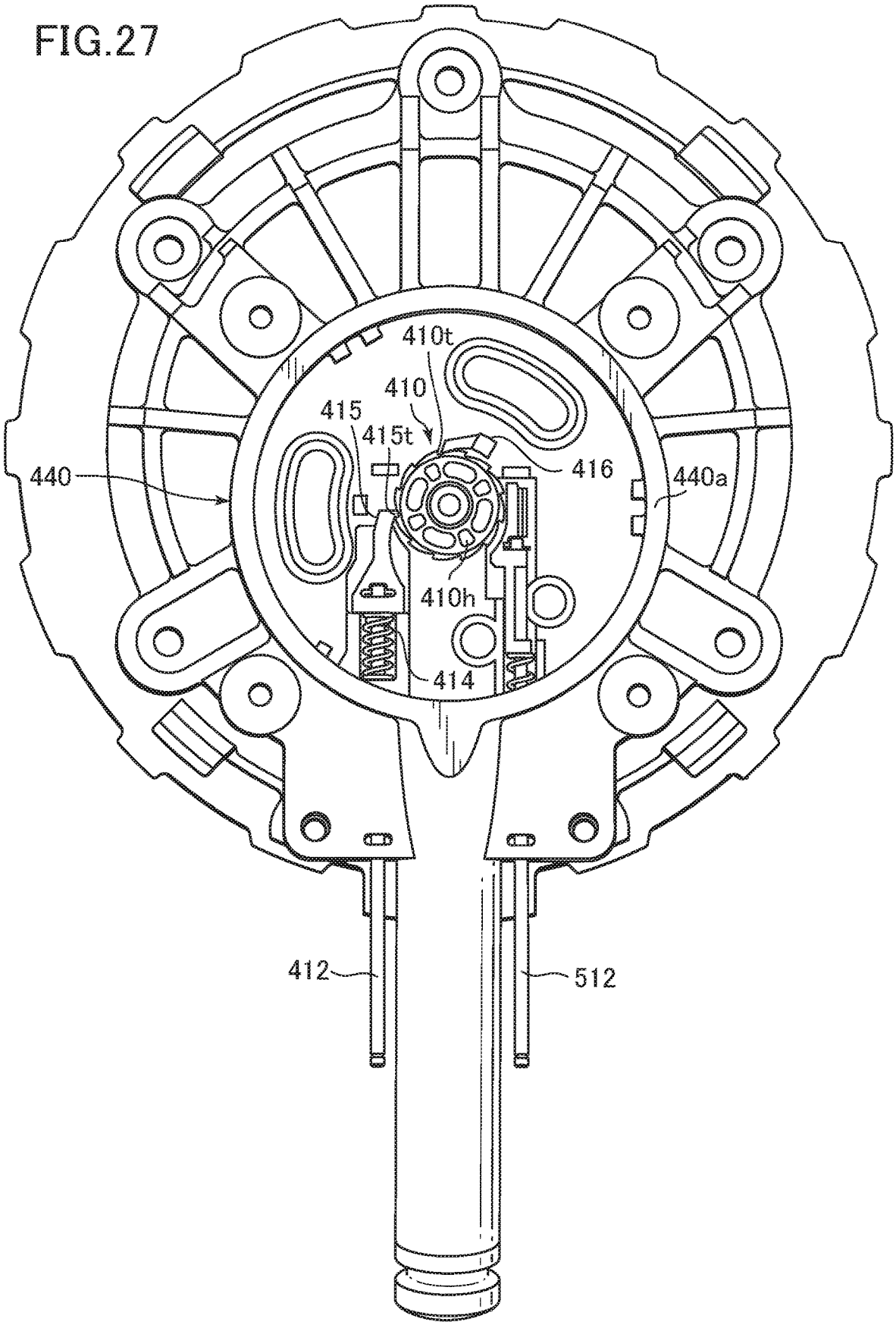
FIG. 27 is a schematic view for explaining a state wherein the first disc-shaped member has finished to be rotated.

A distal end portion of the shaft part 412 is exposed to the water in the storage chamber 405 (see FIGS. 25 to 27, too). Thus, the shaft part 412 is made of a metal bar which is difficult to rust, such as a stainless-steel bar. In the present embodiment, the shaft part 412 slidably pierces through the element part 440 integrally fixed to the shower head housing 407. A seal ring part 412*s* is provided for maintaining watertight performance. The shaft part 412 may be made of not only a rigid material but also a plastic material such as string or an elastic material such as rubber.

FIG. 25 is a schematic view for explaining a state wherein the first disc-shaped member 410 has started to be rotated, FIG. 26 is a schematic view for explaining a state wherein the first disc-shaped member 410 is being rotated, and FIG. 27 is a schematic view for explaining a state wherein the first disc-shaped member 410 has finished to be rotated.

As shown in FIGS. 25 to 27, a coil spring 414 is arranged around a distal end portion of the shaft part 412 located in the storage chamber 405. A proximal end of the coil spring 414 is fixed to the element part 440, and thus fixed to the shower head housing 407 (to the pivot shaft 411*s* of the first push button 411).

A claw member 415 is fixed to a distal end of the coil spring 414. A stopper 413 for the claw member 415 is attached to the distal end portion of the shaft part 412. The distal end of the coil spring 414 and the claw member 415 are movable in an axial direction by deformation of the coil spring 414 in the axial direction in a region on the side of the proximal end portion of the shaft part 412 with respect to the stopper 413.

Furthermore, the distal end of the coil spring 414 and the claw member 415 are also movable in an inclined direction, which is inclined with respect to the axial direction of the coil spring 414, by deformation of the coil spring 414 in the inclined direction.

A claw 415*t* is provided on a lateral surface of the claw member 415 on the side of the first disc-shaped member 410. The claw 415*t* is configured to engage with the teeth 410*t* of the first disc-shaped member 410. The first disc-shaped member 410 is rotated when the claw 415*t* draws one of the teeth 410*t* while the shaft part 412 reciprocates (from the state shown in FIG. 25, through the stage shown in FIG. 26, to the state sown in FIG. 27).

In addition, a stopper claw 416 configured to prevent the first disc-shaped member 410 (teeth 410*t*) from reversely rotating is held by the element part 440 (or the cover member 408).

Furthermore, in the fourth embodiment, as shown in FIG. 19, the second push button 511 is also provided on a lower portion of the shower head housing 407 as an operation part configured to receive an operation force from a user. (Any other type of button or slide switch may be provided in place of the second push button 511.)

With reference to FIGS. 21 to 23 again, every time the second push button 511 receives an operation force (a pushing force) from a user (every time the user gives an operation force (a pushing force) to the second push button 511), the second push button 511 pivots around a pivot shaft 511*s* (which also serves as the pivot shaft 411*s* in the present embodiment). Then, in coordination with the pivot movement, by means of abutment and slide between an abutment slide inclined portion of the second push button 511 (whose configuration is substantially the same as the abutment slide inclined portion 11*a* shown in FIG. 2) and an abutment slide ring part 512*a* provided at a proximal end portion of a shaft part 512, the shaft part 512 is configured to reciprocate in an axial direction thereof.

In the fourth embodiment, the two shaft parts 412, 512 are arranged in substantially parallel to each other, at substantially the same height with respect to the upper surface of the element part 440 (see FIG. 22).

Figure 28:
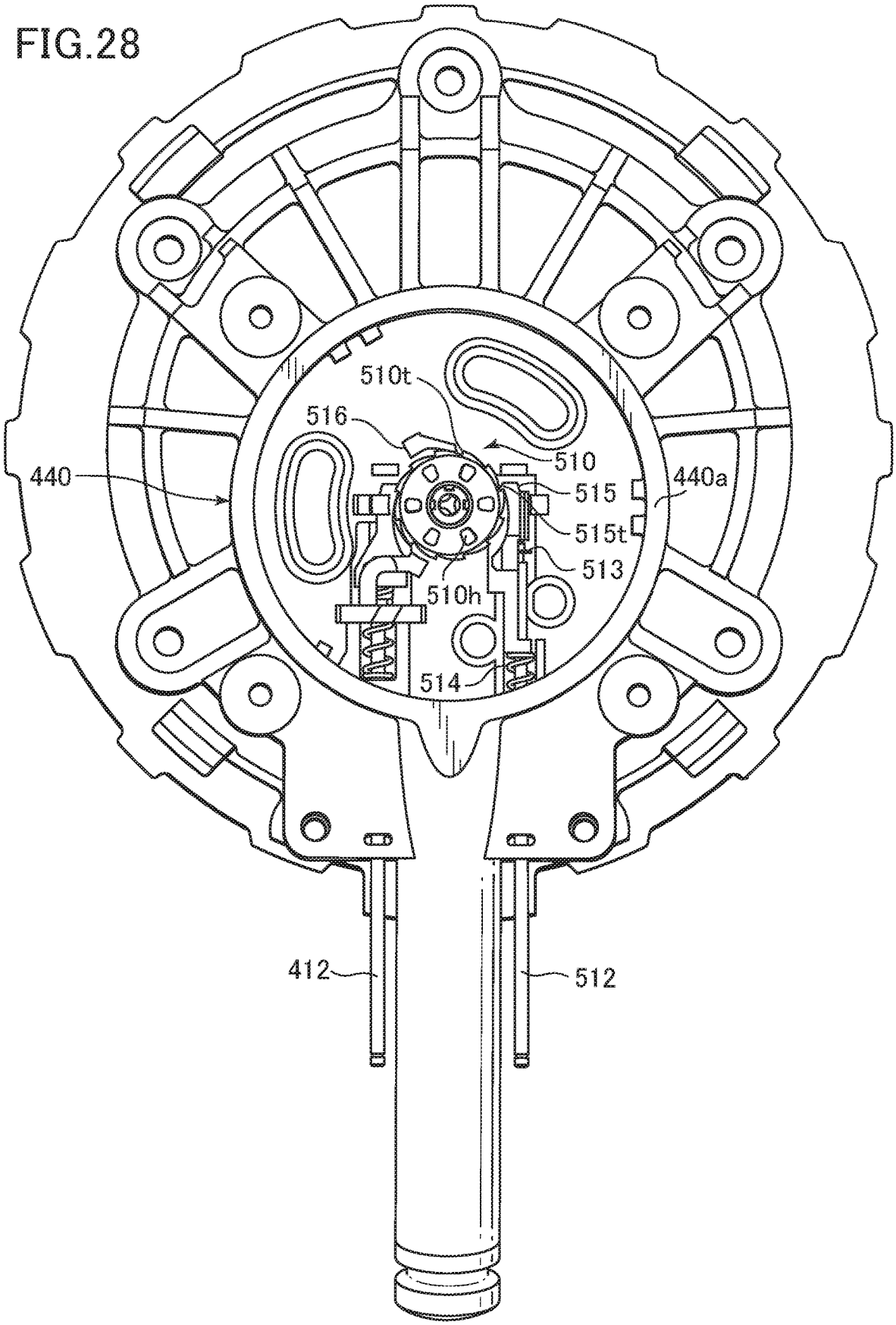
FIG. 28 is a schematic view for explaining a state wherein a second disc-shaped member has started to be rotated.
Figure 29:
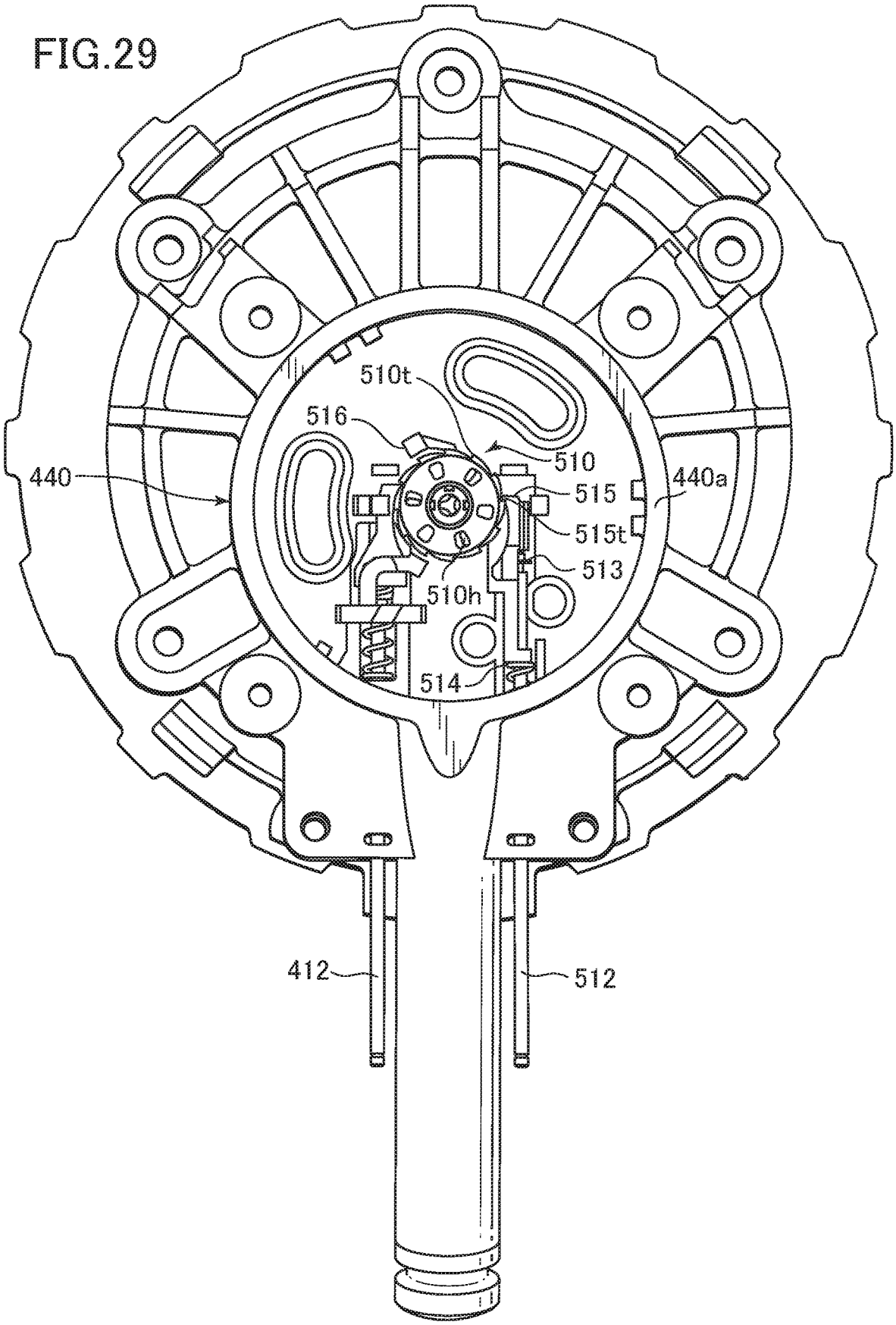
FIG. 29 is a schematic view for explaining a state wherein the second disc-shaped member is being rotated.
Figure 30:
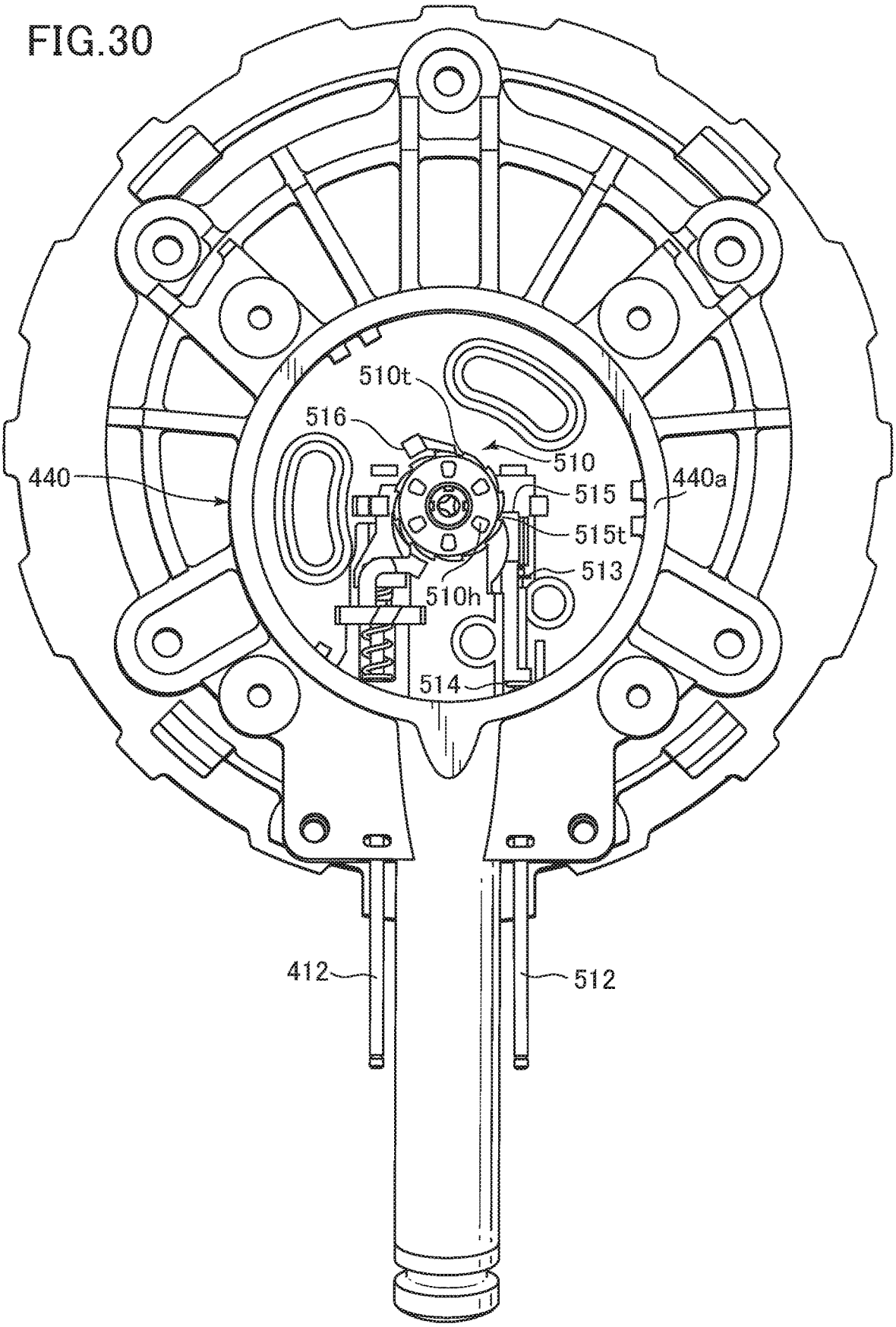
FIG. 30 is a schematic view for explaining a state wherein the second disc-shaped member has finished to be rotated.

A distal end portion of the shaft part 512 is also exposed to the water in the storage chamber 405 (see FIGS. 28 to 30, too). Thus, the shaft part 512 is made of a metal bar which is difficult to rust, such as a stainless-steel bar. In the present embodiment, the shaft part 512 also slidably pierces through the element part 440 integrally fixed to the shower head housing 407. A seal ring part 512*s* is provided for maintaining watertight performance. The shaft part 512 also may be made of not only a rigid material but also a plastic material such as string or an elastic material such as rubber.

FIG. 28 is a schematic view for explaining a state wherein the second disc-shaped member 510 has started to be rotated, FIG. 29 is a schematic view for explaining a state wherein the second disc-shaped member 510 is being rotated, and FIG. 30 is a schematic view for explaining a state wherein the second disc-shaped member 510 has finished to be rotated.

As shown in FIGS. 28 to 30, a coil spring 514 is arranged around a distal end portion of the shaft part 512 located in the storage chamber 405. A proximal end of the coil spring 514 is fixed to the element part 440, and thus fixed to the shower head housing 407 (to the pivot shaft 511*s* of the second push button 511).

A claw member 515 is fixed to a distal end of the coil spring 514. A stopper 513 for the claw member 515 is attached to the distal end portion of the shaft part 512. The distal end of the coil spring 514 and the claw member 515 are movable in an axial direction by deformation of the coil spring 514 in the axial direction in a region on the side of the proximal end portion of the shaft part 512 with respect to the stopper 513.

Furthermore, the distal end of the coil spring 514 and the claw member 515 are also movable in an inclined direction, which is inclined with respect to the axial direction of the coil spring 514, by deformation of the coil spring 514 in the inclined direction.

A distal end region of the claw member 515 extends out upward to compensate for the offset in height between the first disc-shaped member 410 and the second disc-shaped member 510. A claw 515*t* is provided on a lateral surface of the extended-out region of the claw member 515 on the side of the second disc-shaped member 510. The claw 515*t* is configured to engage with the teeth 510*t* of the second disc-shaped member 510. The second disc-shaped member 510 is rotated when the claw 515*t* draws one of the teeth 510*t* while the shaft part 512 reciprocates (from the state shown in FIG. 28, through the stage shown in FIG. 29, to the state sown in FIG. 30).

In addition, a stopper claw 516 configured to prevent the second disc-shaped member 510 (teeth 510*t*) from reversely rotating is held by the element part 440 (or the cover member 408).

Operation of Fourth Embodiment

Next, an operation of the shower head 401 according to the fourth embodiment is explained.

With reference to FIG. 19, when a user pushes the first push button 411, the pushing force (operating force) causes the abutment slide inclined portion of the first push button 411 to pivot around the pivot shaft 411*s*, so that the shaft part 412 moves in a direction toward the proximal end portion thereof (the lower side in FIG. 22) via the abutment slide ring part 412*a*.

The state shown in FIG. 25 corresponds to a state before the user pushes the first push button 411. From this state, the shaft part 412 starts to move. When the claw 415*t* of the claw member 415 draws one of the teeth 410*t* of the first disc-shaped member 410, the first disc-shaped member 410 is rotated, as shown in FIG. 26. The state shown in FIG. 27 corresponds to a state wherein the first push button 411 has been pushed to a deepest position thereof and thus the shaft part 412 has moved to a most proximal-end-side position thereof (the lowest position in FIG. 22). In the state shown in FIG. 27, the stopper claw 416 stops a tooth 410*t* next to that in FIG. 25. Accordingly, the first disc-shaped member 410 is rotated by 30 degrees every time the user pushes the first push button 411.

In the state shown in FIG. 27, the coil spring 414 is compressed between the claw member 415 (and the stopper 413 at the distal end portion of the shaft part 412) and the element part 440. From this state, when the pushing force against the first push button 411 is released, the shaft part 412 and the first push button 411 are returned back to their original positions (the state shown in FIG. 25) by a resilience force of the coil spring 414. During this step, the claw 415*t* does not engage with any tooth 410*t*, and the first disc-shaped member 410 is not reversely rotated in combination with the existence of the claw stopper 416. In addition, during the above step, the claw member 415 is movable in the inclined direction, which is inclined with respect to the axial direction of the coil spring 414, by the deformation of the coil spring 414 in the inclined direction. Thus, it is possible to effectively avoid resistance (interference) from the first disc-shaped member 410. In addition, when the claw member 415 is returned back to an original position thereof (the state shown in FIG. 25), the claw member 415 (claw 415*t*) engages with the tooth 410*t* next to the previously drawn one, by the resilience force of the coil spring 414.

As described above, the four communication holes 410*h* are annularly arranged at even intervals in a circumferential direction, i.e., every 90 degrees, and the back-pressure-chamber outlet holes 421*c* to 423*c* and the outlet holes 444 to 446 are annularly arranged at even intervals in a circumferential direction, i.e., every 120 degrees. Thus, under a condition wherein the communication holes 510*h* of the second disc-shaped member 510 are positioned correspondingly to the outlet holes 444 to 446 (and the communication holes 610*h* of the disc-shaped valve-seat member 610), when the first disc-shaped member 410 is rotated by 30 degrees, it is possible to sequentially switch the following three spout modes:

(i) a first spout mode wherein the back-pressure-chamber outlet holes 421*c* and the outlet hole 444 communicate with each other while the back-pressure-chamber outlet holes 422*c*, 423*c* and the outlet holes 445, 446 do not communicate with each other;

(ii) a second spout mode wherein the back-pressure-chamber outlet holes 422*c* and the outlet hole 445 communicate with each other while the back-pressure-chamber outlet holes 421*c*, 423*c* and the outlet holes 444, 446 do not communicate with each other; and (iii) a third spout mode wherein the back-pressure-chamber outlet holes 423*c* and the outlet hole 446 communicate with each other while the back-pressure-chamber outlet holes 421*c*, 422*c* and the outlet holes 444, 445 do not communicate with each other.

The state shown in the right side half of FIG. 24 is an example of a state wherein a back-pressure-chamber outlet hole and the corresponding outlet hole do not communicate with each other, i.e., the corresponding pilot hole of the corresponding diaphragm valve is not opened. In the state shown in the right side half of FIG. 24, the back-pressure-chamber outlet holes 422*c*, 423*c* and the corresponding outlet holes 445, 446 are blocked by the first disc-shaped member 410. On the other hand, through the corresponding back-pressure-chamber inlet holes, the water pressure in the storage chamber 405 and the water pressures in the back pressure chambers 423*b*, 423*c* are made equal to each other. Thus, each of the diaphragm valves 422, 423 is closed by a biasing force of the corresponding coil spring 452, 453 (not shown in FIG. 24).

The state shown in the left side half of FIG. 24 is an example of a state wherein a back-pressure-chamber outlet hole and the corresponding outlet hole communicate with each other, i.e., the corresponding pilot hole of the corresponding diaphragm valve is opened. In the state shown in the left side half of FIG. 24, the back-pressure-chamber outlet hole 421*c* and the corresponding outlet hole 444 communicate with each other through the communication hole 410*h* of the first disc-shaped member 410. In this state, the water in the back pressure chamber 421*b* flows out through the back-pressure-chamber outlet hole 421*c* and the corresponding outlet hole 444, so that the water pressure in the storage chamber 405 becomes greater than the water pressure in the back pressure chamber 421*b*. Thus, the diaphragm valve 421 is opened in spite of the biasing force of the corresponding coil spring 451 (not shown in FIG. 24).

Next, in the shower head 401 of the fourth embodiment, not only the plurality of spout modes can be switched by means of the first push button 411 but also a spout mode and a water-stop mode can be switched by means of the second push button 511.

With reference to FIG. 19 again, when a user pushes the second push button 511, the pushing force (operating force) causes the abutment slide inclined portion of the second push button 511 to pivot around the pivot shaft 511*s*, so that the shaft part 512 moves in a direction toward the proximal end portion thereof (the lower side in FIG. 22) via the abutment slide ring part 512*a*.

The state shown in FIG. 28 corresponds to a state before the user pushes the second push button 511. From this state, the shaft part 512 starts to move. When the claw 515*t* of the claw member 515 draws one of the teeth 510*t* of the second disc-shaped member 510, the second disc-shaped member 510 is rotated, as shown in FIG. 29. The state shown in FIG. 30 corresponds to a state wherein the second push button 511 has been pushed to a deepest position thereof and thus the shaft part 512 has moved to a most proximal-end-side position thereof (the lowest position in FIG. 22). In the state shown in FIG. 30, the stopper claw 516 stops a tooth 510*t* next to that in FIG. 28. Accordingly, the second disc-shaped member 510 is rotated by 30 degrees every time the user pushes the second push button 511.

In the state shown in FIG. 30, the coil spring 514 is compressed between the claw member 515 (and the stopper 513 at the distal end portion of the shaft part 512) and the element part 440. From this state, when the pushing force against the second push button 511 is released, the shaft part 512 and the second push button 511 are returned back to their original positions (the state shown in FIG. 28) by a resilience force of the coil spring 514. During this step, the claw 515*t* does not engage with any tooth 510*t*, and the second disc-shaped member 510 is not reversely rotated in combination with the existence of the claw stopper 516. In addition, during the above step, the claw member 515 is movable in the inclined direction, which is inclined with respect to the axial direction of the coil spring 514, by the deformation of the coil spring 514 in the inclined direction. Thus, it is possible to effectively avoid resistance (interference) from the second disc-shaped member 510. In addition, when the claw member 515 is returned back to an original position thereof (the state shown in FIG. 28), the claw member 515 (claw 515*t*) engages with the tooth 510*t* next to the previously drawn one, by the resilience force of the coil spring 514.

As described above, the six communication holes 510*h* are annularly arranged at even intervals in a circumferential direction, i.e., every 60 degrees, and the back-pressure-chamber outlet holes 421*c* to 423*c* and the outlet holes 444 to 446 are annularly arranged at even intervals in a circumferential direction, i.e., every 120 degrees. Thus, when the second disc-shaped member 510 is rotated by 30 degrees, it is possible to sequentially switch the spout mode, in which the back-pressure-chamber outlet holes and the outlet holes communicate with each other through the communication holes 510*h* of the second disc-shaped member 510, and the water-stop mode, in which the back-pressure-chamber outlet holes and the outlet holes do not communicate with each other (the back-pressure-chamber outlet holes and the outlet holes are blocked by the second disc-shaped member 510).

Effects of Fourth Embodiment

As described above, according to the shower head 401 of the fourth embodiment, since the communicated/blocked state between each of the three flow paths and the storage chamber 405 is controlled by each of the three diaphragm valves 421 to 423, a remarkable and stable reduction of an operation force for the switching operation is achieved for a long time without using grease.

In particular, according to the shower head 401 of the fourth embodiment, the switching operation between the plurality of spout modes by means of the first push button 411 and the switching operation between the spout mode and the water-stop mode by means of the second push button 511 are independent of each other, which contributes to good operability, In addition, according to the shower head 401 of the fourth embodiment, the pilot hole for communicating the back pressure chamber 421*b* to 423*b* of each of the annularly-arranged three diaphragm valves 421 to 423 with the space outside the storage chamber 405 is collectively located at the central region of the three diaphragm valves 421 to 423 so that the pilot hole is opened and closed by the common first and second disc-shaped members 410, 510 (pilot valves). Thus, the shower head 401 is made to be compact. In addition, a moving range (moving distance) of the first disc-shaped member 410 (pilot valve) and a moving range (moving distance) of the second disc-shaped member 510 (pilot valve) are sufficiently small, which contributes to a further reduction of the operating force.

In addition, according to the shower head 401 of the fourth embodiment, the first disc-shaped member 410 is supported in a rotatable manner around the axis thereof and has the teeth 410*t* on the outer circumference thereof. Thus, it is possible to easily drive the first disc-shaped member 410 in rotation by using the teeth 410*t*.

In addition, according to the shower head 401 of the fourth embodiment, the first disc-shaped member 410 is made of resin. Thus, it is possible to easily achieve high smoothness, which can inhibit sliding resistance (sliding friction). In addition, it is unnecessary to separately provide a seal part.

In addition, according to the shower head 401 of the fourth embodiment, the first disc-shaped member 410 has the four communication holes 410*h*, and each of the four communication holes 410*h* is configured to open the corresponding pilot hole of the corresponding diaphragm valve 421 to 423 when selectively communicating with the corresponding back-pressure-chamber outlet hole 421*c* to 423*c* provided on the corresponding back pressure chamber 421*b* to 423*b* of the corresponding diaphragm valve 421 to 423, in response to a rotational position of the first disc-shaped member 410. Thus, the shower head 401 is made to be more compact. In addition, a rotation angle (moving distance) of the first disc-shaped member 410 (pilot valve) is sufficiently small (no more than 30 degrees), which contributes to a further reduction of the operating force.

Substantially similarly, according to the shower head 401 of the fourth embodiment, the second disc-shaped member 510 is also supported in a rotatable manner around the axis thereof and has the teeth 510*t* on the outer circumference thereof. Thus, it is also possible to easily drive the second disc-shaped member 510 in rotation by using the teeth 510*t*.

In addition, according to the shower head 401 of the fourth embodiment, the second disc-shaped member 510 is also made of resin. Thus, it is possible to easily achieve high smoothness, which can inhibit sliding resistance (sliding friction). In addition, it is unnecessary to separately provide a seal part.

In addition, according to the shower head 401 of the fourth embodiment, the second disc-shaped member 510 has the six communication holes 510*h*, and each of the six communication holes 510*h* is configured to open the corresponding pilot hole of the corresponding diaphragm valve 421 to 423 when selectively communicating with the corresponding back-pressure-chamber outlet hole 421*c* to 423*c* provided on the corresponding back pressure chamber 421*b* to 423*b* of the corresponding diaphragm valve 421 to 423, in response to a rotational position of the second disc-shaped member 510. Thus, the shower head 401 is made to be more compact. In addition, a rotation angle (moving distance) of the second disc-shaped member 510 (pilot valve) is sufficiently small (no more than 30 degrees), which contributes to a further reduction of the operating force.

In addition, according to the shower head 401 of the fourth embodiment, the disc-pushing member 430 is interposed between the corresponding back-pressure-chamber outlet hole 421*c* to 423*c* and the second disc-shaped member 510, and the disc-pushing member 430 is configured to push the second disc-shaped member 510, the valve-seat member 610 and the first disc-shaped member 410 away from the corresponding back-pressure-chamber outlet hole 421*c* to 423*c* by means of the coil spring 435. Thus, it is unnecessary to provide a seal part between the first disc-shaped member 410 and the element part 440 (a member located away from the back-pressure-chamber outlet holes 421*c* to 423*c* with respect to the first disc-shaped member 410).

In addition, according to the shower head 401 of the fourth embodiment, the gap formed by the spacing member 438 or the like, which communicates with the region around the disc-pushing member 430, is configured to function as a corresponding back-pressure-chamber inlet hole. It is easy to form the gap with high precision, and thus it is possible to effectively inhibit variation in performance among the three back-pressure-chamber inlet holes (the three gaps) for the three diaphragm valves 421 to 423.

In addition, according to the shower head 401 of the fourth embodiment, by using a driving mechanism including: the first push button 411 configured to receive an operation force from a user; the shaft part 412 configured to reciprocate in the axial direction thereof every time the first push button 411 receives the operation force; and the claw member 415 attached to the distal end portion of the shaft part 412 and having the claw 415*t* configured to engage with the teeth 410*t* of the first disc-shaped member 410, the first disc-shaped member 410 is rotated when the claw 415*t* draws one of the teeth 410*t* while the shaft part 412 reciprocates. Since the force for driving the first disc-shaped member 410 in rotation is applied in a direction in which the claw 415*t* draws one of the teeth 410*t*, it is possible to prevent (avoid) buckling deformation of the shaft part 412. Thus, rigidity required for the shaft part 412 can be reduced. As a result, it is possible to make the shaft part 412 of not only a rigid material but also a plastic material such as string or an elastic material such as rubber.

In particular, according to the shower head 401 of the fourth embodiment, the proximal end portion of the shaft part 412 is operably connected to the first push button part 411, the coil spring 414 is arranged around the distal end portion of the shaft part 412, the proximal end of the coil spring 414 is fixed to the element part 440, the distal end of the coil spring 414 is fixed to the claw member 415, and the stopper 413 for the claw member 415 is attached to the distal end portion of the shaft part 412. Thus, the claw member 415 is movable relative to the shaft part 412 by deformation of the coil spring 414 (both in the axial direction and in the inclined direction). Thus, after the claw member 415 has drawn one tooth 410*t*, when the claw member 415 is returned to the original position thereof (the state shown in FIG. 25) to engage with the next tooth 410*t*, it is possible to effectively avoid resistance (interference) from the first disc-shaped member 410.

Substantially similarly, according to the shower head 401 of the fourth embodiment, by using a driving mechanism including: the second push button 511 configured to receive an operation force from a user; the shaft part 512 configured to reciprocate in the axial direction thereof every time the second push button 511 receives the operation force; and the claw member 515 attached to the distal end portion of the shaft part 512 and having the claw 515*t* configured to engage with the teeth 510*t* of the second disc-shaped member 510, the second disc-shaped member 510 is rotated when the claw 515*t* draws one of the teeth 510*t* while the shaft part 512 reciprocates. Since the force for driving the second disc-shaped member 510 in rotation is applied in a direction in which the claw 515*t* draws one of the teeth 510*t*, it is possible to prevent (avoid) buckling deformation of the shaft part 512. Thus, rigidity required for the shaft part 512 can be reduced. As a result, it is possible to make the shaft part 512 of not only a rigid material but also a plastic material such as string or an elastic material such as rubber.

In particular, according to the shower head 401 of the fourth embodiment, the proximal end portion of the shaft part 512 is operably connected to the second push button part 511, the coil spring 514 is arranged around the distal end portion of the shaft part 512, the proximal end of the coil spring 514 is fixed to the element part 440, the distal end of the coil spring 514 is fixed to the claw member 515, and the stopper 513 for the claw member 515 is attached to the distal end portion of the shaft part 512. Thus, the claw member 515 is movable relative to the shaft part 512 by deformation of the coil spring 514 (both in the axial direction and in the inclined direction). Thus, after the claw member 515 has drawn one tooth 510*t*, when the claw member 515 is returned to the original position thereof (the state shown in FIG. 28) to engage with the next tooth 510*t*, it is possible to effectively avoid resistance (interference) from the second disc-shaped member 510.

In addition, according to the shower head 401 of the fourth embodiment, the three diaphragm valves 421 to 423 are integrally formed as the one diaphragm member 420, and the seal ring portion 424 is provided at the periphery of the diaphragm member 420. Thus, it is unnecessary to separately provide a seal ring part.

In addition, according to the shower head 401 of the fourth embodiment, each of the three diaphragm valves 421 to 423 is biased in a valve-closing direction by means of the corresponding coil spring 451 to 453. Thus, the movement for opening and closing each of the three diaphragm valves 421 to 423 is stabilized.

[Complement Regarding Flow Paths]

In the shower head 401 of the fourth embodiment as well, the opened/closed state of each of the three diaphragm valves 421 to 423 corresponds to the communicated/blocked state of each of the three flow paths in the secondary-side flow-path member 404 on a one-to-one basis, and just one diaphragm valve is opened at a time in response to a rotational position of the first disc-shaped member 410, so that just one flow path is communicated at the time. However, the present invention is not limited to this matter, For example, by changing an arrangement pattern of the communication holes 410*h* of the first disc-shaped member 410, a plurality of diaphragm valves may be opened at the same time in response to a rotational position of the first disc-shaped member 410, so that a plurality of flow paths may be communicated at the same time to achieve a composite-type spout.

Alternatively, for example, by changing an arrangement pattern of the flow paths in the secondary-side flow-path member 404, a plurality of flow paths may be communicated at the same time to achieve a composite-type spout when a specific diaphragm valve is opened.

What is claimed is:

1. A shower head having a flow path configured to guide water to a plurality of spout holes, the shower head comprising:

a plurality of main valve bodies movably supported in the flow path, a plurality of back pressure chambers, each of which is adjacent to each of the plurality of main valve bodies on an upstream side of the flow path and is configured to contain water supplied from an upstream side of the flow path and to generate a biasing force in a valve-closing direction for closing the corresponding main valve body by the supplied water, a plurality of pilot holes communicating a downstream side of the flow path with the plurality of back pressure chambers, a pilot valve configured to selectively control opened/closed states of the plurality of pilot holes, and an operation part to be operated by a user, configured to cause the pilot valve to switch the opened/closed states of the plurality of pilot holes when operated by the user.

2. The shower head according to claim 1, wherein the pilot valve has a plurality of communication holes, and each of the plurality of communication holes is configured to open a corresponding pilot hole of a corresponding main valve body when selectively communicating with a corresponding back-pressure-chamber outlet hole provided on a corresponding back pressure chamber of the corresponding main valve body.

3. A shower head for which a plurality of spout modes can be switched, the shower head comprising:

a storage chamber configured to store water supplied from a water supply source, a secondary-side flow-path member provided on a spout-surface side with respect to the storage chamber, the secondary-side flow-path member having a plurality of flow paths, each of which corresponds to each of the plurality of spout modes, and a plurality of diaphragm valves, each of which is configured to control a communicated/blocked state between each of the plurality of flow paths and the storage chamber, wherein the plurality of diaphragm valves are two diaphragm valves, a pilot hole for communicating a back pressure chamber of each of the two diaphragm valves with a space outside the storage chamber is collectively located at a middle region between the two diaphragm valves so that the pilot hole is opened and closed by a common pilot valve.

4. A shower head for which a plurality of spout modes can be switched, the shower head comprising:

a storage chamber configured to store water supplied from a water supply source, a secondary-side flow-path member provided on a spout-surface side with respect to the storage chamber, the secondary-side flow-path member having a plurality of flow paths, each of which corresponds to each of the plurality of spout modes, and a plurality of diaphragm valves, each of which is configured to control a communicated/blocked state between each of the plurality of flow paths and the storage chamber, wherein the plurality of diaphragm valves are three or more diaphragm valves which are annularly arranged, a pilot hole for communicating a back pressure chamber of each of the three or more diaphragm valves with a space outside the storage chamber is collectively located at a central region of the three or more diaphragm valves so that the pilot hole is opened and closed by a common pilot valve.

5. The shower head according to claim 4, wherein the common pilot valve is a disc-shaped member supported in a rotatable manner around an axis thereof and having teeth on an outer circumference thereof.

6. The shower head according to claim 5, wherein the disc-shaped member is made of resin.

7. The shower head according to claim 5, wherein the disc-shaped member has a plurality of communication holes, and each of the plurality of communication holes is configured to open a corresponding pilot hole of a corresponding diaphragm valve when selectively communicating with a corresponding back-pressure-chamber outlet hole provided on a corresponding back pressure chamber of the corresponding diaphragm valve, in response to a rotational position of the disc-shaped member.

8. The shower head according to claim 7, wherein a disc-pushing member is interposed between the corresponding back-pressure-chamber outlet hole and the disc-shaped member, the disc-pushing member has an outlet communication hole that can communicate with the corresponding back-pressure-chamber outlet hole provided on the corresponding back pressure chamber of the corresponding diaphragm valve, and the disc-pushing member is configured to push the disc-shaped member away from the corresponding back-pressure-chamber outlet hole by means of a biasing part.

9. The shower head according to claim 8, wherein the outlet communication hole is formed by a tubular part, the tubular part is inserted into the corresponding back-pressure-chamber outlet hole, there remains a gap between the tubular part and the corresponding back-pressure-chamber outlet hole, and the gap is configured to function as a corresponding back-pressure-chamber inlet hole.

10. The shower head according to claim 5, further comprising:

an operation part configured to receive an operation force from a user, a shaft part configured to reciprocate in an axial direction thereof every time the operation part receives the operation force, and a claw member attached to a distal end portion of the shaft part and having a claw configured to engage with the teeth of the disc-shaped member, wherein the disc-shaped member is rotated when the claw draws the teeth while the shaft part reciprocates.

11. The shower head according to claim 10, wherein a proximal end portion of the shaft part is connected to the operation part, a coil spring is arranged around the shaft part, a proximal end of the coil spring is fixed to a shower head housing, a distal end of the coil spring is fixed to the claw member, a stopper for the claw member is attached to a distal end portion of the shaft part, and the claw member is movable relative to the shaft part by deformation of the coil spring.

12. The shower head according to claim 3, wherein the plurality of diaphragm valves are integrally connected as one diaphragm member.

13. The shower head according to claim 12, wherein the diaphragm member has a seal part at a periphery thereof.

14. The shower head according to claim 3, wherein each of the plurality of diaphragm valves is biased in a valve-closing direction by means of an elastic member.

15. The shower head according to claim 4, wherein the plurality of diaphragm valves are integrally connected as one diaphragm member.

16. The shower head according to claim 15, wherein the diaphragm member has a seal part at a periphery thereof.

17. The shower head according to claim 4, wherein each of the plurality of diaphragm valves is biased in a valve-closing direction by means of an elastic member.

* * * * *